US012507759B2

(12) United States Patent
McKenzie et al.

(10) Patent No.: US 12,507,759 B2
(45) Date of Patent: Dec. 30, 2025

(54) ARTICLE OF FOOTWEAR HAVING A FRAME

(71) Applicant: PUMA SE, Herzogenaurach (DE)

(72) Inventors: Carly McKenzie, Herzogenaurach (DE); Sidney Fauconnier, Nuremberg (DE); Romain Girard, Lauf an der Pegnitz (DE); Patrick Donovan, Fuerth (DE); Heiko Frank Desens, Berlin (DE); Daniel Simon Taylor, Tokyo (JP)

(73) Assignee: PUMA SE, Herzogenaurach (DE)

( * ) Notice: Subject to any disclaimer, the term of this patent is extended or adjusted under 35 U.S.C. 154(b) by 111 days.

(21) Appl. No.: 18/099,098

(22) Filed: Jan. 19, 2023

(65) Prior Publication Data

US 2023/0225449 A1 Jul. 20, 2023

Related U.S. Application Data

(60) Provisional application No. 63/300,934, filed on Jan. 19, 2022.

(51) Int. Cl.
*A43B 3/24* (2006.01)
*A43B 9/00* (2006.01)
*A43B 13/12* (2006.01)

(52) U.S. Cl.
CPC ..... *A43B 9/00* (2013.01); *A43B 3/246* (2013.01); *A43B 13/122* (2013.01)

(58) Field of Classification Search
CPC .. A43B 3/16; A43B 3/18; A43B 3/244; A43B 3/246; A43B 13/122; A43B 13/125
See application file for complete search history.

(56) References Cited

U.S. PATENT DOCUMENTS 5,367,791 A * 11/1994 Gross ..... A43B 13/26 36/31
6,915,596 B2 * 7/2005 Grove ..... A43B 13/223 36/15
7,140,129 B2 * 11/2006 Newson ..... A43B 3/244 36/3 R
7,966,748 B2 * 6/2011 Votolato ..... A43C 15/02 36/15
8,225,532 B2 * 7/2012 Chen ..... A43B 17/02 36/15
11,224,263 B2 * 1/2022 Darby ..... A43B 19/00
2005/0188562 A1 * 9/2005 Clarke ..... A43B 3/244 36/3 R (Continued)

*Primary Examiner* — Sharon M Prange
(74) *Attorney, Agent, or Firm* — Quarles & Brady LLP

(57) ABSTRACT

An article of footwear includes an upper having a fastening mechanism, a sole, and a frame having an exterior surface and an interior surface. The sole includes a midsole structure and an outsole structure. The interior surface of the frame is adjacent portions of the midsole structure, the outsole structure, and the upper. The frame further has a lattice-work structure formed by a plurality of apertures extending through the interior and exterior surfaces of the frame such that at least some of the portions of the midsole structure, the outsole structure, and the upper adjacent the interior surface of the frame are exposed through the plurality of apertures. The fastening mechanism includes a fastening member extending through at least one aperture of the plurality of apertures of the frame.

20 Claims, 25 Drawing Sheets

(56) References Cited

U.S. PATENT DOCUMENTS

| | | | | |
|---|---|---|---|---|
| 2009/0071041 | A1* | 3/2009 | Hooper | A43C 11/14<br>36/25 R |
| 2009/0183392 | A1* | 7/2009 | Shane | A43B 3/244<br>12/114.2 |
| 2014/0259779 | A1* | 9/2014 | Hashish | A43B 7/1445<br>12/142 R |
| 2016/0044988 | A1* | 2/2016 | Delgorgue | A43B 3/16<br>36/131 |
| 2019/0116925 | A1* | 4/2019 | Darby | A43B 7/1405 |

* cited by examiner

ARTICLE OF FOOTWEAR HAVING A FRAME

CROSS REFERENCE TO RELATED APPLICATIONS

This application claims the benefit of priority from U.S. Provisional Application No. 63/300,934, filed Jan. 19, 2022, the contents of which are incorporated herein by reference in its entirety.

REFERENCE REGARDING FEDERALLY SPONSORED RESEARCH OR DEVELOPMENT

Not applicable

SEQUENCE LISTING

Not applicable

BACKGROUND

1. Field of the Invention

The present disclosure relates generally to an article of footwear including a frame.

2. Description of the Background

Many conventional shoes or other articles of footwear generally comprise an upper and a sole attached to a lower end of the upper. Conventional shoes further include an internal space, i.e., a void or cavity, which is created by interior surfaces of the upper and sole, that receives a foot of a user before securing the shoe to the foot. The sole is attached to a lower surface or boundary of the upper and is positioned between the upper and a ground surface. As a result, the sole typically provides stability and cushioning to the user when the shoe is being worn. In some instances, the sole may include multiple components, such as an outsole, a midsole, and a top portion. The outsole may provide traction to a bottom surface of the sole, and the midsole may be attached to an inner surface of the outsole and may provide cushioning or added stability to the sole. For example, a sole may include a particular foam material that may increase stability at one or more desired locations along the sole, or a foam material that may reduce stress or impact energy on the foot or leg when a user is running, walking, or engaged in another activity. The sole may also include additional components, such as plates, embedded with the sole to increase the overall stiffness of the sole and reduce energy loss during use.

The upper generally extends upward from the sole and defines an interior cavity that completely or partially encases a foot. In most cases, the upper extends over the instep and toe regions of the foot, and across medial and lateral sides thereof. Many articles of footwear may also include a tongue that extends across the instep region to bridge a gap between edges of medial and lateral sides of the upper, which collectively define an opening into the cavity. The tongue may also be disposed below a lacing system and between medial and lateral sides of the upper, to allow for adjustment of shoe tightness. The tongue may further be manipulatable by a user to permit entry or exit of a foot from the internal space or cavity. In addition, the lacing system may allow a user to adjust certain dimensions of the upper or the sole, thereby allowing the upper to accommodate a wide variety of foot types having varying sizes and shapes.

The upper of many shoes may comprise a wide variety of materials, which may be utilized to form the upper and chosen for use based on one or more intended uses of the shoe. The upper may also include portions comprising varying materials specific to a particular area of the upper. For example, added stability may be desirable at a front of the upper or adjacent a heel region so as to provide a higher degree of resistance or rigidity. In contrast, other portions of a shoe may include a soft woven textile to provide an area with stretch-resistance, flexibility, air-permeability, or moisture-wicking properties.

Sole assemblies generally extend between a ground surface and the upper. In some examples, the sole assembly includes an outsole that provides abrasion-resistance and traction with the ground surface. The outsole may be formed from rubber or other materials that impart durability and wear-resistance, and enhance traction with the ground surface.

While many currently-available shoes have varying features related to the above-noted properties, many shoes, including athletic shoes, and even more so running shoes, have sole structures in which the outsole may wear faster than the rest of the sole structure and/or the upper of the shoe. This results in users needing to replace entire sets of shoes even though the upper and the sole structure, other than the outsole, have not yet worn to a condition requiring replacement. Further, some physical activities have differing support requirements at different locations of the sole structure and/or upper of shoes, including athletic shoes, to benefit the user of the shoe during such physical activities. For example, for traditional running activity, increased support in the heel region of the shoe may be beneficial to a user of the shoe, while for traditional cross training activity, increased support along the lateral and medial sides of the shoe may be beneficial to a user of the shoe.

Therefore, articles of footwear having features that permit the outsole of the sole structure to be replaced and/or that permit the sole structure to be customized by a user are desired. These and other deficiencies with the prior art are addressed by the following disclosure.

SUMMARY

An article of footwear, as described herein, may have various configurations. The article of footwear may have an upper and a sole structure connected to the upper.

In some aspects, the present disclosure provides an article of footwear having an upper with a fastening mechanism, a sole structure including a midsole and an outsole, and a frame. The frame can have an exterior surface and an interior surface opposite the exterior surface. The interior surface of the frame can be adjacent portions of the midsole, the outsole, and the upper. The frame can further have a latticework structure formed by a plurality of apertures extending through the interior and exterior surfaces of the frame such that at least some of the portions of the midsole, the outsole, and the upper adjacent the interior surface of the frame are exposed through the plurality of apertures. The fastening mechanism of the upper can include a fastening member that extends through at least one aperture of the plurality of apertures of the frame.

In some embodiments, the frame can extend along a medial side and a lateral side of the article of footwear. In such embodiments, the lattice-work structure of the frame may extend along at least the lateral side of the article of footwear.

In some embodiments, the frame can extend along a medial side, a lateral side, and a heel region of the article of footwear. In such embodiments, the lattice-work structure of the frame may extend along at least the lateral side and the heel region of the article of footwear.

In some embodiments, the lattice work structure of the frame may extend along a percentage in a range of about 5% to about 60% of an exterior surface of the upper.

In some embodiments, the fastening member of the fastening mechanism can be a lace. In some embodiments, the fastening member of the fastening mechanism can be a hook and a loop that can be configured to removably engage the hook.

In some embodiments, a percentage in a range of about 30% to about 90% of the frame can include the lattice-work structure. In some embodiments, a percentage in a range of about 60% to about 90% of the frame includes the lattice-work structure.

In some embodiments, the lattice-work structure of the frame can be formed of a material that is configured to adapt to a wearer's foot. In some embodiments, the lattice-work structure of the frame may be formed of a material that can be configured to elastically deform under tension that can be exerted by the fastening member of the fastening mechanism. In some embodiments, portions of the lattice-work structure of the frame adjacent the outsole can have a greater stiffness than portions of the lattice-work structure of the frame adjacent the midsole.

In some embodiments, the frame of the article of footwear can further include an outsole member that may at least partially define the outsole of the sole structure. In some such embodiments, the outsole member may be disposed between the midsole and the interior surface of the frame along a bottom side of the frame. In other such embodiments, the outsole member can be disposed on the exterior surface of the frame along a bottom side of the frame.

In other aspects, the present disclosure provides a frame for an article of footwear that includes an upper and a sole structure. The frame can have a lattice-work structure that can be formed by a plurality of apertures extending through an exterior surface and an interior surface of the frame. The interior surface of the frame may be configured for placement adjacent portions of a midsole and an outsole of the sole structure. The frame can be configured to be removably attachable to at least the sole structure of the article of footwear such that, when the frame is removably attached to the article of footwear, at least some of the portions of the midsole and the outsole adjacent the interior surface of the frame can be exposed through the plurality of apertures of the frame In some embodiments, the frame can further include a removable outsole member that may be disposed adjacent a bottom side of the frame.

In some embodiments, two or more apertures of the plurality of apertures of the frame can be configured to receive a portion of a lace of the upper to secure the frame to the sole structure of the article of footwear. In such embodiments, at least portions of the lattice-work structure of the frame can be configured to elastically deform under tension when the lace received within the two or more apertures of the plurality of apertures is in a tightened configuration.

In some aspects, the present disclosure provides an article of footwear that may include an upper, a sole structure having a midsole and an outsole, and a frame. The frame can have an exterior surface and an interior surface. The interior surface of the frame can be adjacent portions of the midsole, the outsole, and the upper in a heel region of the article of footwear. The frame can have a lattice-work structure formed by a plurality of apertures extending through the interior and exterior surfaces of the frame such that at least some of the portions of the midsole, the outsole, and the upper adjacent the interior surface of the frame can be exposed through the plurality of apertures. The frame can be removably attached to at least the sole structure of the article of footwear.

In some embodiments, the portion of the midsole in the heel region adjacent the interior surface of the frame can include a plurality of midsole members that may be removably attached to a bottom side of the upper. In such embodiments, the frame may extend over the plurality of midsole members of the sole structure. In such embodiments, the frame can further include an outsole member that can be disposed between the plurality of midsole members and the interior surface of the frame along a bottom side of the frame.

Other aspects of the article of footwear, including features and advantages thereof, will become apparent to one of ordinary skill in the art upon examination of the figures and detailed description herein. Therefore, all such aspects of the article of footwear are intended to be included in the detailed description and this summary.

DETAILED DESCRIPTION OF THE DRAWINGS

Figure 1:
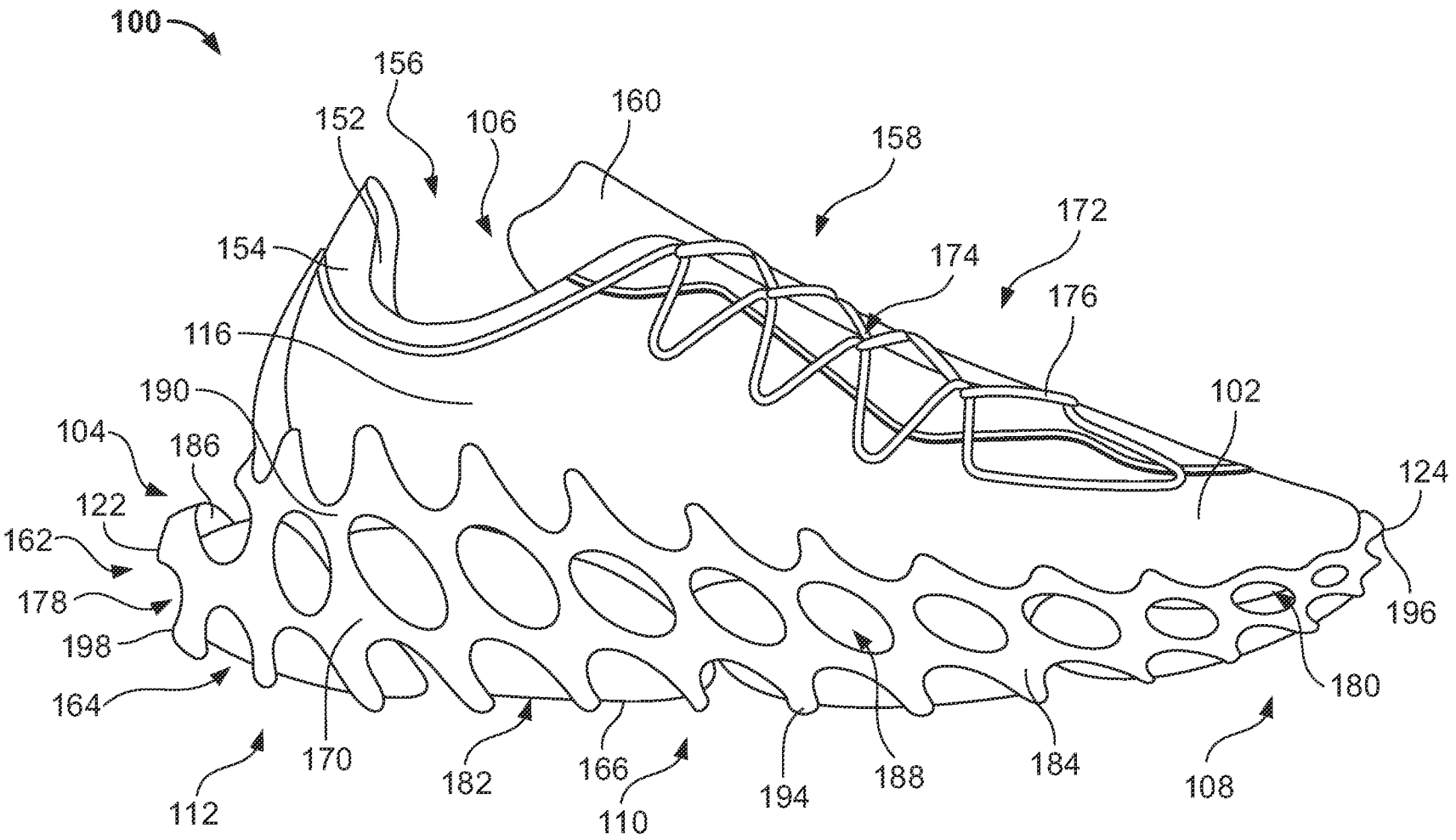
FIG. 1 is a lateral side view of an article of footwear configured as a right shoe that includes an upper, a sole structure, and a frame, according to an embodiment of the disclosure.

The following discussion and accompanying figures disclose various embodiments or configurations of a shoe and a sole structure. Although embodiments of a shoe or sole structure are disclosed with reference to a sports shoe, such as a running shoe, tennis shoe, basketball shoe, etc., concepts associated with embodiments of the shoe or the sole structure may be applied to a wide range of footwear and footwear styles, such as, e.g., cross-training shoes, football shoes, golf shoes, hiking shoes, hiking boots, ski and snowboard boots, soccer shoes and cleats, walking shoes, and track cleats, for example. Concepts of the shoe or the sole structure may also be applied to articles of footwear that are considered non-athletic, including dress shoes, sandals, loafers, slippers, and heels. In addition to footwear, particular concepts described herein may also be applied and incorporated in other types of apparel or other athletic equipment, such as, e.g., helmets, padding or protective pads, shin guards, and gloves. Even further, particular concepts described herein may be incorporated in other consumer or industrial products, such as, e.g., cushions, backpack straps, and golf clubs. Accordingly, concepts described herein may be utilized in a variety of products.

The term "about," as used herein, refers to variation in the numerical quantity that may occur, for example, through typical measuring and manufacturing procedures used for articles of footwear or other articles of manufacture that may include embodiments of the disclosure herein; through inadvertent error in these procedures; through differences in the manufacture, source, or purity of the ingredients used to make the compositions or mixtures or carry out the methods; and the like. Throughout the disclosure, the terms "about" and "approximately" refer to a range of values±5% of the numeric value that the term precedes.

Further, as used herein, unless otherwise defined or limited, directional terms are used for convenience of reference for discussion of particular figures or examples. For example, references to "downward," or other directions, or "lower" or other positions, may be used to discuss aspects of a particular example or figure, but do not necessarily require similar orientation or geometry in all installations or configurations.

The terms "first," "second," "third," etc. may be used herein to describe various elements, components, regions, layers, and/or sections. These elements, components, regions, layers, and/or sections should not be limited by these terms. These terms may be only used to distinguish one element, component, region, layer, or section from another region, layer, or section. Terms such as "first," "second," and other numerical terms do not imply a sequence or order unless clearly indicated by the context. Thus, a first element, component, region, layer, or section discussed below could be termed a second element, component, region, layer, or section without departing from the teachings of the example configurations.

The present disclosure is directed to an article of footwear and/or specific components of the article of footwear, such as an upper and/or a sole or sole structure. The upper may comprise a knitted component, a woven textile, and/or a non-woven textile. The knitted component may be made by knitting of yarn, the woven textile by weaving of yarn, and the non-woven textile by manufacture of a unitary non-woven web. Knitted textiles include textiles formed by way of warp knitting, weft knitting, flat knitting, circular knitting, and/or other suitable knitting operations. The knit textile may have a plain knit structure, a mesh knit structure, and/or a rib knit structure, for example. Woven textiles include, but are not limited to, textiles formed by way of any of the numerous weave forms, such as plain weave, twill weave, satin weave, dobbin weave, jacquard weave, double weaves, and/or double cloth weaves, for example. Non-woven textiles include textiles made by air-laid and/or spun-laid methods, for example. The upper may comprise a variety of materials, such as a first yarn, a second yarn, and/or a third yarn, which may have varying properties or varying visual characteristics.

In addition, the present disclosure relates to an article of footwear having a sole structure attached to an upper and a frame attached to the sole structure and/or the upper. The sole structure may include a midsole and an outsole. Each of the midsole and the outsole may be separate components coupled with one another, or one or more of these elements may be integrally formed with each other. The midsole may be made of a foam material and is disposed between and connects the upper with the outsole. The midsole may cushion the impact from a user's foot contacting the ground. The outsole may be attached to the midsole to define a bottom surface of the shoe. The outsole may be made from a rubber material and is configured to contact the ground and provide traction. The outsole may include one or more sections, for example, a heel section and a forefoot section, although the outsole may include more than two sections at different areas, or it may be a single component. The frame may be made of a rigid plastic, such as thermoplastic polyurethane (TPU), or from another type of plastic or composite, and is provided to increase structural support and/or contain components of the sole structure. In particular, the frame may wrap around the sole structure and has portions on both the lateral and medial sides of the article of footwear. Further, the frame can be configured to removably attach to the shoe, e.g., the sole structure and/or the upper. In some embodiments, the frame can be further configured to receive outsole members disposed between the frame and the midsole, in which the outsole members can function as the outsole of the shoe. Thus, the frame can provide customized support to the shoe while further providing a means to replace the outsole of the shoe.

A frame is an elongate member that is coupled with and wraps around the sole structure and/or portions of the upper. The frame has an inner surface facing the article of footwear, which is configured to couple with the sole structure, and further, at least a portion of the upper when the sole structure is connected with the upper in some embodiments. The frame also has an outer surface, which, in some embodiments, may be smooth, contoured, or have other features such as apertures. The frame may be contoured, for example, to match adjacent portions of the sole structure and/or the upper. Such features can be used to tune the flexibility of the frame, making it stiffer in some portions, or along some directions, such as the length of the frame. Further, the frame may serve to add to the decorative nature of the shoe. Furthermore, the frame may have edges that are generally smooth and curvilinear, wavy, zig-zag, or otherwise undulate. Some portions of the frame, for example, those portions adjacent the bottom surface, may have one or more flanges extending therefrom. In such embodiments, the flanges of the frame may be disposed between the midsole, the outsole, and/or the upper to aid in securing the frame to the sole structure and/or the upper.

As noted above, the frame wraps around the sole structure. In particular, the frame may define a first or distal end in a forefoot region proximate a medial side and a lateral side. The distal end may be located adjacent the bottom surface of the sole structure or it may extend partially onto the side of the midsole or the upper. The frame may extend rearward along the bottom surface of the sole structure proximate the medial side and the lateral side to a second or proximate end in a heel region. The frame may extend above the midsole near the forefoot region, the midfoot region, and/or the heel region, so that it connects with the upper. The frame may also wrap around the periphery of a heel region from the lateral side to the medial side, extending forward and ending at the distal end near or adjacent to the midfoot region or the forefoot region. The frame may be configured to connect with the sole structure and/or the upper on at least a portion of its length.

The following discussion and accompanying figures disclose various embodiments or configurations of an article of footwear. The article of footwear can be provided as a pair of shoes including a first or left shoe and a second or right shoe. The left shoe and the right shoe may be similar in all material aspects, except that the left shoe and the right shoe are sized and shaped to receive a left foot and a right foot of a user, respectively. For ease of disclosure, a single shoe or article of footwear will be referenced to describe aspects of the disclosure. In some figures, the article of footwear is depicted as a right shoe, and in some figures the article of footwear is depicted as a left shoe. The disclosure below with reference to the article of footwear is applicable to both the left shoe and the right shoe. In some embodiments, there may be differences between the left shoe and the right shoe other than the left/right configuration. For example, in some embodiments, the left shoe may include a frame, while the right shoe may not include the frame, or vice versa. Further, in some embodiments, the left shoe may include one or more additional elements that the right shoe does not include, or vice versa.

FIGS. 1-5 depict an exemplary embodiment of an article of footwear 100 including an upper 102 and a sole structure 104. Referring specifically to FIG. 1, the upper 102 is attached to the sole structure 104, which together define an interior cavity 106 (see FIGS. 2 and 3) into which a foot of a user may be inserted. Many conventional footwear uppers are formed from multiple elements (such as, e.g., textiles, polymer foam, polymer sheets, leather, and synthetic leather) that are joined through bonding or stitching at a seam. In some embodiments, the upper 102 of the article of footwear 100 is formed from a knitted structure or knitted components. In various embodiments, a knitted component may incorporate various types of yarn that may provide different properties to an upper. For example, one area of the upper 102 may be formed from a first type of yarn that imparts a first set of properties, and another area of the upper 102 may be formed from a second type of yarn that imparts a second set of properties. Using this configuration, properties of the upper 102 may vary throughout the upper 102 by selecting specific yarns for different areas of the upper 102.

With reference to the material(s) that comprise the upper 102, the specific properties that a particular type of yarn will impart to an area of a knitted component may at least partially depend upon the materials that form the various filaments and fibers of the yarn. For example, cotton may provide a soft effect, biodegradability, or a natural aesthetic to a knitted material. Elastane and stretch polyester may each provide a knitted component with a desired elasticity and recovery. Rayon may provide a high luster and moisture absorbent material, wool may provide a material with an increased moisture absorbance, nylon may be a durable material that is abrasion-resistant, and polyester may provide a hydrophobic, durable material.

Other aspects of a knitted component may also be varied to affect the properties of the knitted component and provide desired attributes. For example, a yarn forming a knitted component may include monofilament yarn or multifilament yarn, or the yarn may include filaments that are each formed of two or more different materials. In addition, a knitted component may be formed using a particular knitting process to impart an area of a knitted component with particular properties. Accordingly, both the materials forming the yarn and other aspects of the yarn may be selected to impart a variety of properties to particular areas of the upper 102.

In some embodiments, an elasticity of a knit structure may be measured based on comparing a width or length of the knit structure in a first, non-stretched state to a width or length of the knit structure in a second, stretched state after the knit structure has a force applied to the knit structure in a lateral direction. In further embodiments, the upper 102 may also include additional structural elements. For example, in some embodiments, a heel plate or cover (not shown) may be provided on the heel region 112 to provide added support to a heel of a user. In some instances, other elements, e.g., plastic material, logos, trademarks, etc., may also be applied and fixed to an exterior surface using glue or a thermoforming process. In some embodiments, the properties associated with the upper 102, e.g., a stitch type, a yarn type, or characteristics associated with different stitch types or yarn types, such as elasticity, aesthetic appearance, thickness, air permeability, or scuff-resistance, may be varied.

Figure 2:
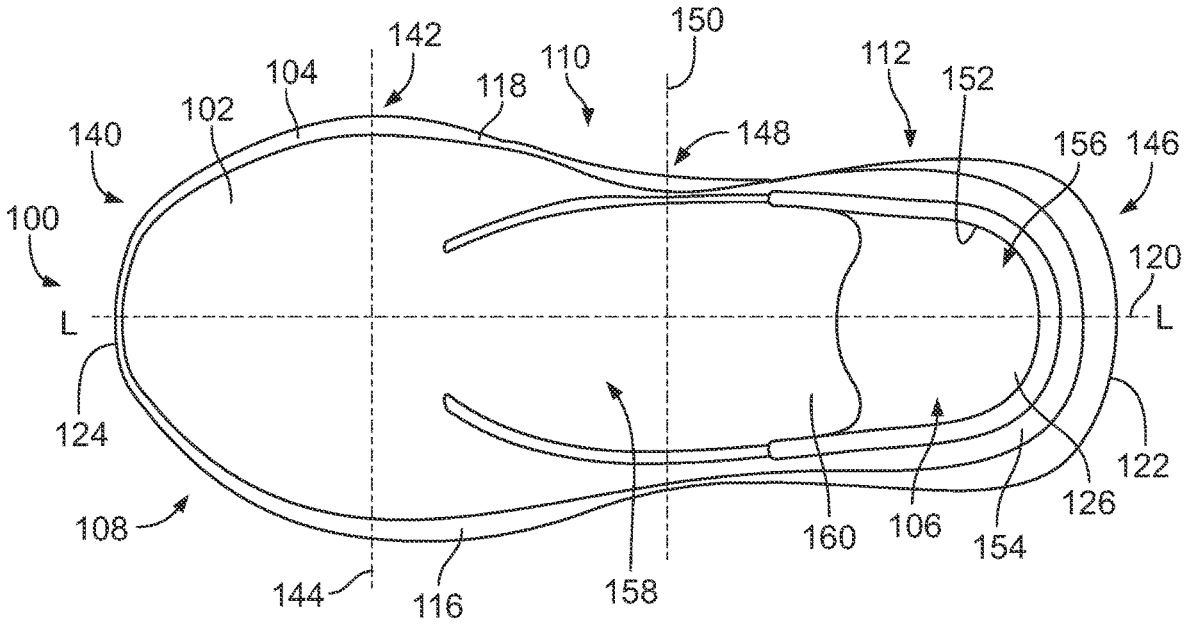
FIG. 2 is a top view of the article of footwear of FIG. 1, with a frame and a lacing mechanism of an upper removed.
Figure 3:
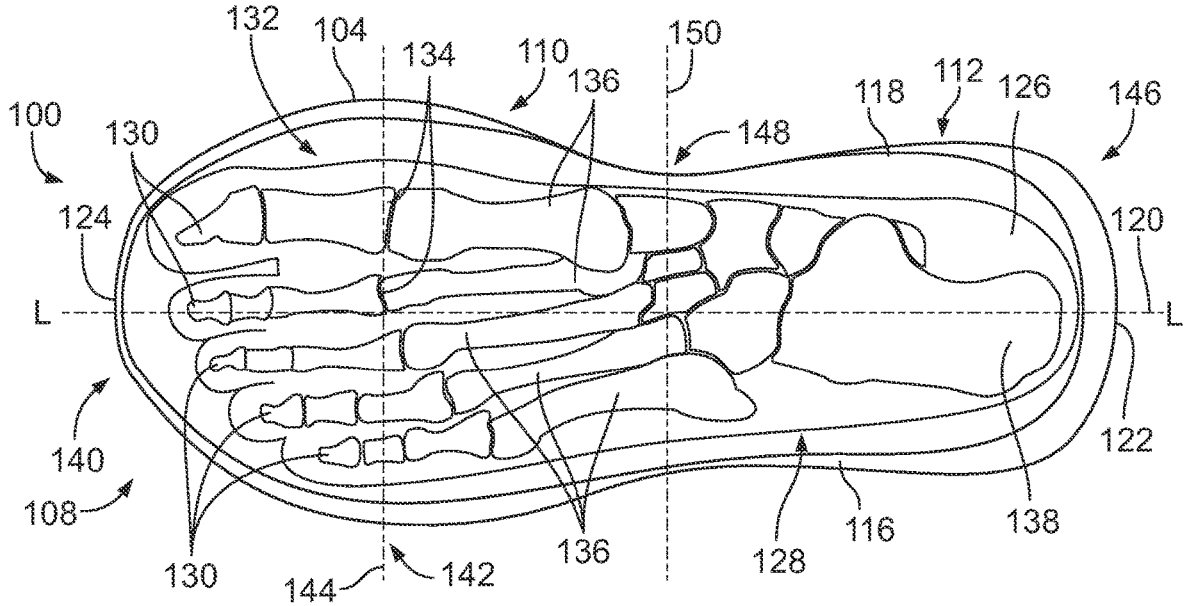
FIG. 3 is a top plan view of the article of footwear of FIG. 1, with an upper removed and a user's skeletal foot structure overlaid thereon.

Referring now to FIGS. 2 and 3, the article of footwear 100 defines a lateral side 116 and a medial side 118. When a user is wearing the shoes, the lateral side 116 corresponds with an outside-facing portion of the article of footwear 100 while the medial side 118 corresponds with an inside-facing portion of the article of footwear 100. As such, the article of footwear 100 has opposing lateral and medial sides 116, 118. The lateral side 116 and the medial side 118 adjoin one another along a longitudinal central plane or axis 120 of the article of footwear 100, which is coplanar with a longitudinal axis L of the article of footwear 100. As will be further discussed herein, the longitudinal central plane or axis 120 may demarcate a central, intermediate axis between the lateral side 116 and the medial side 118 of the article of footwear 100. Put differently, the longitudinal plane or axis 120 may extend between a rear, proximal end 122 of the article of footwear 100 and a front, distal end 124 of the article of footwear 100 and may continuously define a middle of the sole structure 104 and/or the upper 102 of the article of footwear 100, i.e., the longitudinal plane or axis 120 is a straight axis extending through the proximal end 122 to the distal end 124 of the article of footwear 100.

Referring still to FIGS. 2 and 3, the article of footwear 100 may be defined by a forefoot region 108, a midfoot region 110, and a heel region 112, unless otherwise specified. The forefoot region 108 may generally correspond with portions of the article of footwear 100 that encase portions of a foot 128 that include the toes or phalanges 130, the ball of the foot 132, and one or more of the joints 134 that connect the metatarsals 136 of the foot 128 with the toes or phalanges 130 (see FIG. 3). The midfoot region 110 is proximate and adjoins the forefoot region 108. The midfoot region 110 generally corresponds with portions of the article of footwear 100 that encase an arch of the foot 128, along with a bridge of the foot 128 (see FIG. 3). The heel region 112 is proximate to the midfoot region 110 and adjoins the midfoot region 110. The heel region 112 generally corresponds with portions of the article of footwear 100 that encase rear portions of the foot 128, including the heel or calcaneus bone 138 (see FIG. 3), the ankle (not shown), and/or the Achilles tendon (not shown).

Still referring to FIGS. 2 and 3, the forefoot region 108, the midfoot region 110, the heel region 112, the lateral side 116, and the medial side 118 are intended to define boundaries or areas of the article of footwear 100. To that end, the forefoot region 108, the midfoot region 110, the heel region 112, the lateral side 116, and the medial side 118 generally characterize sections of the article of footwear 100. Certain aspects of the disclosure may refer to portions or elements that are coextensive with one or more of the forefoot region 108, the midfoot region 110, the heel region 112, the lateral side 116, and/or the medial side 118. Further, both the upper 102 and the sole structure 104 may be characterized as having portions within the forefoot region 108, the midfoot region 110, the heel region 112, and/or along the lateral side 116 and/or the medial side 118. Therefore, the upper 102 and the sole structure 104, and/or individual portions of the upper 102 and the sole structure 104, may include portions thereof that are disposed within the forefoot region 108, the midfoot region 110, the heel region 112, and/or along the lateral side 116 and/or the medial side 118.

With continued reference to FIGS. 2 and 3, the forefoot region 108, the midfoot region 110, the heel region 112, the lateral side 116, and the medial side 118 are shown in detail. The forefoot region 108 extends from a toe end 140 to a widest portion 142 of the article of footwear 100. The widest portion 142 is defined or measured along a first line 144 that is perpendicular with respect to the longitudinal axis 120 that extends from a distal portion of the toe end 140 to a distal portion of a heel end 146, which is opposite the toe end 140. The midfoot region 110 extends from the widest portion 142 to a thinnest portion 148 of the article of footwear 100. The thinnest portion 148 of the article of footwear 100 is defined as the thinnest portion of the article of footwear 100 measured across a second line 150 that is perpendicular with respect to the longitudinal axis 120. The heel region 112 extends from the thinnest portion 148 to the heel end 146 of the article of footwear 100.

It should be understood that numerous modifications may be apparent to those skilled in the art in view of the foregoing description, and individual components thereof, may be incorporated into numerous articles of footwear. Accordingly, aspects of the article of footwear 100 and components thereof, may be described with reference to general areas or portions of the article of footwear 100, with an understanding the boundaries of the forefoot region 108, the midfoot region 110, the heel region 112, the lateral side 116, and/or the medial side 118 as described herein may vary between articles of footwear. However, aspects of the article of footwear 100 and individual components thereof, may also be described with reference to exact areas or portions of the article of footwear 100 and the scope of the appended claims herein may incorporate the limitations associated with these boundaries of the forefoot region 108, the midfoot region 110, the heel region 112, the lateral side 116, and/or the medial side 118 discussed herein.

Referring still to FIGS. 2 and 3, the lateral side 116 begins at the distal, toe end 140 and bows outward along an outer side of the article of footwear 100 along the forefoot region 108 toward the midfoot region 110. The lateral side 116 reaches the first line 144, at which point the lateral side 116 bows inward, toward the longitudinal, central axis 120. The lateral side 116 extends from the first line 144, i.e., the widest portion 142, toward the second line 150, i.e., the thinnest portion 148, at which point the lateral side 116 enters into the midfoot region 110, i.e., upon crossing the first line 144. Once reaching the second line 150, the lateral side 116 bows outward, away from the longitudinal, central axis 120, at which point the lateral side 116 extends into the heel region 112, i.e., upon crossing the second line 150. The lateral side 116 then bows outward and then inward toward the heel end 146, and terminates at a point where the lateral side 116 meets the longitudinal, central axis 120.

The medial side 118 also begins at the distal, toe end 140 and bows outward along an inner side of the article of footwear 100 along the forefoot region 108 toward the midfoot region 110. The medial side 118 reaches the first line 144, at which point the medial side 118 bows inward, toward the central, longitudinal axis 120. The medial side 118 extends from the first line 144, i.e., the widest portion 142, toward the second line 150, i.e., the thinnest portion 148, at which point the medial side 118 enters into the midfoot region 110, i.e., upon crossing the first line 144. Once reaching the second line 150, the medial side 118 bows outward, away from the longitudinal, central axis 120, at which point the medial side 118 extends into the heel region 112, i.e., upon crossing the second line 150. The medial side 118 then bows outward and then inward toward the heel end 146, and terminates at a point where the medial side 118 meets the longitudinal, central axis 120.

With continued reference to FIGS. 2 and 3, the upper 102 extends along the lateral and medial sides 116, 118, and across the forefoot, midfoot, and heel regions 108, 110, 112 to house and enclose the foot 128 of a user (see FIG. 3). With specific reference to FIG. 2, when fully assembled, the upper 102 also includes an interior surface 152 and an exterior surface 154. The interior surface 152 faces inward and generally defines the interior cavity 106, and the exterior surface 154 of the upper 102 faces outward and generally defines an outer perimeter or boundary of the upper 102. The upper 102 also includes an opening 156 that is at least partially located in the heel region 112 of the article of footwear 100, which provides access to the interior cavity 106 and through which the foot 128 (see FIG. 3) may be inserted and removed. In some embodiments, the upper 102 may also include an instep region 158 that extends from the opening 156 in the heel region 112 over an area corresponding to an instep of a foot to an area proximate the forefoot region 108. The instep region 158 may comprise an area similar to where a tongue 160 of the present embodiment is disposed. In some embodiments, the upper 102 does not include the tongue 160, i.e., the upper 102 is tongueless.

Referring again to FIG. 1, the sole structure 104 is connected or secured to the upper 102 and extends between the foot 128 (see FIG. 3) of a user and a ground surface (not shown) when the article of footwear 100 is worn by the user. In the illustrated embodiment, the sole structure 104 includes a midsole or midsole region 162 and an outsole or outsole region 164. The outsole region 164 may define a bottom end or bottom surface 166 of the sole structure 104 across the heel region 112, the midfoot region 110, and the forefoot region 108. Further, the outsole region 164 may be a ground-engaging portion or include a ground-engaging surface (e.g., the bottom surface 166) of the sole structure 104. The outsole region 164 may be formed from one or more materials to impart durability, wear-resistance, abrasion resistance, or traction to the sole structure 104. In some embodiments, the outsole region 164 may be formed from any kind of elastomer material, e.g., rubber, including thermoset elastomers or thermoplastic elastomers, or a thermoplastic material, e.g., TPU. In some embodiments, the outsole region 164 may define a shore A hardness up to 95.

Still referring to FIG. 1, the midsole region 162 may be individually constructed from a thermoplastic material, such as polyurethane (PU), for example, and/or an ethylene-vinyl acetate (EVA), copolymers thereof, or a similar type of material. In other embodiments, the midsole region 162 may be an EVA-Solid-Sponge ("ESS") material, an EVA foam (e.g., PUMA® ProFoam Lite™, IGNITE Foam), polyurethane, polyether, an olefin block copolymer, organosheets, a thermoplastic material (e.g., a thermoplastic polyurethane, a thermoplastic elastomer, a thermoplastic polyolefin, etc.), or a supercritical foam. The midsole region 162 may be a single polymeric material or may be a blend of materials, such as an EVA copolymer, a thermoplastic polyurethane, a polyether block amide (PEBA) copolymer, and/or an olefin block copolymer. One example of a PEBA material is PEBAX®. In some embodiments, the midsole region 162 is manufactured by a process involving injection molding, vulcanization, printing layer by layer, i.e., additive manufacturing systems or methods, and the like.

In embodiments where the midsole region 162 is formed from a supercritical foaming process, the supercritical foam may comprise micropore foams or particle foams, such as a TPU, EVA, PEBAX®, or mixtures thereof, manufactured using a process that is performed within an autoclave, an injection molding apparatus, or any sufficiently heated/pressurized container that can process the mixing of a supercritical fluid (e.g., $CO_2$, $N_2$, or mixtures thereof) with a material (e.g., TPU, EVA, polyolefin elastomer, or mixtures thereof) that is preferably molten. During an exemplary process, a solution of supercritical fluid and molten material is pumped into a pressurized container, after which the pressure within the container is released, such that the molecules of the supercritical fluid rapidly convert to gas to form small pockets within the material and cause the material to expand into a foam. In further embodiments, the midsole region 162 may be formed using alternative methods known in the art, including the use of an expansion press, an injection machine, a pellet expansion process, a cold foaming process, a compression molding technique, die cutting, or any combination thereof. For example, the midsole region 162 may be formed using a process that involves an initial foaming step in which supercritical gas is used to foam a material and then compression molded or die cut to a particular shape.

Referring again to FIG. 2, the sole structure 104 may further include an insole 126 disposed above the midsole region 162 (see FIG. 1). The insole 126 may be a strobel board, a forefoot board, a lasting board, etc., or a combination thereof. In some embodiments, the insole 126 may be provided between the upper 102 and the sole structure 104. In some embodiments, the insole 126 may be provided as part of the upper 102. Furthermore, the insole 126 can be positioned within the interior cavity 106 of the upper 102, which can be in direct contact with the user's foot 128 (see FIG. 3) while the article of footwear 100 is being worn. Moreover, the upper 102 may also include a liner (not shown) that can increase comfort, for example, by reducing friction between the foot 128 (see FIG. 3) of the user and the upper 102, the insole 126, and/or other components of the sole structure 104, and/or by providing moisture wicking properties. The liner may line the entirety of the interior cavity 106 or only a portion thereof. In some embodiments, a binding (not shown) may surround the opening 156 of the interior cavity 106 to secure the liner to the upper 102 and/or to provide an aesthetic element to the article of footwear 100.

Referring again to FIG. 1, the upper 102 includes a fastening mechanism 172 that defines a plurality of first fastening members or lace retainers 174 disposed on the lateral side 116 and medial side 118 (see FIG. 4) of the article of footwear 100 adjacent to the tongue 160. The lace retainers 174 are configured to receive a second fastening member or lace 176 that can extend in a crisscrossing manner across the tongue 160 and through the lace retainers 174. In some embodiments, the lace 176 extends through the lace retainers 174 disposed on the lateral side 116 of the upper 102, across the tongue 160 and the instep region 158, and through the lace retainers 174 disposed on the medial side 118 of the upper 102. In some embodiments, the lace 176 has free ends that can be tied together by the user. In some embodiments, the lace 176 comprises two laces each having a first end that is fixed to the upper 102 and a second end that is free, such that the second ends of the two laces can be tied together by the user. In some embodiments, the lace 176 may be a closed loop lace that is tightened manually and/or automatically by a tightening mechanism (not shown). In some embodiments, the fastening mechanism 172 includes more than one plurality of lace retainers 174 that are configured to receive one or more laces 176.

Still referring to FIG. 1, and as discussed above, the sole structure 104 includes the midsole or midsole region 162 and the outsole or outsole region 164. In the illustrated embodiment, the midsole region 162 includes a plurality of midsole members 178 disposed along the forefoot region 108, the midfoot region 110, and the heel region 112. The plurality of midsole members 178 may have varying properties, including different shapes, colors, thicknesses, and/or widths. In some embodiments, the midsole members 178 have other properties that vary between one or more midsole members 178, such as the color. In some embodiments, and as discussed further below, one or more of the midsole members 178 can be comprised of different materials than the material comprising the other midsole members 178. For example, in some embodiments, the midsole members 178 disposed in the heel region 112 are comprised of a different material than the midsole members 178 disposed in the forefoot region 108 and/or the midfoot region 110. In some embodiments, the midsole members 178 can define both the midsole 162 and the outsole 164 of the sole structure 104.

The plurality of midsole members 178 each have an upper portion 180 and a bottom portion 182. In the illustrated embodiment, the bottom portions 182 of the plurality of midsole members 178 define the outsole 164 of the sole structure 104 and are configured to at least partially contact the ground while providing traction to a user wearing the article of footwear 100. The upper 102 is connected to the upper portion 180 of the midsole members 178. In some embodiments, the upper 102 may be attached to the upper portions 180 of the midsole members 178 by a glue or other adhesive. In some embodiments, the upper portions 180 of the plurality of midsole members 178 form a continuous surface. In such embodiments, the continuous surface of the upper portions 180 may function as the insole 126 (see FIG. 2) of the article of footwear 100. In some embodiments, one or more gaps are present between the upper portions 180 of the plurality of midsole members 178. In some embodiments, the insole 126 (see FIG. 2) is connected to the upper portions 180 of the plurality of midsole members 178. In such embodiments, the upper 102 may be connected to the insole 126 of the sole structure 104.

Figure 4:
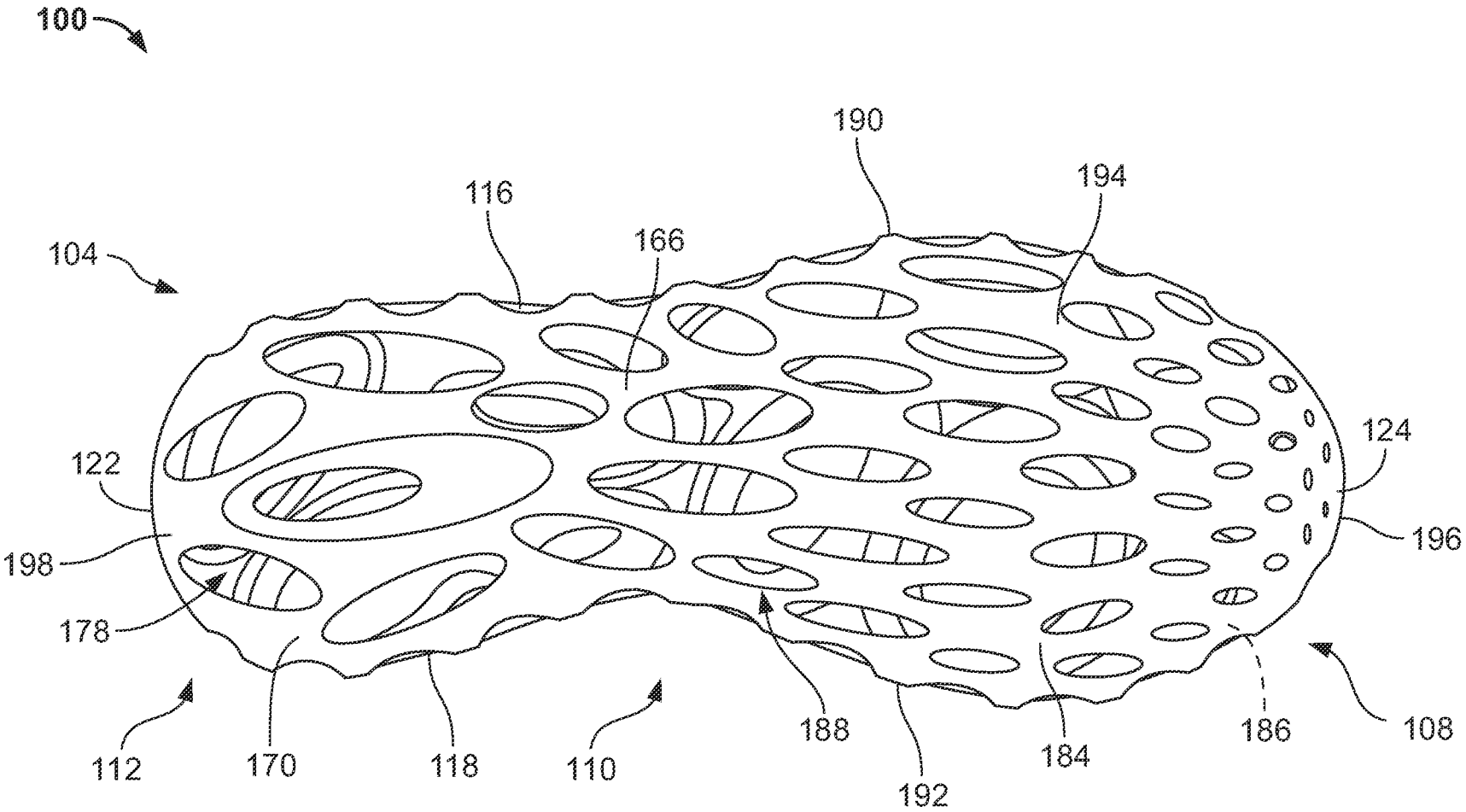
FIG. 4 is a bottom view of the article of footwear of FIG. 1.

Referring specifically to FIGS. 1 and 4, the article of footwear 100 also includes a frame 170. The frame 170 is an elongate member that wraps around the midsole region 162 and the outsole region 164 of the sole structure 104 (i.e., the plurality of midsole members 178 in the illustrated embodiment). In the illustrated embodiment, the frame 170 also wraps at least partially around lower portions of the upper 102 (see FIG. 4). Thus, in the illustrated embodiment, the frame 170 wraps around at least portions of the lateral side 116, the medial side 118 (see FIG. 2), the proximal end 122, the distal end 124, the forefoot region 108, the midfoot region 110, and the heel region 112 of the article of footwear 100. The frame 170 is a unitary body that can be made from a plastic material, such as TPU. In some embodiments, the frame 170 is made from a translucent TPU or another translucent material. Furthermore, two or more portions of the frame 170 may be comprised of two or more materials that have varying properties relative to each other. For example, in some embodiments, the frame 170 may have a portion comprising TPU and another portion comprising a composite.

The frame 170 may be configured to be removably attached to the sole structure 104 and/or the upper 102. In such embodiments, the frame 170 may be configured to include a plurality of frames having differing geometric and/or material properties that can each be removably attached to the sole structure 104 by the user to provide a specific support structure desired by the user for a particular physical activity. Further, as discussed below, the frame 170 may be configured such that a user can remove and replace the outsole 164 of the article of footwear 100. In addition, as discussed below, the inclusion of the frame 170 can add to the visual appeal of the shoe by permitting the plurality of midsole members 178 to be visible from an outside of the article of footwear 100 through the frame 170.

Still referring to FIGS. 1 and 4, the frame 170 is an elongate member that wraps around the midsole members 178 along with the lateral side 116 and the medial side 118 (see FIG. 4) of the upper 102. The frame 170 has an exterior surface 184 that faces away from the article of footwear 100 and an interior surface 186 that faces toward the article of footwear 100. In some embodiments, the frame 170 covers at least a portion of the sole structure 104 and does not cover any portion of the upper 102. In some embodiments, the frame 170 covers a portion of the sole structure 104 and a portion of the upper 102. In some embodiments, a percentage coverage of the upper 102 by the frame 170, as defined as an absolute surface area without consideration of a plurality of apertures 188 of the frame 170, is in a range of about 2% to about 90%, in a range of about 5% to about 95%, in a range of about 15% to about 80%, in a range of about 25% to about 75%, in a range of about 30% to about 70%, or in a range of about 50% to about 65%.

The interior surface 186 of the frame 170 is configured to encase or cover one or more of the midsole members 178 of the sole structure 104 and/or portions of the upper 102. In some embodiments, the frame 170 may be at least partially disposed within a plurality of channels or recesses (not shown) formed on one or more of the midsole members 178. In some embodiments, the frame 170 is co-molded with the midsole members 178. In some embodiments, the frame 170 is adhered to the midsole members 178 or the upper 102. In some embodiments, the frame 170 is removably attached to the midsole members 178 by compression or other means. In some embodiments, the frame 170 can extend over, or cover, only a portion of the midsole members 178. For example, in such embodiments, the frame 170 can extend over only those midsole members 178 disposed in the heel region 212, such that the midsole members 178 disposed in the forefoot region 108 and the midfoot region 110 are not covered by the frame 170. In some embodiments, the article of footwear 100 can include more than one frame 170, for example, a first frame can extend over the midsole members 178 disposed in the heel region 112 and a second frame can extend over the midsole members 178 disposed in the forefoot region 108 and/or the midfoot region 110.

Referring still to FIGS. 1 and 4, the frame 170 has a lattice-work structure formed by the plurality of apertures 188 that extend from the exterior surface 184 to the interior surface 186 of the frame 170. In the illustrated embodiment, the apertures 188 are disposed along a lateral side 190, a medial side 192 (see FIG. 6), a bottom side 194, a distal side 196, and/or a proximal side 198 of the frame 170. Thus, the lattice-work structure of the frame 170 extends over the entire frame 170 such that the midsole members 178 covered by the frame 170 are visible from an outside (e.g., along the lateral side 116, the medial side 118 (see FIG. 2), the proximal end 122, the distal end 124, and the outsole region 164) of the article of footwear 100 through the lattice-work structure (i.e., the apertures 188) of the frame 170. In some embodiments, the apertures 188 are disposed entirely on the bottom side 194 of the frame 170 and thus the lattice-work structure of the frame 170 extends along only the outsole region 164 of the article of footwear 100 while the remainder of the frame 170 can extend along the lateral side 116, the medial side 118 (see FIG. 2), the proximal end 122, and the distal end 124 of the article of footwear 100. In some embodiments, the apertures 188 are disposed only on the lateral and bottom sides 190, 194 of the frame 170 and thus the lattice-work structure of the frame 170 extends along only the lateral side 116 and the outsole region 164 of the article of footwear 100 while the remainder of the frame can extend along the medial side 118 (see FIG. 2), the proximal end 122, and the distal end 124 of the article of footwear 100. In some embodiments, the apertures 188 are disposed only on the lateral and proximal sides 190, 198 of the frame 170 and thus the lattice-work structure of the frame 170 extends along only the lateral side 116 and the heel region 112 of the article of footwear 100 while the remainder of the frame 170 can extend along the medial side 118 (see FIG. 2), the distal end 124, and the outsole region 164 of the article of footwear 100. In some embodiments, a percentage of the frame 170 including the plurality of apertures 188 (i.e., the lattice-work structure) is in a range of about 5% to about 30%, in a range of about 20% to about 60%, in a range of about 30% to about 80%, in a range of about 50% to about 90%, or in a range of about 10% to about 95%. In some embodiments, the lattice-work structure of the frame 170 can extend along a percentage of the exterior surface 154 of the upper 102 in a range of about 5% to about 60%, in a range of about 10% to about 50%, in a range of about 15% to about 45%, or in a range of about 20% to about 40%. In some embodiments, the frame 170, or portions thereof, can have a continuous exterior surface 184 with no apertures 188.

With continued reference to FIGS. 1 and 4, the plurality of apertures 188 can be of varying size and shape. For example, with specific reference to FIG. 4, the apertures 188 disposed on the bottom side 194 of the frame 170 toward the distal side 196 of the frame 170 have a smaller size and generally have a more circular shape in comparison to the apertures 188 disposed toward the proximal side 198 of the frame 170. Likewise, with specific reference to FIG. 1, the apertures 188 disposed on the lateral side 190 of the frame 170 have a generally oval shape, and the apertures 188 disposed toward the distal side 196 of the frame 170 have a smaller size and differently orientated oval shapes in comparison to the apertures 188 disposed toward the proximal side 198 of the frame 170.

Figure 5:
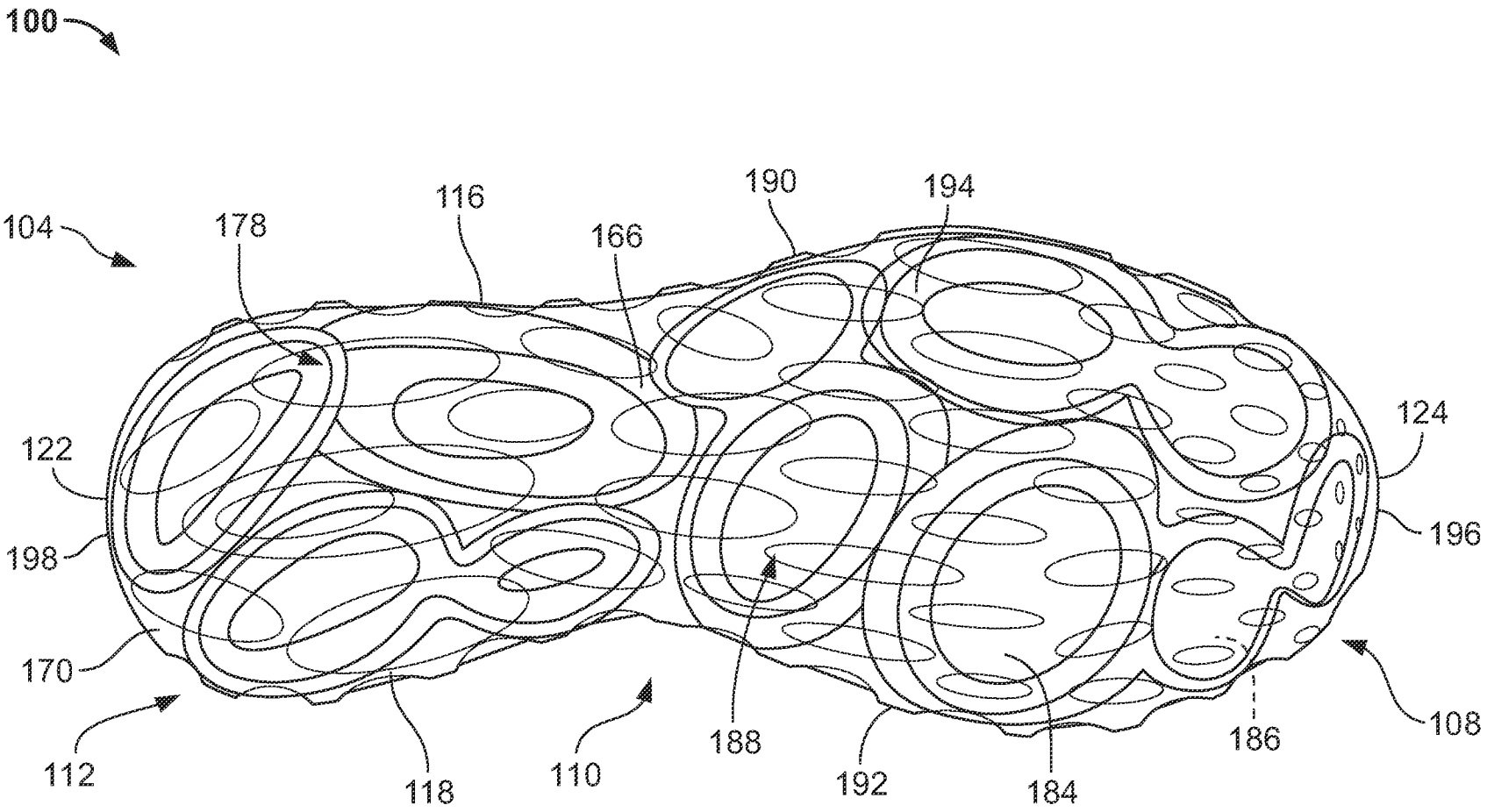
FIG. 5 is a bottom view of the article of footwear of FIG. 1, with the frame shown as translucent.

Referring specifically to FIGS. 4 and 5, and as discussed above, with the apertures 188 included on the bottom side 194 of the frame 170, the frame 170 and the bottom portions 182 of the midsole members 178 partially define the bottom surface 166 of the outsole 164 of the sole structure 104. In the illustrated embodiment, the apertures 188 disposed on the bottom side 194 of the frame 170 are arranged such that at least two or more apertures 188 are at least partially disposed over each of the midsole members 178. In some embodiments, the bottom side 194 of the frame 170 and the bottom portions 182 of the midsole members 178 form a substantially flat or continuous bottom surface 166 of the outsole 164. In some embodiments, the midsole members 178 can include a plurality of protrusions (not shown) that align with two or more of the apertures 188 disposed on the bottom side of the frame 170, such that the protrusions of the bottom portions 182 of the midsole members 178 extend at least partially through the apertures 188 of the frame 170.

Referring again to FIGS. 1, 4, and 5, the midsole members 178 can be comprised of a compressible and/or deformable material that can provide cushioning or shock absorption benefits to a user when wearing the article of footwear 100. In such embodiments, the frame 170 can be comprised of a material that is more rigid than a material comprising the midsole members 178 such that frame 170 provides support to the midsole members 178 when a user's foot exerts force on the sole structure 104. In such embodiments, when a user wearing the article of footwear 100 exerts downward force on the sole structure 104 opposite a ground surface, the frame 170 can flex inward toward the midsole members 178 while the midsole members 178 compress between the user's foot and the ground surface. In some embodiments, the upper portions 180 of the midsole members 178 can be comprised of a different material than the bottom portions 182 of the midsole members 178. In such embodiments, for example, the bottom portions 182 of the midsole members 178 can be comprised a first material that provides traction between the midsole members 178 and a ground surface while the upper portions 180 of the midsole members 178 are comprised of a second material that provides cushioning to a user wearing the article of footwear 100.

Likewise, the frame 170 can be comprised of two or more materials having different properties. For example, the lateral side 190, the medial side 192 (see FIGS. 4 and 5), the distal side 196, and/or the proximal side 198 of the frame 170 that are adjacent to the midsole region 162 can be comprised of a first material that is flexible while the bottom side 194 of the frame 170 adjacent to the outsole region 164 can be comprised of a second material that is more rigid than the first material. In such embodiments, portions of the lateral side 190 and the medial side 192 (see FIGS. 4 and 5) of the frame 170 can be comprised of a third material that is more elastic than the first material. Such portions of the lateral side 190 and the medial side 192 (see FIGS. 4 and 5) comprised of the third elastic material can be utilized as a fastening member of the fastening mechanism 172 in some embodiments. For example, the first fastening member or lace 176 can extend through the apertures 188 disposed on the lateral side 190 and the medial side 192 (see FIGS. 4 and 5) of the frame 170 in addition to, or instead of, the second fastening members or lace retainers 174. In such embodiments, the third material comprising the portions of the lateral side 190 and the medial side 192 (see FIGS. 4 and 5) of the frame 170 can allow for elastic deformation of the frame 170 under tension by the lace 176. In such embodiments, elastic deformation of the frame 170 may be defined as one or more portions of the lattice-work structure of the frame 170 being configured to sustain an elastic deformation when a force (e.g., the tensile force of the tightened lace 176) is applied to the one or more portions of the frame 170 and to self-recover the original shape of the lattice-work structure of the frame 170 when the force is removed (e.g., when the lace 176 is loosened).

As discussed above, the frame 170 can extend along various portions of the upper 102, which encases the user's foot 128 (see FIG. 3). Accordingly, in some embodiments, at least the lattice-work structure of the frame 170 defined by the plurality of apertures 188 can be formed of a material configured to adapt to a wearer's foot. For example, in such embodiments, the lattice-work structure of the frame 170 can be formed of an elastic material that is configured to adapt and elastically deform around contours of the wearer's foot, including expanding to a first length at some locations of the wearer's foot while expanding to a second length that is greater than the first length at other locations of the wearer's foot. In some such embodiments, the material forming the lattice-work structure of the frame 170 can be configured to maintain a shape corresponding to contours of a wearer's foot after the article of footwear 100 is worn by the user for some time. In other embodiments, the material forming the lattice-work structure of the frame 170 can be configured to adapt and elastically deform in response to bending of the sole structure 104 and/or upper 102 (e.g., when the forefoot region 108 of bottom surface 166 of the outsole 164 contacts a ground surface while the heel region 112 of the bottom surface 166 of the outsole 164 is raised from the ground surface during a particular phase of the wearer's stride) and then to self-recover to the non-bending shape of the lattice-work structure of the frame 170 when the sole structure 104 and/or upper 102 return to the original shape (e.g., when the forefoot and heel regions 108, 112 of the bottom surface 166 of the outsole 164 simultaneously contact the ground surface during a different phase of the wearer's stride or when the wearer is standing stationary).

As discussed above, the frame 170 can be comprised of a translucent or partially transparent material. In this regard, FIG. 5 illustrates an alternative embodiment of the frame 170 as being translucent, such that the entirety of the bottom portions 182 of the midsole members 178 are at least partially visible from the bottom surface 166 of the article of footwear 100 through the translucent frame 170, in addition to portions of the midsole members 178 being visible through the apertures 188 disposed on the bottom side 194 of the frame 170. In some embodiments, the upper portions 180 of the midsole members 178 and/or portions of the upper 102 covered by the frame 170 can be visible or partially visible from a side (such as, e.g., the lateral side 116) of the article of footwear 100 through the frame 170, in addition to portions thereof being visible through the apertures 188 disposed on the lateral side 190, the medial side 192, the distal side 196, and/or the proximal side 198 of the frame 170. In some embodiments, portions of the frame 170 can be translucent and other portions of the frame 170 can be opaque. For example, in some embodiments, the lateral side 190 of the frame 170 can be translucent while the medial side 192, the bottom side 194, the distal side 196, and/or the proximal side 198 of the frame 170 can be opaque.

Referring again to FIGS. 1, 4, and 5, in some embodiments, one or more of the midsole members 178 and/or the frame 170 can be configured to be removably attached to the sole structure 104. For example, in some embodiments, at least some portions of the frame 170 may be comprised of an elastic material and the frame 170 may be configured such that a user can remove the frame 170 from the fixedly attached midsole members 178 by inserting a finger into one or more of the apertures 188 and pulling the frame 170 outward and downward relative to the upper 102. In another example, both the frame 170 and one or more midsole members 178 can be removably attached to the upper 102, such that the frame 170 can be removed, one or more midsole members 178 can be replaced with a different midsole member 178 that can have different properties, and then the frame 170 can be reattached over the different midsole member 178. In some embodiments, the midsole members 178 can be unattached to the upper 102 and the frame 170 can be configured to hold the midsole members 178 in contact with the upper 102 and/or contain the midsole members 178 in a particular arrangement with one another. In such embodiments, the frame 170 can further include one or more protrusions (not shown) extending from the interior surface 186 that can be configured to extend at least partially between the unattached midsole members 178.

Referring still to FIGS. 1, 4 and 5, the midsole members 178 and/or the frame 170 may be formed through additive manufacturing techniques, such as by 3D printing. To that end, a number of 3D printed techniques may be implemented to form the midsole members 178 and/or the frame 170, such as vat photopolymerization, material jetting, binder jetting, powder bed fusion, material extrusion, directed energy deposition, and/or sheet lamination. In some embodiments, the frame 170, or components thereof, may be 3D printed directly upon the midsole members 178 or along a portion of the upper 102. In some embodiments, the frame 170, or components thereof, may be 3D printed and then separately coupled with a portion of the article of footwear 100.

Referring now to FIGS. 6-14, another exemplary embodiment of an article of footwear 200 is depicted, which includes an upper 202, a sole structure 204 having a midsole or midsole region 262 and an outsole or outsole region 264, and a frame 270. The article of footwear 200 is similar to previous embodiments, with like elements being indicated by similar reference numerals under the "2xx" series of reference numerals. For example, the upper 202 of the article of footwear 200 has an interior surface 252, an exterior surface 254, and an instep region 258, just as the upper 102 of the article of footwear 100 has the interior surface 152, the exterior surface 154, and the instep region 158 (see FIG. 1). While the article of footwear 200 is similar to the previous embodiment in many aspects, there are some aspects that differ. In particular, the fastening mechanism 272 further includes third fastening members or a second plurality of lace retainers **274*b* in addition to the second fastening members or the first plurality of lace retainers 274*a***.

Figure 6:
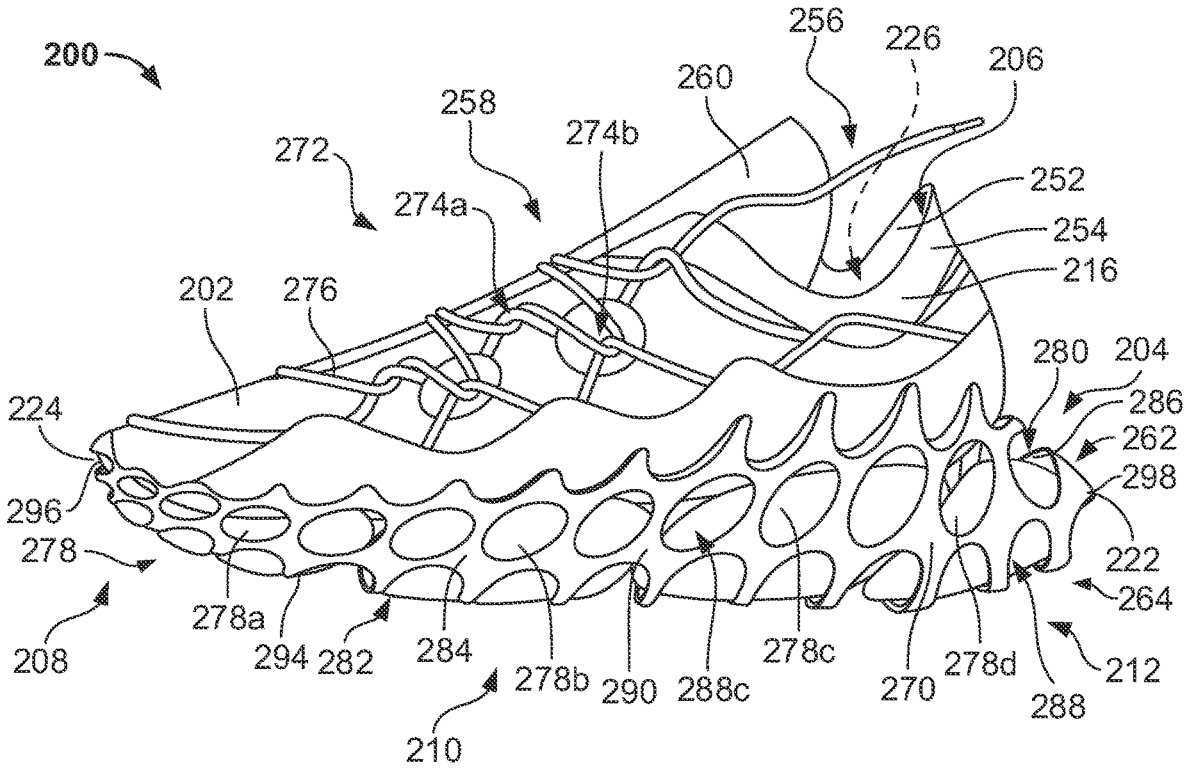
FIG. 6 is a lateral side view of another example of an article of footwear that is similar to the article of footwear of FIG. 1.
Figure 7:
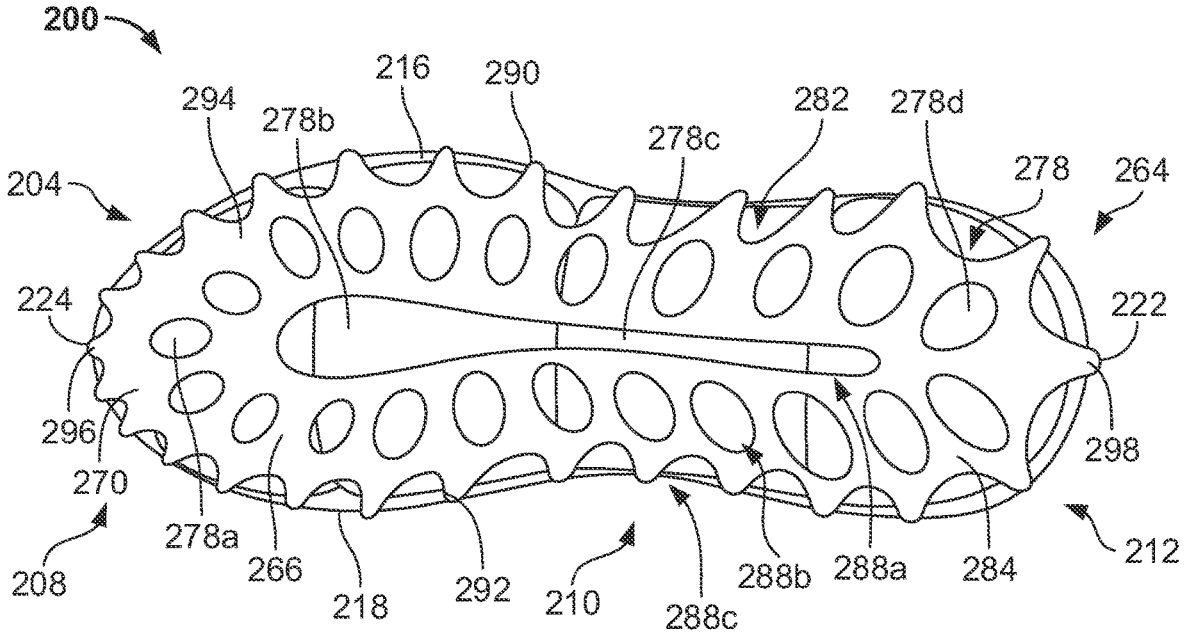
FIG. 7 is a bottom view of the article of footwear of FIG. 6.

Referring specifically to FIGS. 6 and 7, the first fastening member or the lace 276 extends in a crisscrossing manner across the tongue 260 and through the first and second pluralities of lace retainers **274*a*, 274*b* in an alternating sequence or in series, i.e., through one of the first plurality of lace retainers 274*a*, across the tongue 260, through one of the second plurality of lace retainers 274*b*, and so on. In the illustrated embodiment, the second plurality of lace retainers 274*b* are arranged between the first plurality of lace retainers 274*a* and the sole structure 204. The first and second pluralities of lace retainers 274*a*, 274*b* can each be formed by a single lace or strip of material extending around and partially adhered to the lateral side 216 and the medial side 218 (see FIG. 7) of the upper 102 and having one or more disconnected portions that can form the first and second pluralities of lace retainers 274*a*, 274*b***.

Referring still to FIGS. 6 and 7, the frame 270 extends along the lateral side 216, the medial side 218 (see FIG. 7), the proximal end 222, and the distal end 224 of the sole structure 204 and along at least a lower portion of the upper 202. Similar to the embodiment illustrated in FIGS. 1-5, the frame 270 has a lattice-work structure formed by a plurality of apertures 288, including a first plurality of apertures 288*a* disposed at least partially along the lateral side 290, the medial side 292, the distal side 296, and/or the proximal side 298 of the frame 270. However, unlike the previous embodiment of FIGS. 1-5, the frame 270 includes a large central aperture 288*b* defined on the bottom side 294 of the frame 270 that extends partially along the forefoot, midfoot, and heel regions 208, 210, 212 between the lateral side 216 and the medial side 218 (see FIG. 7) of the article of footwear 200. The bottom side 294 of the frame 270 further includes a second plurality of apertures 288*c* (see FIG. 6) disposed around a perimeter of the large central aperture 288*b*.

With continued reference to FIGS. 6 and 7, in the illustrated embodiment, each of the midsole members 278 extend from the lateral side 216 to the medial side 218 (see FIG. 7) of the sole structure 204. The plurality of midsole members 278 includes a first or forefoot midsole member 278*a*, a second or midfoot midsole member 278*b*, a third or distal-heel midsole member 278*c*, and a fourth or proximal-heel midsole member 278*d*. The first midsole member 278*a* is disposed entirely within the forefoot region 208 of the article of footwear 200, and the second midsole member 278*b* is disposed entirely within the midfoot region 210 of the article of footwear 200. The third and fourth midsole members 278*c*, 278*d* are disposed entirely within distal and proximal portions of the heel region 212, respectively, of the article of footwear 200.

Figure 8:
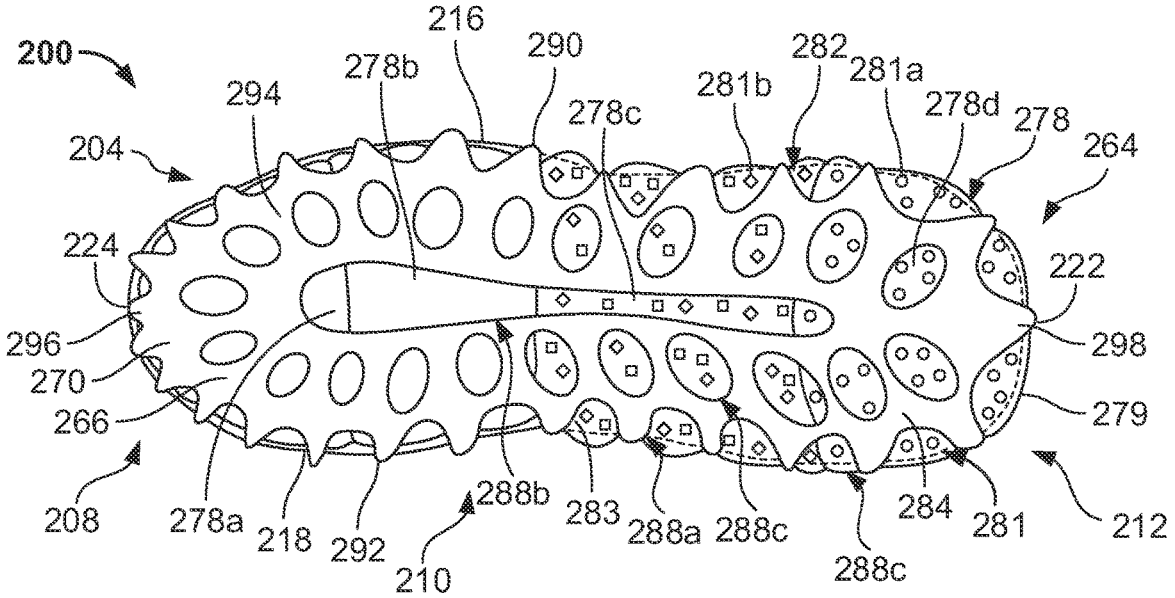
FIG. 8 is a bottom view of the article of footwear of FIG. 6, with another example midsole member in a first compressed configuration.
Figure 9:
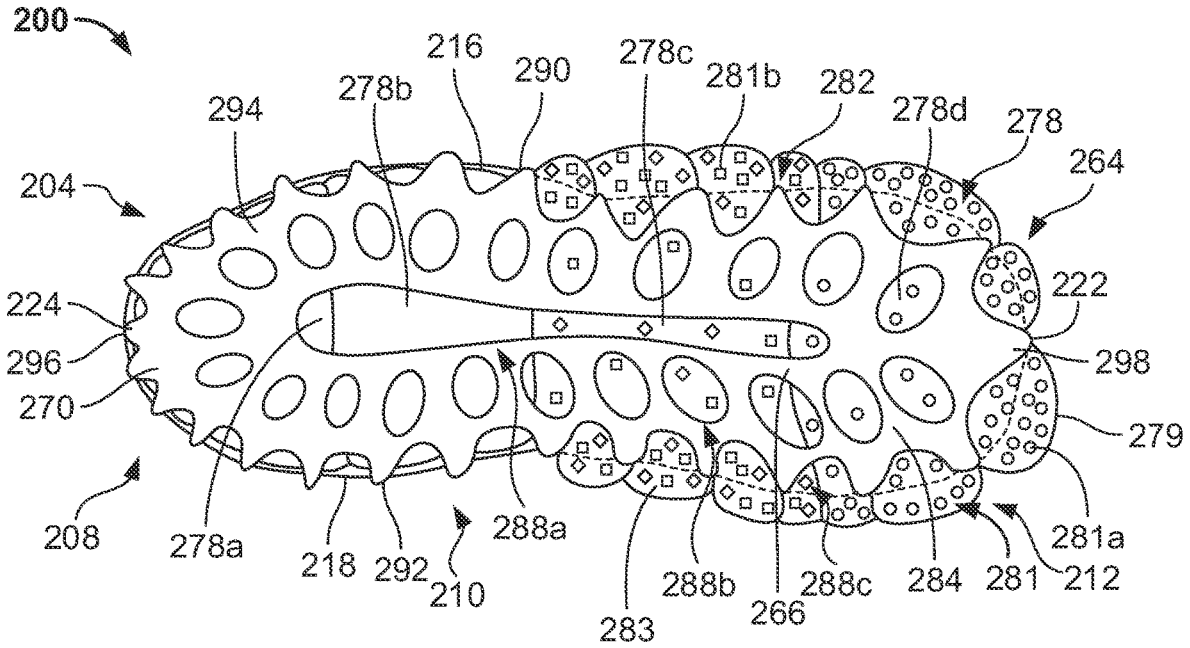
FIG. 9 is a bottom view of the article of footwear of FIG. 8, with the example midsole member in a second compressed configuration.

In some embodiments, one or more of the midsole members 278 may be configured such that at least some portions of such midsole members 278 can expand through one or more of the first plurality of apertures 288*a* disposed on the lateral side 290, the medial side 292, and the proximal side 298 of the frame 270 when the sole structure 204 is compressed by a user's foot. For example, FIGS. 8 and 9 illustrate the article of footwear 200 with various amounts of force applied downward on the insole 226 (see FIG. 6) of the sole structure 204, such as downward force applied by a user's foot while in stride, and with the third and fourth midsole members 278*c*, 278*d* being configured to be expandable and the first and second midsole members 278*a*, 278*b* being configured to be non-expandable. Referring specifically to FIG. 8, the article of footwear 200 is shown in a first compressed position when a first amount of force is applied downward on the insole 226 (see FIG. 6) of the sole structure 204. In the first compressed position, the midsole members 278 of the sole structure 204 are compressed between the downward force on the insole 226 (see FIG. 6) and an opposing ground surface (not shown) contacting the bottom surface 266 of the outsole 264 of the sole structure 204, causing the third and fourth midsole members 278*c*, 278*d* to expand partially outward through the first plurality of apertures 288*a* of the frame 270. In such embodiments, the frame 270 may be configured to compress along at least the lateral and medial sides 290, 292 of the frame 270 to a lesser or equal distance in which the midsole members 278 are compressed. In other embodiments, the frame 270 may be configured to be caused to move upward toward the opening 256 (see FIG. 6) of the upper 202 when the sole structure 204 is compressed.

Referring specifically to FIG. 9, the article of footwear 200 is shown in a second compressed configuration when a second amount of force, greater than the first amount of force, is applied downward on the insole 226 (see FIG. 6) of the sole structure 204. In the second compressed position, the midsole members 278 of the sole structure 204 are compressed further between the greater downward force on the insole 226 (see FIG. 6) and the opposing ground surface (not shown) contacting the bottom surface 266 of the outsole 264 of the sole structure 204, causing the third and fourth midsole members 278*c*, 278*d* to expand further outward through the first plurality of apertures 288*a* of the frame 270. In some embodiments, the midsole members 278 may be configured to expand at least partially outward through the central aperture 288*b* and/or the second plurality of apertures 288*c* disposed on the bottom side 294 of the frame 270 when the sole structure 204 is compressed. In such embodiments, at least a bottom surface of the midsole members 278 may be comprised of a material that provides traction between the expanded portions of the midsole members 278 extending through the central aperture 288*b* and/or the second plurality of apertures 288*c* and the ground surface when the sole structure 204 is compressed.

Referring still to FIGS. 8 and 9, and as noted above, the first and second midsole members 278*a*, 278*b* located in the forefoot and midfoot regions 208, 210, respectively, are configured to be non-expandable when the sole structure 204 is compressed, and the third and fourth midsole members 278*c*, 278*d* located in the heel region 212 are configured to be expandable when the sole structure 204 is compressed. Thus, when the sole structure 204 is compressed in the illustrated embodiment, the third and fourth midsole members 278*c*, 278*d* expand through the first plurality of apertures 288*a* while the first and second midsole members 278*a*, 278*b* do not expand through the first plurality of apertures 288*a*. In other embodiments, the midsole members 278 located in the forefoot, midfoot, and heel regions 208, 210, 212 can be configured to be expandable through the first plurality of apertures 288*a* when the sole structure 204 is compressed.

Still referring to FIGS. 8 and 9, the midsole members 278 may be comprised of an outer casing 279 with a plurality of plastic bodies 281 disposed within the outer casing 279. In some embodiments, the outer casing 279 of one or more of the midsole members 278 may be comprised of a translucent or partially translucent material such that the plastic bodies 281 disposed therein are visible therethrough and, thus, visible from an outside of the article of footwear 200 through the apertures 288. In such embodiments, a fluid 283 may be contained within the outer casing 279 of the midsole members 278 such that the plastic bodies 281 are suspended in the fluid 283 and free to move relative to each other within the outer casing 279. Thus, the fluid 283 may permit the plastic bodies 281 to move outwardly relative to an outer perimeter of the frame 270 into portions of the midsole members 278 that expand through the first plurality of apertures 288*a* of the frame 270, as shown in FIG. 9. In other embodiments, the fluid 283 may be a binder such that movement of the plurality of plastic bodies 281 relative to each other is at least partially constrained.

With continued reference to FIGS. 8 and 9, the plurality of plastic bodies 281 may be of a variety of shapes and sizes. For example, in the illustrated embodiment of FIGS. 8 and 9, a first plurality of plastic bodies 281*a* disposed within the fourth midsole member 278*d* have a different shape and size than a second plurality of plastic bodies 281*b* disposed within the third midsole member 278*c*. In some embodiments, the plurality of plastic bodies 281 are spherical and/or ellipsoidal shaped. In such embodiments, the spherical and/or ellipsoidal shaped plastic bodies 281 have dimensions, in the three spatial direction, in a range between about 1 millimeter (mm) and about 18 mm, in a range between about 2 mm and about 12 mm, or in a range between about 3 mm and about 10 mm. In some embodiments, the plurality of plastic bodies 281 has other varying properties within the same or different midsole members 278*a*, 278*b*, 278*c*, 278*d*. For example, in the illustrated embodiment of FIGS. 8 and 9, the first plurality of plastic bodies 281*a* may have varying colors within the fourth midsole member 278*d* or the first and second plurality of plastic bodies 281*a*, 281*b* may have differing colors within the third and fourth midsole members 278*c*, 278*d*, respectively. In some embodiments, the plastic bodies 281 may comprise between about 30% to about 95% of a weight of the midsole members 278, and the fluid 283 may comprise between about 5% to about 70% of the weight of the midsole members 278. In other embodiments, the plastic bodies 281 may comprise about 50% to about 60% of the weight of the midsole members 278, and the fluid 283 may comprise about 40% to about 50% of the weight of the midsole members 278.

Figure 10:
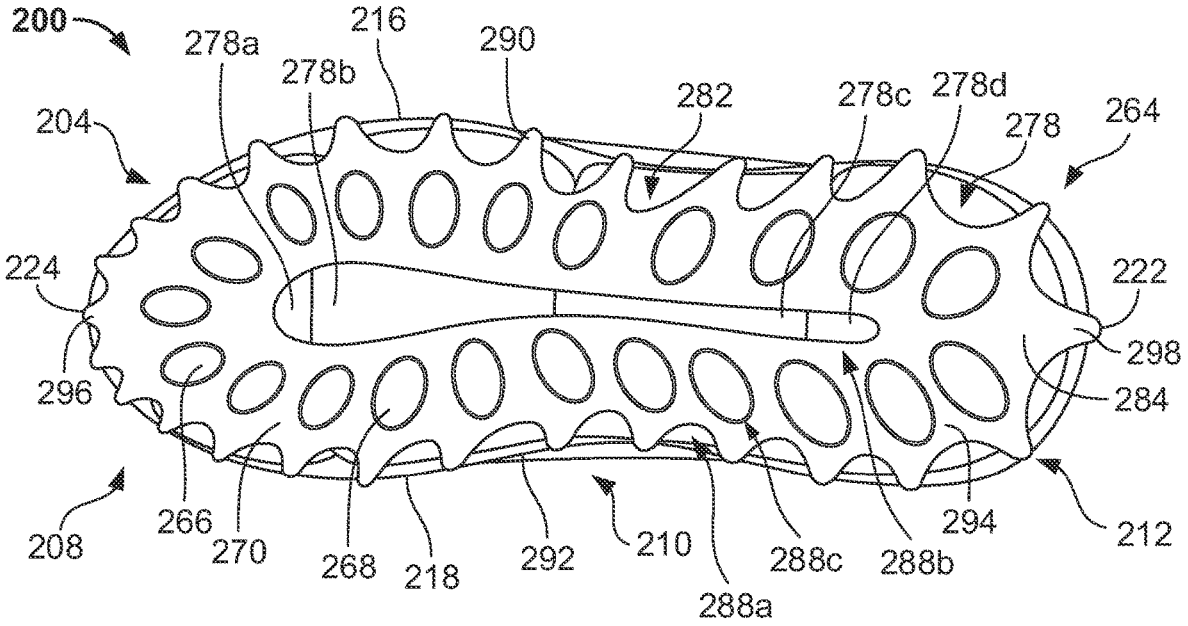
FIG. 10 is a bottom view of the article of footwear of FIG. 6, with an example outsole member included in the frame.

Referring specifically to FIG. 10, the frame 270 of the article of footwear 200 may be configured to receive an outsole member 268 disposed between the bottom portions 282 of the midsole members 278 and the interior surface 286 along the bottom side 294 of the frame 270. In the illustrated embodiment, the outsole member 268 is arranged such that portions of the outsole member 268 cover some of the second plurality of apertures 288*c* disposed on the bottom side 294 of the frame 270. In some embodiments, the bottom side 294 of the frame 270 and the outsole member 268 can together define the bottom surface 266 of the outsole 264 of the article of footwear 200. In some embodiments, the outsole member 268 can cover each of the apertures 288 disposed on the bottom side 294 of the frame 270. In some embodiments, the outsole member 268 can be comprised of a material that is different than the frame 270 and/or the midsole members 278. For example, in such embodiments, the outsole member 268 can be comprised of a first material that is configured to provide traction between the article of footwear 200 and a ground surface, the frame 270 can be comprised of a second material that is configured to provide structural support to the article of footwear 200, and the midsole members 278 can be comprised of a third material that is configured to provide cushioning to a user wearing the article of footwear 200.

Figure 11:
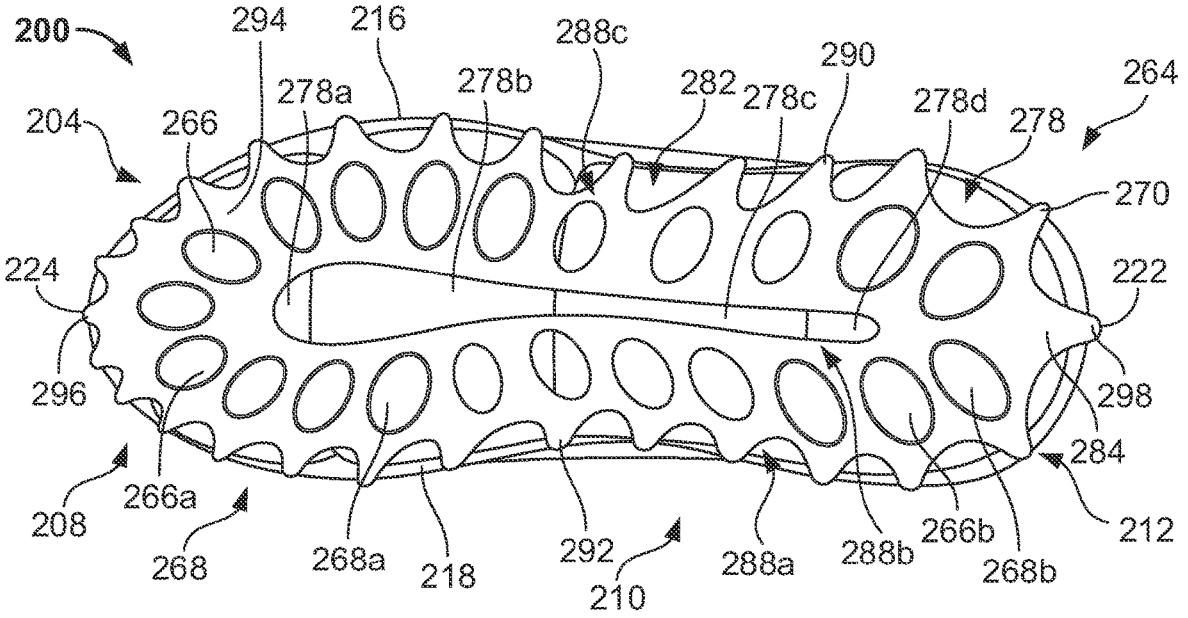
FIG. 11 is a bottom view of the article of footwear of FIG. 6, with another example outsole member included in the frame.

Referring specifically to FIG. 11, the outsole member 268 can include a first or distal outsole member 268*a* and a second or proximal outsole member 268*b*. Additionally, in such embodiments, the first and second outsole members 268*a*, 268*b* can be arranged such that some of the apertures 288 disposed on the bottom side 294 of the frame 270 open to the first or second outsole members 268*a*, 268*b* and some of the apertures 288 disposed on the bottom side of the frame 270 open to the bottom portions 282 of one or more of the midsole members 278*a*, 278*b*, 278*c*, 278*d*. In some embodiments, the first and second outsole members 268*a*, 268*b* and the bottom side 294 of the frame 270 can collectively define the bottom surface 266 of the outsole 264 of the sole structure 204. More specifically, in such embodiments, the first outsole member 268*a* can define a first or distal bottom surface portion 266*a* of the bottom surface 266, the second outsole member 268*b* can define a second or proximal bottom surface portion 266*b* of the bottom surface 266, and the bottom side 294 of the frame 270 can define the remaining portion(s) of the bottom surface 266. In some embodiments, the outsole member 268 can comprise three or more outsole members.

Figure 12:
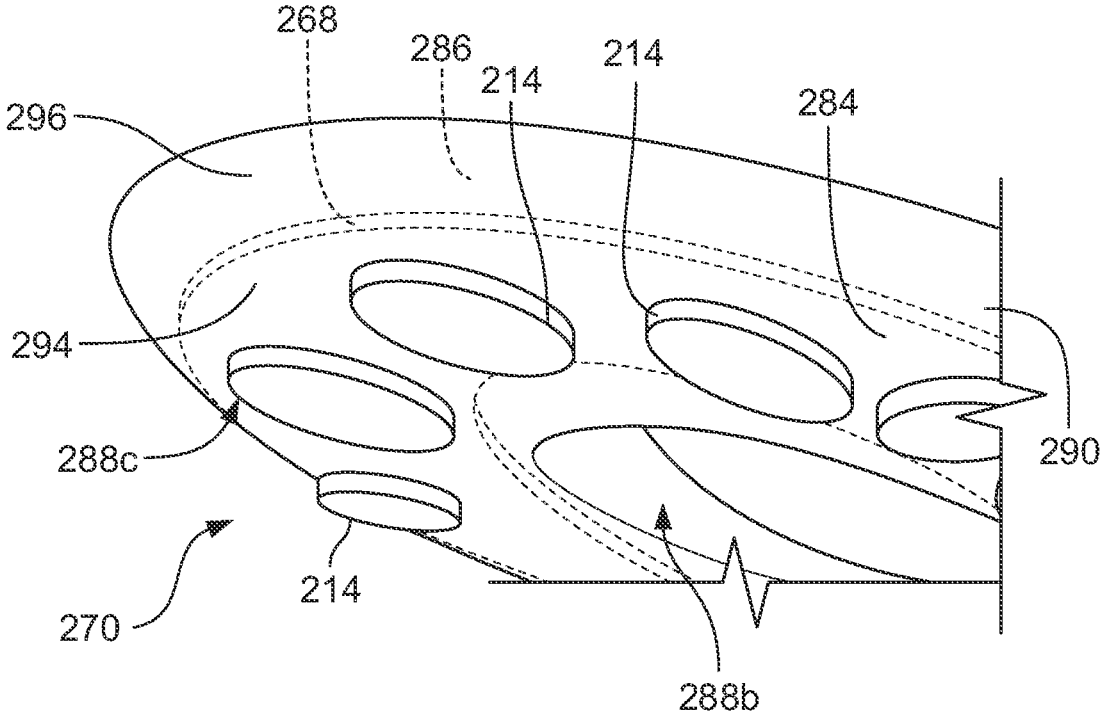
FIG. 12 is a bottom-distal side partial detail view of the frame and the outsole member of the article of footwear of FIG. 10.
Figure 13:
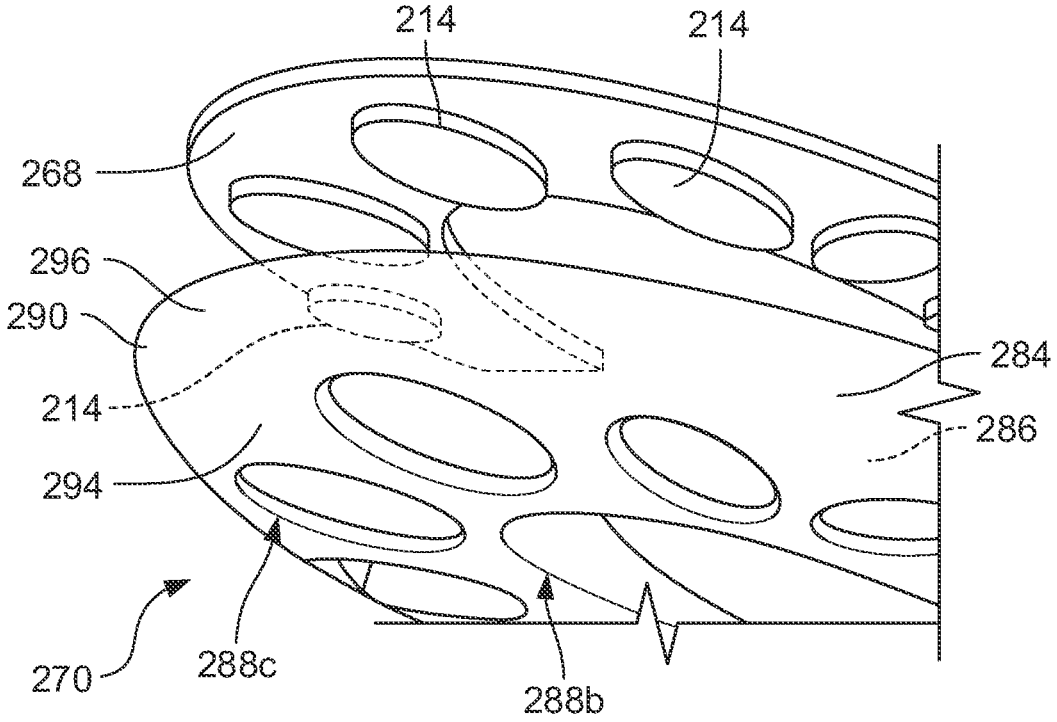
FIG. 13 is an exploded view of FIG. 12.

FIGS. 12 and 13 depict detail views of the outsole member 268 positioned on the interior surface 286 of the bottom side 294 of the frame 270, with the lateral, medial, and distal sides 290, 292, 296 of the frame 270 including the first plurality of apertures 288*a* having been removed for illustration purposes. As illustrated in FIGS. 12 and 13, the outsole member 268 can include a plurality of protrusions 214 that are configured to align with some of the apertures 288 along the bottom side 294 of the frame 270, such as the second plurality of apertures 288*c*, when the outsole member 268 is included between the interior surface 286 of the frame 270 and the bottom portions 282 of midsole members 278. More specifically, in the illustrated embodiment, the plurality of protrusions 214 extend downwardly from the outsole members 268 away from the midsole members 278 such that the plurality of protrusions 214 can be at least partially received within the second plurality of apertures 288*c* of the frame 270 and extend from the interior surface 286 toward the exterior surface 284 of the frame 270. As discussed above, in some embodiments, the article of footwear 200 can be configured such that the frame 270 is removably attached to the sole structure 204. In such embodiments, the outsole member 268 can be inserted into or removed from the interior surface 286 of the frame 270 when the frame 270 is removed from the sole structure 204 by a user. For example, if the protrusions 214 of the outsole member 268 wear down after repeated use of the article of footwear 200, a user can remove the frame 270, replace the worn-down outsole member 268 with a new outsole member 268 that is inserted into the interior surface 286 of the frame 270, and then reattach the frame 270 to the sole structure 204 of the article of footwear 200.

Figure 14:
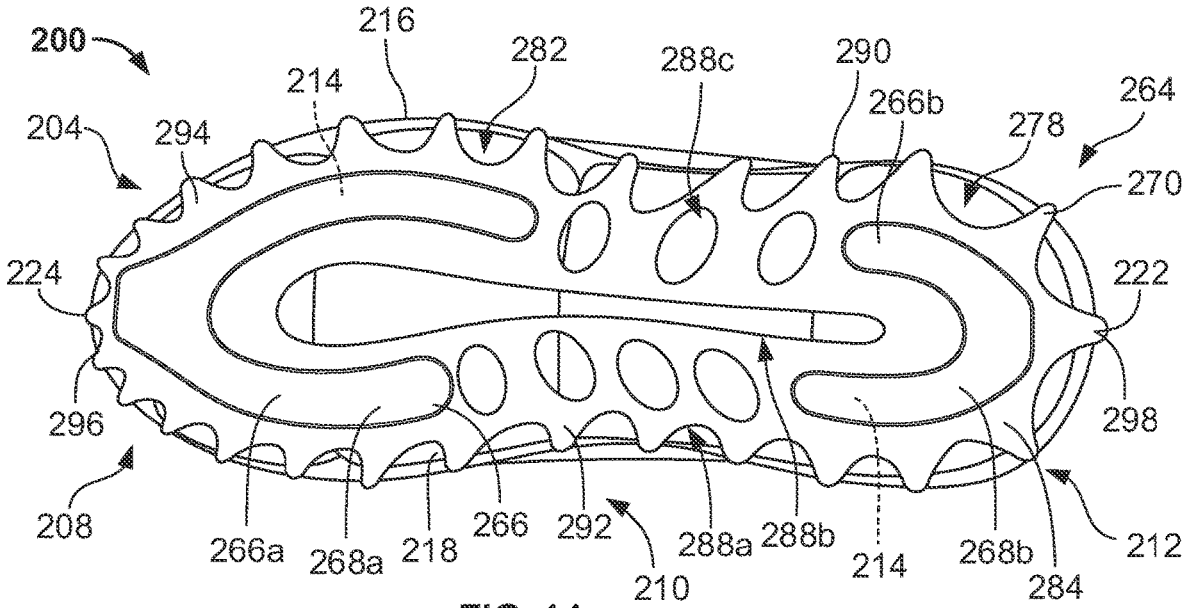
FIG. 14 is a bottom view of the article of footwear of FIG. 6, with yet another example outsole member included in the frame.
Figure 15:
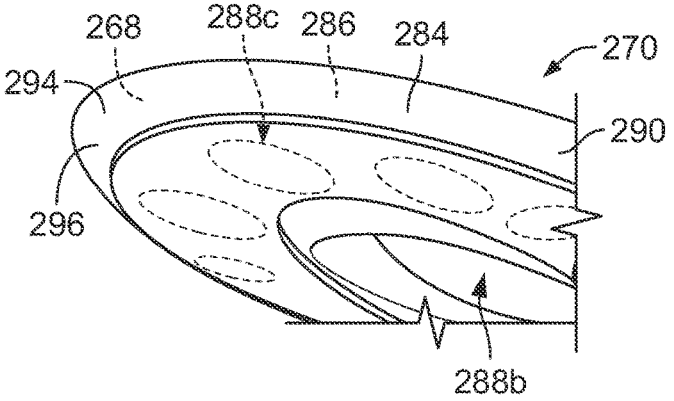
FIG. 15 is a bottom-distal side partial detail view of the frame and the outsole member of the article of footwear of FIG. 14.
Figure 16:
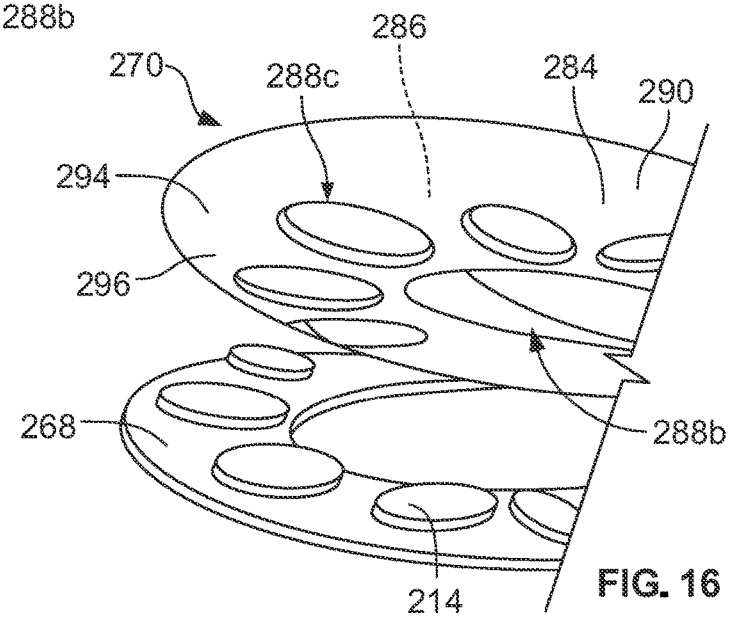
FIG. 16 is an exploded view of FIG. 15.
Figure 17:
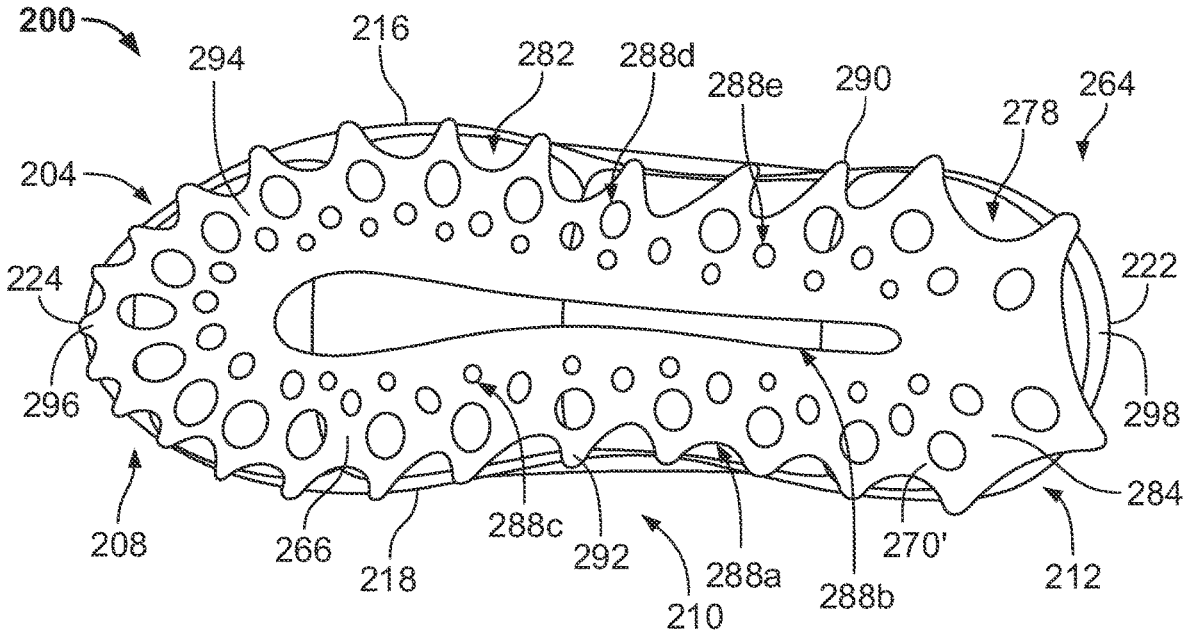
FIG. 17 is a bottom view of the article footwear of FIG. 6, with another example frame.

Referring now to FIGS. 14-16, in some embodiments, the outsole member 268 may be configured to be attached to the exterior surface 284 of the frame 270. In this regard, FIGS. 15 and 16 depict detail views of the outsole member 268 positioned on the exterior surface 284 along the bottom side 294 of the frame 270, with the lateral, medial, and distal sides 290, 292, 296 of the frame 270 including the first plurality of apertures 288*a* having been removed for illustration purposes. In such embodiments, the outsole member 268 can include one or more protrusions 214 that are configured to align with, and be disposed within, one or more apertures 288 disposed on the bottom side 294 of the frame 270, such as the second plurality of apertures 288*c*. More specifically, the plurality of protrusions 214 can extend upwardly from the outsole members 268 toward the midsole members 278 such that the plurality of protrusions 214 can be at least partially received within the second plurality of apertures 288*c* of the frame 270 and extend from the exterior surface 284 toward the interior surface 286 of the frame 270. In such embodiments, a user can replace a worn-down outsole member 268 with a new outsole member 268 along the exterior surface 284 of the frame 270 without removing the frame 270 from the sole structure 204.

Referring in particular to FIG. 14, the first outsole member 268*a* is attached to the exterior surface 284 of the frame 270 by engagement of one or more protrusions 214 with at least some of the second plurality of apertures 288*c* of the frame 270 located in the forefoot region 208 and the midfoot region 210. Likewise, the second outsole member 268*b* is attached to the exterior surface 284 of the frame 270 by engagement of one or more protrusions of the second outsole member 268*b* with some of the second plurality of apertures 288*c* of the frame 270 located in the heel region 212. As such, the first and second outsole members 268*a*, 268*b* each form distinct bottom surface portions 266*a*, 266*b* located below the exterior surface 284 of the frame 270 and that at least partially define the bottom surface 266 of the outsole 264 of the article of footwear 200. In some embodiments, the first and second outsole members 268*a*, 268*b* can define the entire bottom surface 266 of the outsole 264 of the article of footwear 200. In some embodiments, the protrusions 214 can be removably attached to surfaces defining the one or more apertures 288 and/or the exterior surface 284 along the bottom side 294 of the frame 270. In some embodiments, the outsole member 268 is fixedly attached to the bottom side 294 of the frame 270 using an adhesive or other known fastening means. In some embodiments, one or more protrusions 214 of the outsole member 268 are attached to the bottom portion 282 of one or more midsole members 278 using an adhesive or other known fastening means.

Referring now to FIGS. 17-20, another exemplary embodiment frame 270' of the article of footwear 200 is depicted. The frame 270' of the article of footwear 200 of FIGS. 17-20 is similar to the previous embodiment of FIGS. 6-16, with like elements being indicated by similar reference numerals. While the frame 270' of the article of footwear 200 of FIGS. 17-20 is similar to the previous embodiment in many aspects, there are some aspects that differ. In particular, the apertures 288 disposed on the bottom side 294 of the frame 270' have a generally circular shape. Further, two or more sets or pluralities of apertures 288 have varying diameters. For example, the second plurality of apertures 288*c* with a diameter D1 is arranged adjacent to the large central aperture 288*b* that is disposed on the bottom side 294 of the frame 270'. A third plurality of apertures 288*d* having a diameter D2, which is larger than the diameter D1 of the second plurality of apertures 288*c*, is arranged toward the periphery of the bottom side 294 of the frame 270'. A fourth plurality of apertures 288*e* having a diameter D3, which is smaller than the diameter D2 of the third plurality of apertures 288*d* but larger than the diameter D1 of the second plurality of apertures 288*c*, is arranged between the second and third pluralities of apertures 288*c*, 288*d* along the bottom side 294 of the frame 270'.

Figure 18:
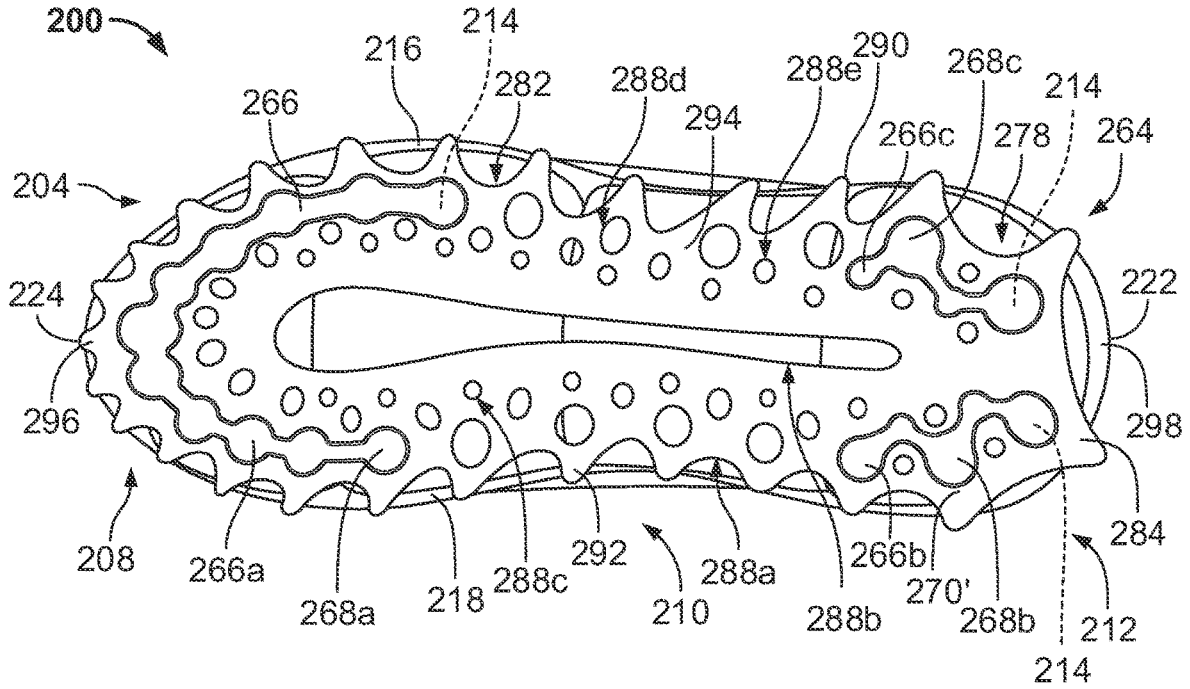
FIG. 18 is a bottom view of the article of footwear of FIG. 17, with an example outsole member included in the frame.
Figure 19:
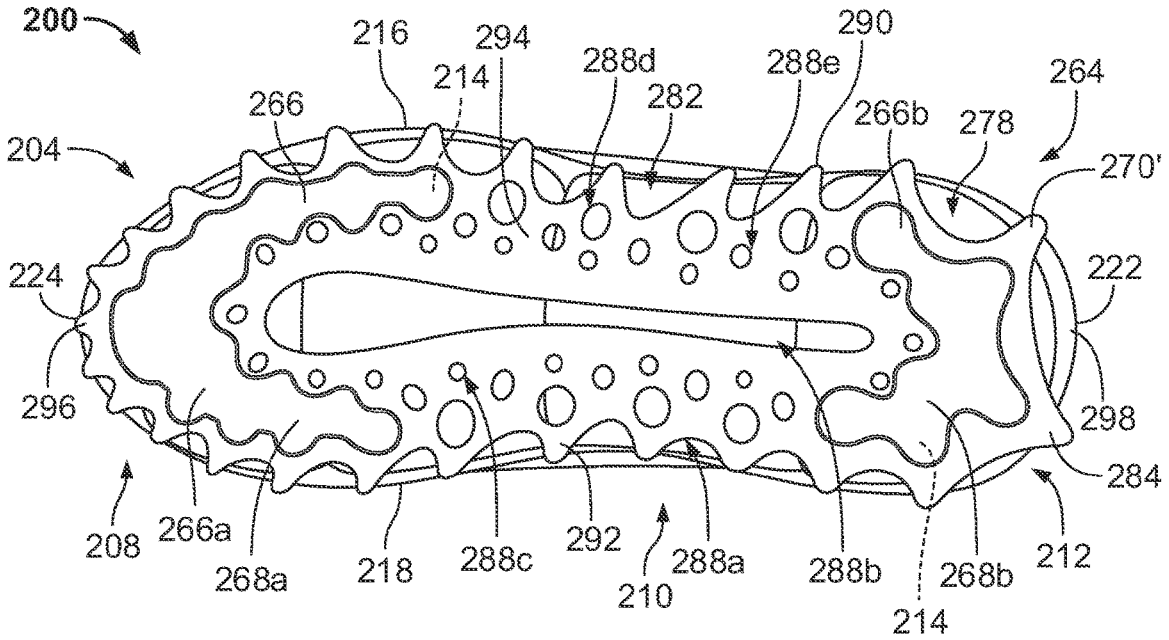
FIG. 19 is a bottom view of the article of footwear of FIG. 17, with another example outsole member included in the frame.
Figure 20:
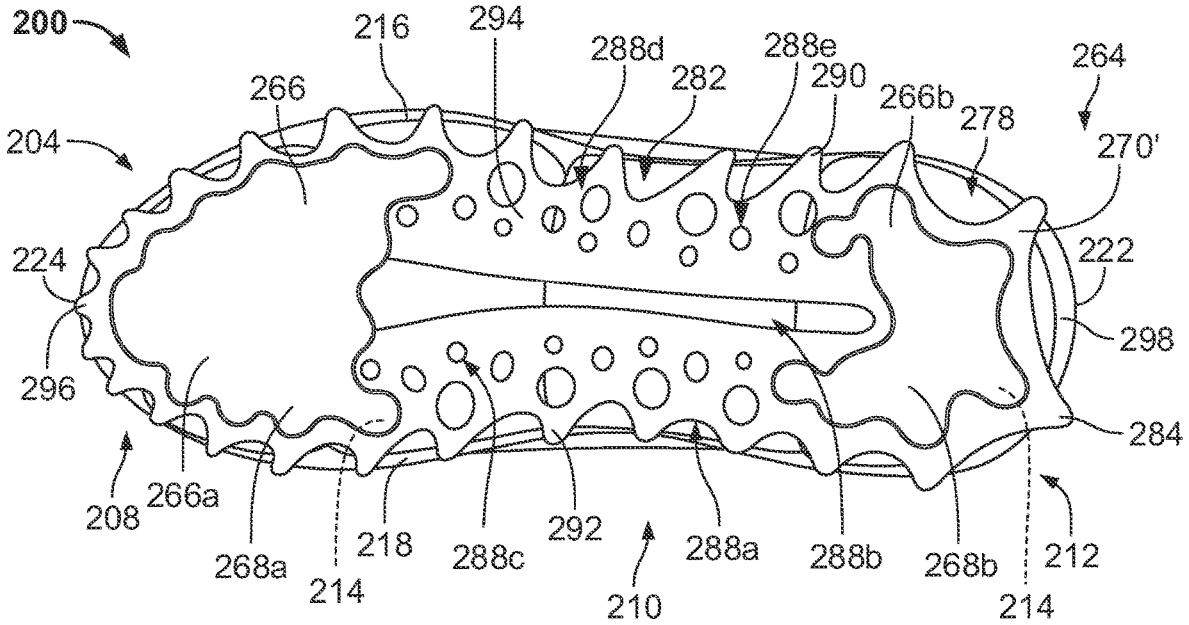
FIG. 20 is a bottom view of the article of footwear of FIG. 17, with yet another example outsole member included in the frame.

In some embodiments, the outsole members 268 can be configured to attach to the exterior surface 284 of the frame 270' via one or more protrusions 214 that are configured to be received by apertures 288 disposed on the bottom side 294 of the frame 270', similar to the exemplary outsole members 268 of FIGS. 14-16 described above, but can be further configured to be received by two or more apertures 288 of varying shapes and sizes. Referring specifically to FIGS. 18 and 19, in the illustrated embodiment, the protrusions 214 of the one or more outsole members 268 may be configured to be received by only one of the second, third, or fourth pluralities of apertures 288*c*, 288*d*, 288*e* (such as, e.g., the first outsole member 268*a* of FIG. 18) disposed on the bottom side 294 of the frame 270' or by two or more of the second, third, and fourth pluralities of apertures 288*c*, 288*d*, 288*e* (such as, e.g., the second and third outsole members 268*b*, 268*c* of FIG. 18 and the first and second outsole members 268*a*, 268*b* of FIG. 19). In some embodiments, the frame 270' and the outsole members 268 may be configured such that the outsole members 268 are removably attached to the exterior surface 284 of the frame 270' via an interference fit between the protrusions 214 and the corresponding apertures 288. In some embodiments, the outsole members 268 can be adhered to the exterior surface 284 of the frame 270' and/or the protrusions 214 extending through the apertures 288 can be adhered to the bottom portions 282 of the midsole members 278. In some embodiments, the protrusions 214 can include a flange (not shown) that can be configured to contact and engage the interior surface 286 of the bottom side 294 of the frame 270'. In such embodiments, the flanges of the protrusions 214 of the outsole members 268 may be adhered to the interior surface 286 of the frame 270'.

In FIG. 18, the first outsole member 268*a* is configured to attach to only the third plurality of apertures 288*d* while the second outsole member 268*b* and the third outsole member 268*c* are configured to attach to both the third and fourth pluralities of apertures 288*d*, 288*e*. Similarly, in FIG. 19, both the first and the second outsole members 268*a*, 268*b* are configured to attach to both the third and the fourth pluralities of apertures 288*d*, 288*e* disposed on the bottom side 294 of the frame 270'. In such embodiments, the outsole members 268 can be configured to attach proximate to the periphery of the bottom side 294 of the frame 270' via the third plurality of apertures 288*d* and proximate to the central aperture 288*b* via the second plurality of apertures 288*c*. Similar to the outsole members 268 of FIGS. 14-16, the first, second, and third outsole members 268*a*, 268*b*, 268*c* of FIG. 18 and the first and second outsole members 268*a*, 268*b* of FIG. 19, respectively, can each form distinct bottom surface portions 266*a*, 266*b*, 266*c* located below the exterior surface 284 of the frame 270' that can at least partially define the bottom surface 266 of the outsole 264 of the article of footwear 200. In this configuration, the frame 270' can provide greater traction to the article of footwear 200 on the bottom side 294 of the frame 270' while providing greater flexibility to the frame 270' and greater support to the article of footwear 200 via the large central aperture 288*b* of the frame 270'.

In some embodiments, the one or more outsole members 268 can be configured to attach to other parts of the frame 270'. For example, referring specifically to FIG. 20, the outsole members 268 can be further configured to at least partially attach to each of the second, third, and fourth pluralities of apertures 288*c*, 288*d*, 288*e* as well as a portion of the large central aperture 288*b* of the frame 270'. In the illustrated embodiment of FIG. 20, the first outsole member 268*a* is attached to the second, third, and fourth pluralities of apertures 288*c*, 288*d*, 288*e* disposed in the forefoot region 208 and is partially attached to a distal portion of the central aperture 288*b* in the forefoot region 208. In such embodiments, the frame 270' and the outsole members 268 can provide even greater traction to the article of footwear 200 on the bottom side 294 of the frame 270' while providing greater flexibility to the frame 270' and support to the article of footwear 200 via the large central aperture 288*b* of the frame 270', i.e., by providing a larger surface area of the bottom surface portion 266*a* for at least the first outsole member 268*a* to contact the ground surface.

Referring to FIGS. 6-20, various components of the article of footwear 200, including the upper 202, the midsole members 278, the frames 270, 270', and/or the outsole members 268, may be formed through additive manufacturing techniques, such as by one or more of the various 3D printing techniques mentioned above. For example, in some embodiments, the frame 270 may be 3D printed using a first material and the outsole members 268 may be simultaneously 3D printed within the frame 270 using a second material that is different than the first material. In some embodiments, the outsole members 268 may be 3D printed separate from the frame 270 and later attached to the frame 270. In some embodiments, the outsole members 268 can be 3D printed such that the protrusions 214 are formed of a first material while the remainder of the outsole members 268 are formed of a second material that is different than the first material.

Referring now to FIGS. 21-26, another exemplary embodiment sole structure 204' and frame 270" of the article of footwear 200 is depicted. The sole structure 204' and the frame 270" of the article of footwear 200 in FIGS. 21-26 are similar to the previous embodiments shown in FIGS. 6-20, with like elements being indicated by similar reference numerals. While the sole structure 204' and the frame 270" of FIGS. 21-26 are similar to previous embodiments in many aspects, there are some aspects that differ. In particular, the midsole members 278 have an interconnected upper portion 280 with the bottom portions 282 extending downward from the upper portion 280 such that one or more gaps 234 extend between the bottom portions 282 of the midsole members 278.

Figure 21:
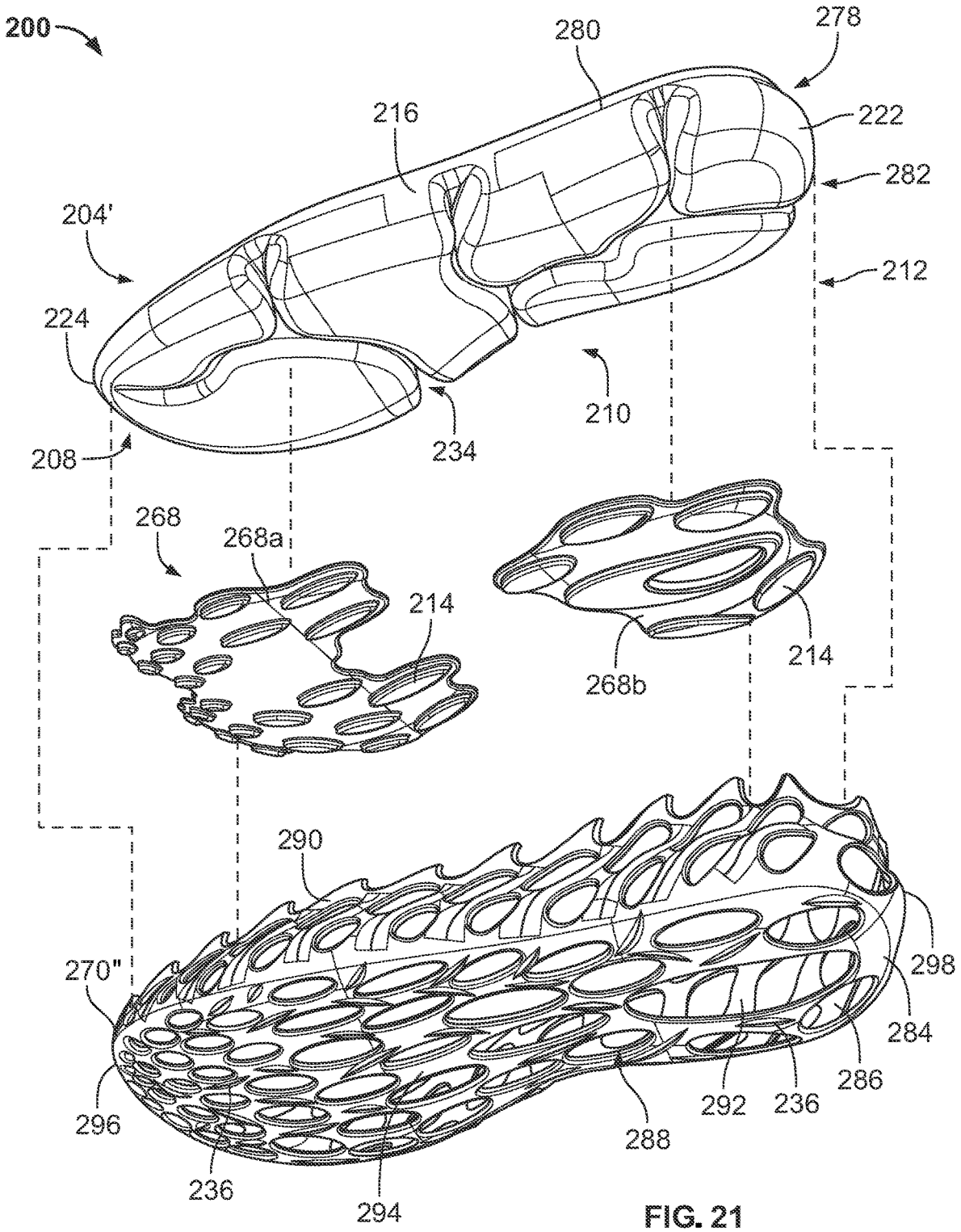
FIG. 21 is a bottom-lateral side perspective exploded view of another example sole structure and a frame of the article of footwear of FIG. 6, with an upper removed.
Figure 23:
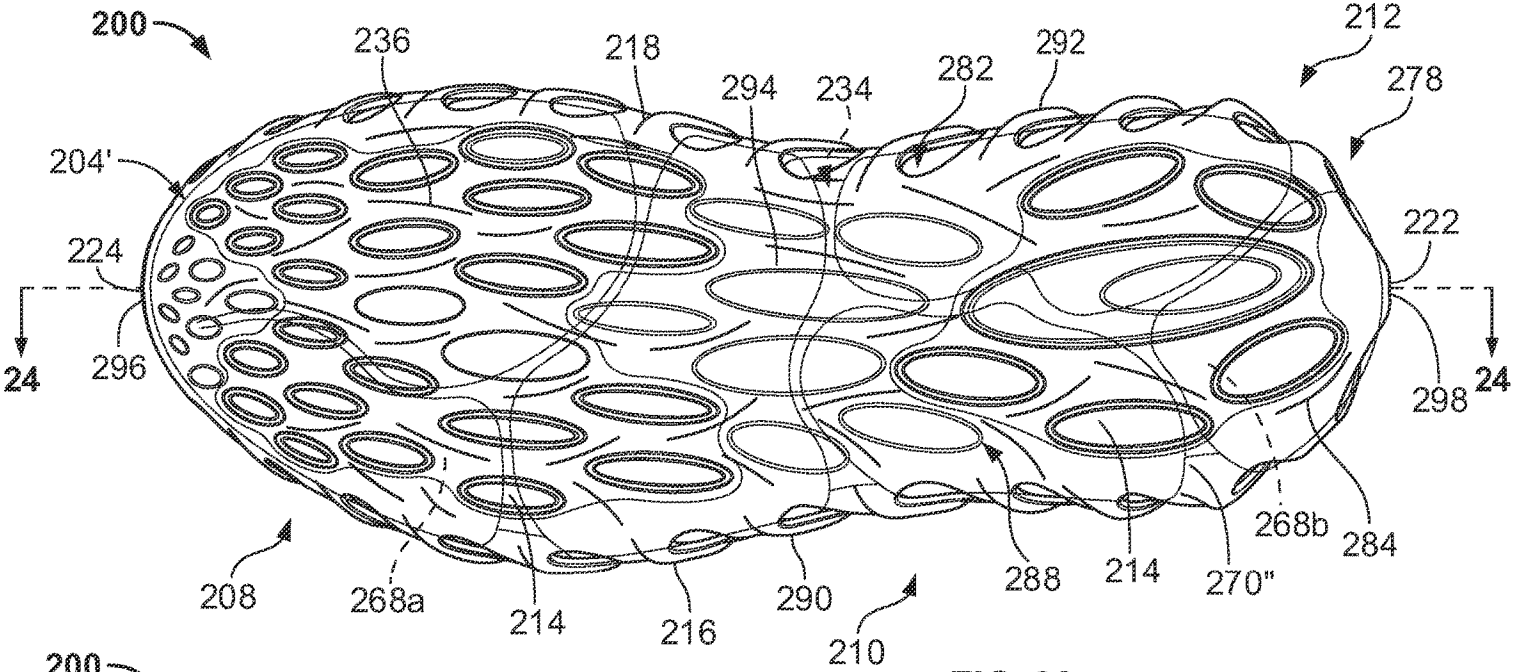
FIG. 23 is a bottom view of the sole structure and the frame of FIG. 21.

Referring specifically to FIG. 21, the sole structure 204' and the frame 270" of the article of footwear 200 are shown in an exploded view. The frame 270" has a lattice-work structure formed by a plurality of apertures 288 disposed on the lateral side 290, medial side 292, bottom side 294, distal side 296, and proximal side 298. The frame 270" further includes a plurality of outsole members 268 including a first outsole member 268*a* and a second outsole member 268*b*, each having protrusions 214*a*, 214*b* and disposed between a first interior surface 286*a* of the bottom side 294 of the frame 270" and the bottom portions 282 of the midsole members 278. Referring specifically to FIG. 23, the first outsole member 268*a* is disposed in the forefoot region 208 and partially in the midfoot region 210 of the sole structure 204', and the second outsole member 268*b* is disposed entirely in the heel region 212 of the sole structure 204'.

Referring again to FIG. 21, the bottom side 294 of the frame 270" can include a plurality of ribs 236 extending from the exterior surface 284 and arranged between the plurality of apertures 288. In such embodiments, the plurality of ribs 236 on the bottom side 294 of the frame 270" can be configured to provide additional traction to the article of footwear 200 by at least partially defining the bottom surface 266 of the outsole 264 (see FIG. 26). Further, in some embodiments, the plurality of ribs 236 can provide increased structural support to the bottom side 294 of the frame 270". In some embodiments, the ribs 236 extend from the exterior surface 284 of the frame 270" to a distance that is equal to or less than a distance that the protrusions 214*a*, 214*b* of the outsole members 268 extend past the exterior surface 284 of the frame 270". In some embodiments, the ribs 236 are comprised of a material having one or more properties that are different than a material that comprises at least the bottom side 294 of the frame 270". For example, the bottom side 294 of the frame 270" can be comprised of a first material while the ribs 236 can be comprised of a second material that has a greater hardness or has greater frictional attributes than the first material.

Figure 22:
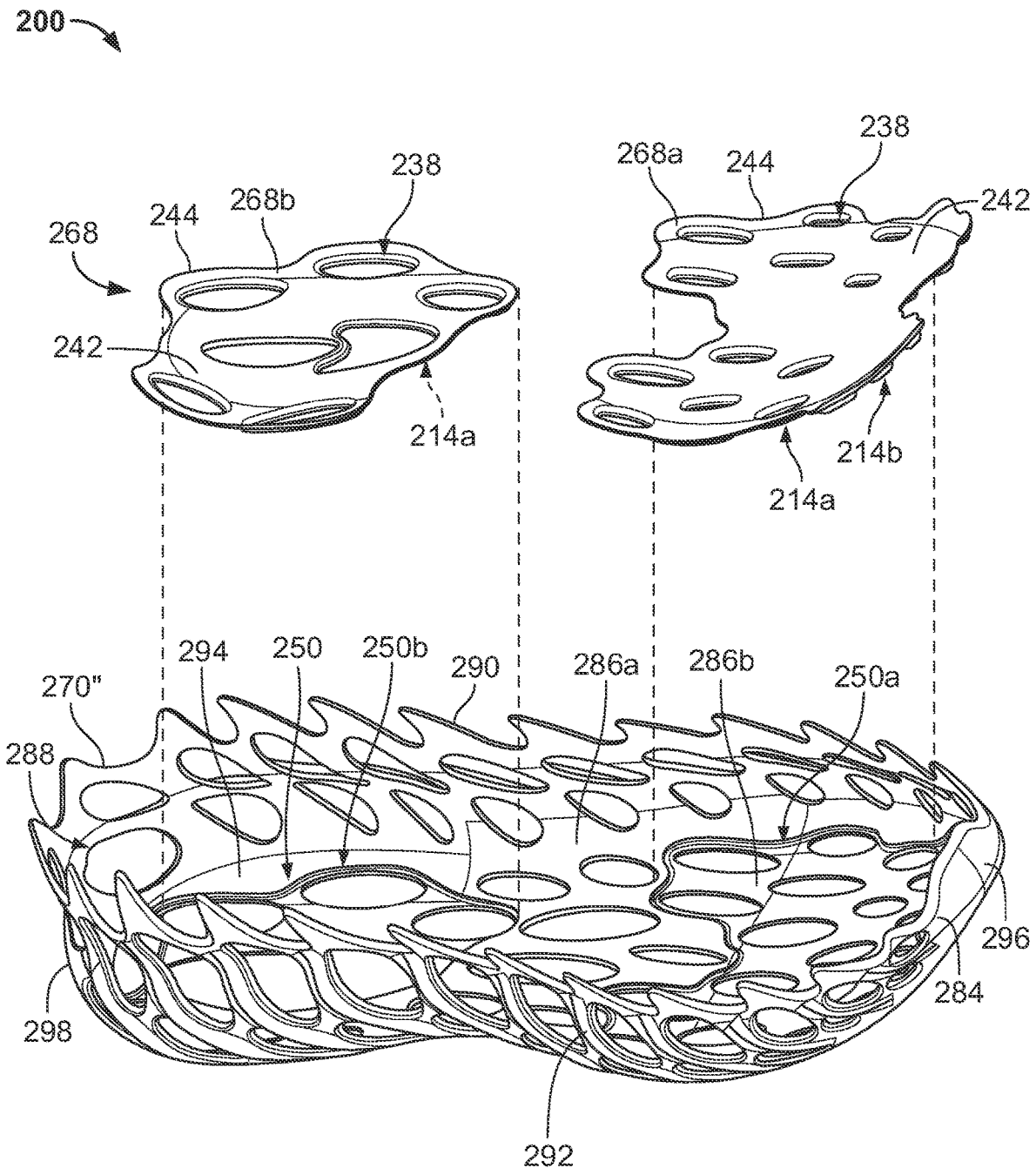
FIG. 22 is a top-medial side perspective exploded view of the frame and outsole members of FIG. 21.

Referring to FIG. 22, the first interior surface 286*a* of at least the bottom side 294 of the frame 270" can include one or more cavities 250 that are configured to receive one or more outsole members 268. In the illustrated embodiment, the cavities 250 of the frame 270" have an outer shape that matches an outer perimeter 244 of one or more outsole members 268. Similarly, with reference to FIG. 24, the cavities 250 may have a depth D that may correspond to a thickness $T_1$ of the outsole members 268. The depth D being measured from the first interior surface 286*a* of the frame 270" to a second interior surface 286*b* of the cavity 250, and the thickness $T_1$ being measured from an interior surface 242 to an exterior surface 248 of the outsole member 268 at a point on the outsole member 268 that does not include a protrusion 214*a*, 214*b*. In some embodiments, the outsole members 268 can have a thickness $T_1$ in a range of about 0.3 mm to about 2 mm, in a range of about 0.5 mm to about 1.5 mm, or in a range of about 0.7 mm to about 1.3 mm. In some embodiments, the depth D of the cavities 250 of the frame 270" can be greater than or equal to the thickness $T_1$ of the outsole members 268. In some embodiments, the depth D of the cavities 250 of the frame 270" can be less than the thickness $T_1$ of the outsole members 268.

Referring again to FIG. 22, the outsole members 268 may include one or more recesses 238 corresponding to one or more of the protrusions 214*a*. The recesses 238 may be disposed on the interior surface 242 of the outsole members 268 such that each of the recesses 238 align with at least one of the protrusions 214*a*, 214*b* disposed on the exterior surface 248 of the outsole member 268. Some of the protrusions 214*b* of the outsole members 268 may not have a corresponding recess 238, as illustrated in FIG. 22. In some embodiments, each of the protrusions 214*a*, 214*b* of the outsole members 268 may have a corresponding recess 238. Referring again to FIG. 24, the outsole members 268 have a thickness $T_2$ measured at a point on the outsole member 268 that includes a protrusion 214*a* with a corresponding recess 238 from the interior surface 242 (i.e., within the corresponding recess 238 of the protrusion 214) to the exterior surface 248. In some embodiments, the thickness $T_2$ can be equal to the thickness $T_1$ of the outsole members 268, such that the outsole members 268 have a uniform thickness from any point measured from the interior surface 242 to the exterior surface 248 of the outsole members 268. In some embodiments, the thickness $T_2$ can be greater than or less than the thickness $T_1$ of the outsole members 268.

Figure 24:
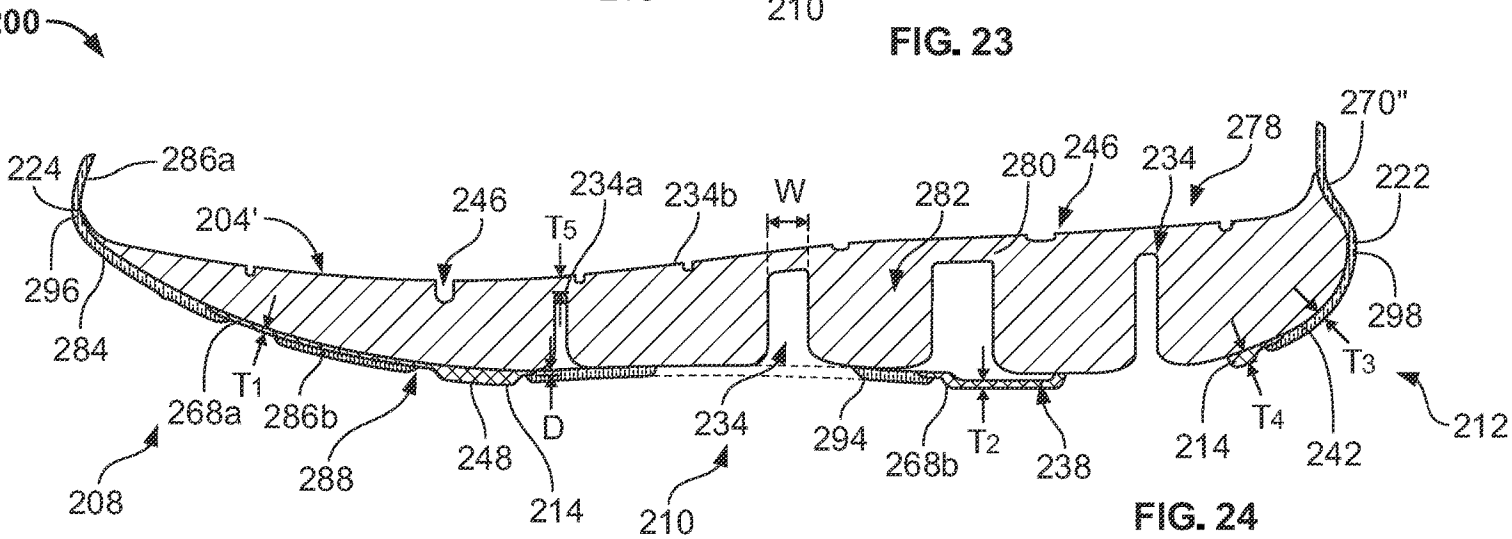
FIG. 24 is a cross-sectional view taken along line 24-24 of FIG. 23.
Figure 25:
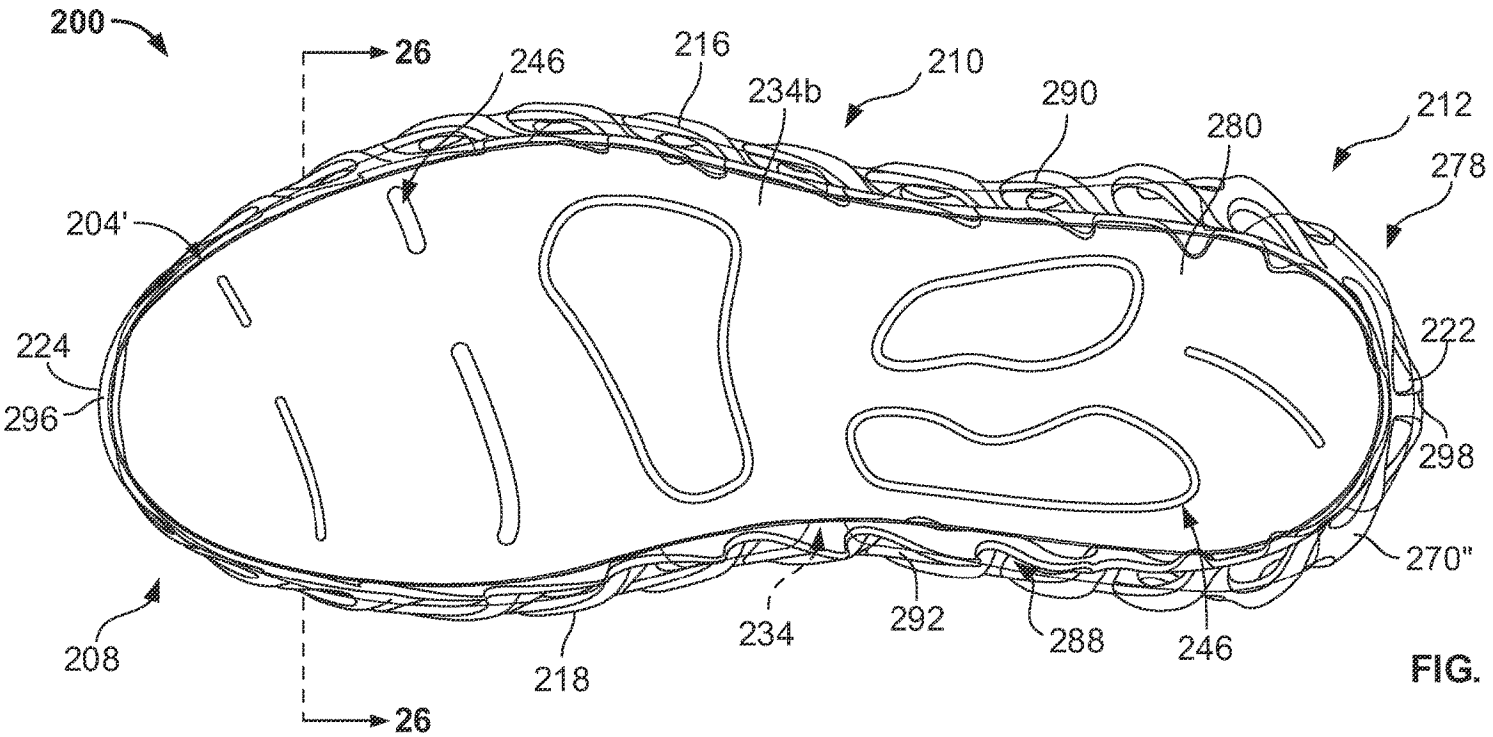
FIG. 25 is a top view of the sole structure and the frame of FIG. 21.

With continued reference to FIG. 24, the gaps 234 extending between the bottom portions 282 of the midsole members 278 extend from the upper portion 280 through the bottom portions 282 and can extend through the lateral side 216 and/or medial side 218 of the sole structure 204'. In some embodiments, the gaps 234 of the midsole members 278 can extend in a straight line from the lateral side 216 to the medial side 218 of the sole structure 204'. In some embodiments, the gaps 234 can extend through the proximal end 222 and/or the distal end 224 of the sole structure 204'. Referring to FIGS. 24 and 25, one or more channels 246 can be defined on an upper surface 234*b* of the upper portion 280 of the midsole members 278. In some embodiments, the channels 246 may be disposed above one or more of the bottom portions 282 between the gaps 234, such as, e.g., on a portion of the upper portion 280 that aligns with a bottom portion 282 disposed in the forefoot region 208 of the sole structure 204'. In some embodiments, the midsole member 278 may be comprised of an ethylene vinyl acetate (EVA) that may be formed via a compression molding process.

Referring specifically to FIG. 24, the frame 270" has a thickness $T_3$ measured from the exterior surface 284 to the first interior surface 286*a* of the frame 270". In some embodiments, the thickness $T_3$ of the frame 270" can be in a range of about 0.5 mm to about 8 mm, in a range of about 0.8 mm to about 6 mm, in a range of about 1 mm to about 10 mm, in a range of about 1 mm to about 5 mm, or in a range of about 0.8 mm to about 4 mm. In the illustrated embodiment, the protrusions 214*b* of the outsole members 268 that do not have a corresponding recess 238 have a thickness $T_4$ measured from the interior surface 242 of the outsole member 268 that contacts the bottom portions 282 of the midsole members 278 to the exterior surface 248 of the protrusion 214*b*. In some embodiments, such protrusions 214*b* of the outsole members 268 can have a thickness $T_4$ in a range of about 0.3 mm to about 10 mm, in a range of about 0.5 mm to about 12 mm, in a range of about 0.8 to about 14 mm, in a range of about 1 mm to about 6 mm, or in a range of about 0.6 mm to about 5 mm. In some embodiments, the thickness $T_4$ of the protrusions 214*b* can be greater than the thickness $T_3$ of the frame 270" such that the exterior surface 248 of the protrusions 214*b* extend past the exterior surface 284 of the bottom side 294 of the frame 270". In other embodiments, the thickness $T_4$ of the protrusions 214*b* can be equal to or less than the thickness $T_3$ of the frame 270" such that the exterior surface 248 of the protrusions 214*b* do not extend past the exterior surface 284 of the bottom side 294 of the frame 270".

With continued reference to FIG. 24, the gaps 234 of the midsole members 278 have a width W measured between opposing surfaces of the bottom portions 282 of the midsole members 278. In some embodiments, the gaps 234 of the midsole members 278 can have a width W in a range of about 0.1 mm to about 5 mm, in a range of about 0.2 mm to about 3 mm, in a range of about 0.3 mm to about 2 mm, or in a range of about 0.5 mm to about 1.5 mm. Referring still to FIG. 24, the interconnected upper portion 280 of the midsole members 278 has a thickness $T_5$ measured from the upper end 234*a* of the gaps 234 to the upper surface 234*b* of the midsole members 278. In some embodiments, the upper portion 280 of the midsole members 278 can have a thickness $T_5$ in a range of about 2.5 mm to about 10 mm, in a range of about 3 mm to about 8 mm, or in a range of about 3.5 mm to about 7 mm.

Figure 26:
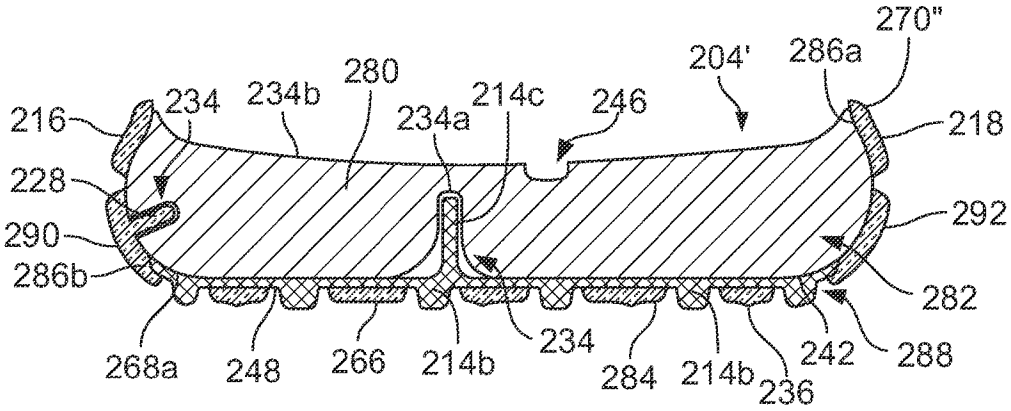
FIG. 26 is a cross-sectional view taken along line 26-26 of FIG. 25.

Referring to FIG. 26, the outsole members 268*a*, 268*b* can further include a second plurality of protrusions 214*c* extending from the interior surface 242 of the outsole members 268*a*, 268*b*. In some embodiments, the second plurality of protrusions 214*c* may be configured to be received within the gaps 234 of the midsole members 278 (as illustrated in FIG. 26) or to otherwise contact or engage the bottom portions 282 of the midsole members 278. Similarly, the frame 270" can further include one or more protrusions 228 extending from the first interior surface 186*a* of the lateral side 290, the medial side 292, the bottom side 294, the distal side 296, and/or the proximal side 298. In some embodiments, the protrusions 228 of the frame 270" may be configured to be received within the gaps 234 of the midsole members 278 (as illustrated in FIG. 26) or to otherwise contact or engage the bottom portions 282 of the midsole members 278.

Figure 27:
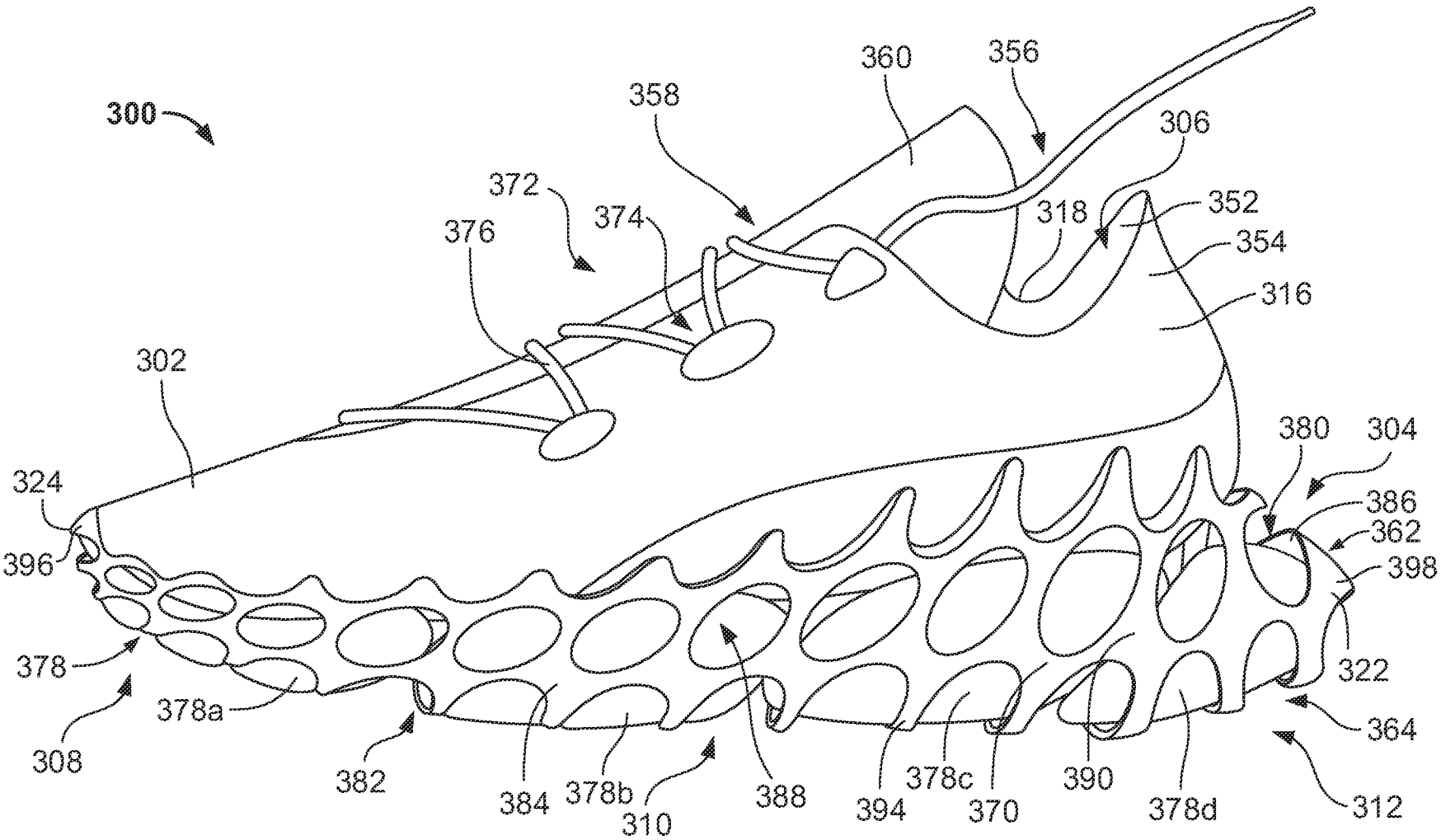
FIG. 27 is a lateral side view of another example of an article of footwear that is similar to the article of footwear of FIG. 1.

Referring now to FIG. 27, another exemplary embodiment of an article of footwear 300 is depicted, which includes an upper 302, a sole structure 304, and a frame 370. The article of footwear 300 is similar to previous embodiments, with like elements being indicated by similar reference numerals under the "3xx" series of reference numerals. In the article of footwear 300, the fastening mechanism 372 includes a first fastening member or plurality of lace retainers 374 disposed along the lateral side 316 and the medial side 318 of the upper 302 adjacent to the tongue 360 and within the midfoot region 310 of the article of footwear 300. A second fastening member or lace 376 extends through the plurality of lace retainers 374 in a crisscrossing manner across the tongue 360. In some embodiments, the plurality of lace retainers 374 can extend adjacent to the tongue 360 within the forefoot and midfoot regions 308, 310 of the article of footwear 300.

With continued reference to FIG. 27, in the illustrated embodiment, at least the fourth midsole member 378*d* is not attached to the upper 302. Instead, the fourth midsole member 378*d* is held in place adjacent to the upper 302 by the frame 370. Thus, in such embodiments, the fourth midsole member 378*d* may be configured to provide support to a user only when the user's heel strikes a ground surface, such as, e.g., by causing at least a portion of the frame 370 to compress or move relative to the upper 302. In some embodiments, two or more of the midsole members 378*a*, 378*b*, 378*c*, 378*d* may be not attached to the upper 302 and held adjacent to the upper 302 by the frame 370. In some embodiments, the fourth midsole member 378*d* may be attached to the frame 370. In some embodiments, two or more midsole members 378*a*, 378*b*, 378*c*, 378*d* may be attached to the frame 370 while two or more midsole members 378*a*, 378*b*, 378*c*, 378*d* may be attached to the upper 302.

Figure 28:
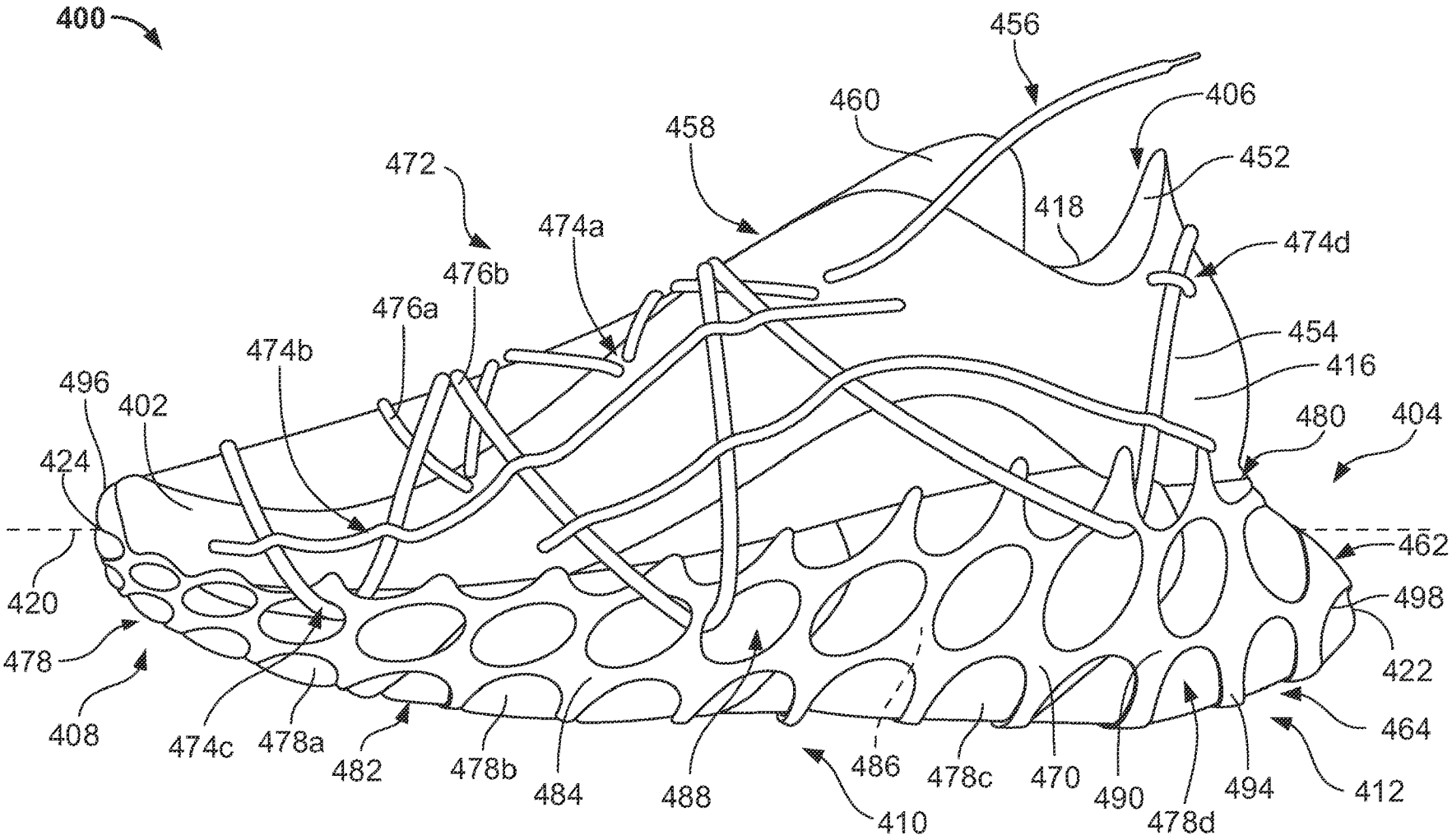
FIG. 28 is a lateral side view of yet another example of an article of footwear that is similar to the article of footwear of FIG. 1.
Figure 29:
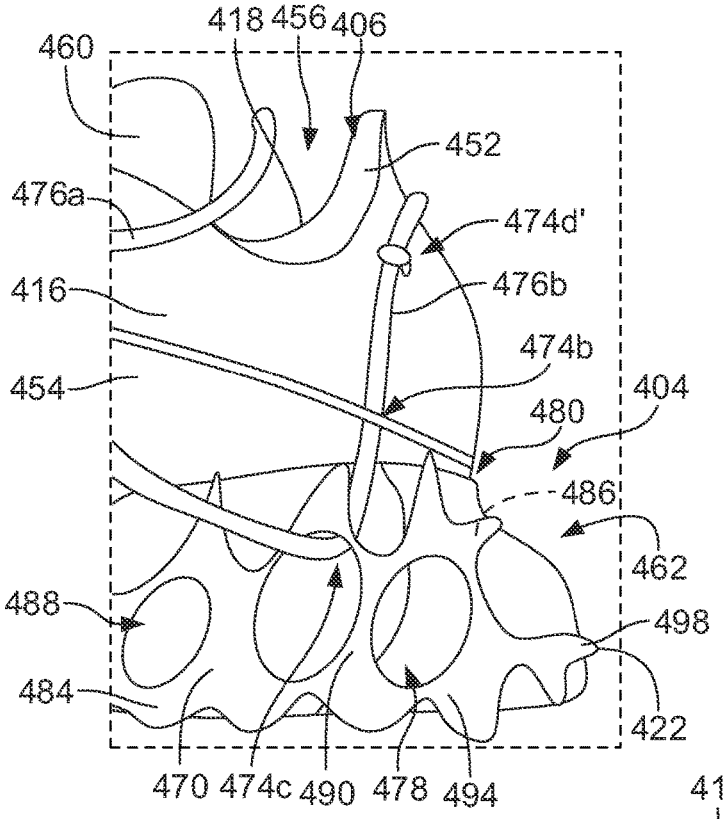
FIG. 29 is a lateral side detail view of another example of a fastening mechanism of the article of footwear of FIG. 28, with a second lace in a tightened configuration.
Figure 30:
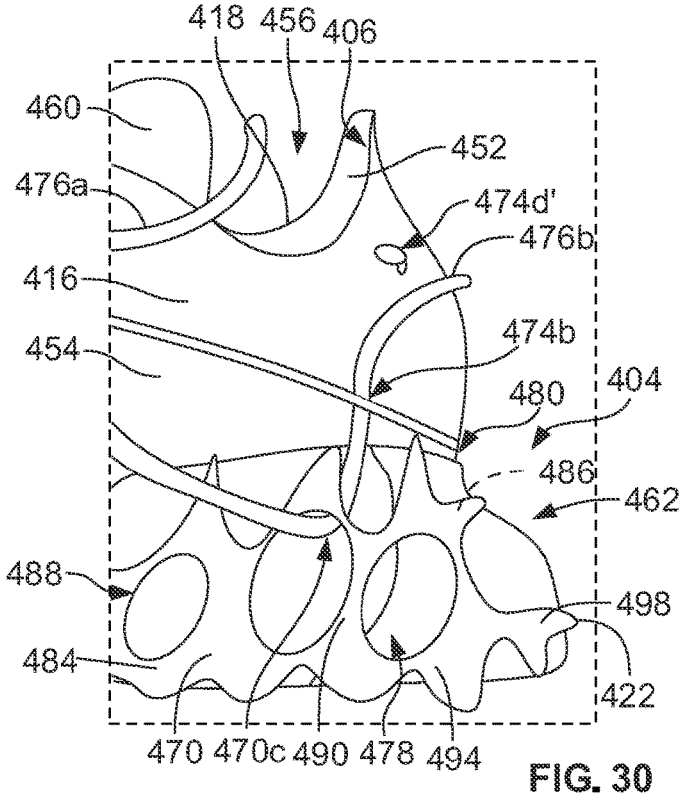
FIG. 30 is a lateral side detail view of the article of footwear of FIG. 29, with the second lace in a loosened configuration.

Referring now to FIGS. 28-30, yet another exemplary embodiment of an article of footwear 400 is depicted, which includes an upper 402, a sole structure 404, and a frame 470. The article of footwear 400 is similar to previous embodiments, with like elements being indicated by similar reference numerals under the "4xx" series of reference numerals. In the article of footwear 400, the fastening mechanism 472 includes a first fastening member or first plurality of lace retainers 474*a*, a second fastening member or second plurality of lace retainers 474*b*, a third fastening member or third plurality of lace retainers 474*c*, a fourth fastening member or fourth plurality of lace retainers 474*d*, a fifth fastening member or first lace 476*a*, and a fifth fastening member or second lace 476*b*.

Referring specifically to FIG. 28, in the illustrated embodiment, the first plurality of lace retainers 474*a* are pairs of apertures extending through the lateral side 416 and the medial side 418 of the upper 402 adjacent to the tongue 460. The first lace 476*a* extends through the first plurality of lace retainers 474*a* in a crisscrossing manner across the tongue 460. Free ends of the first lace 476*a* extend from the first plurality of lace retainers 474*a* adjacent to the opening 456 of the upper 402 such that a user can tighten and tie together the free ends of the first lace 476*a* along the tongue 460. The second plurality of lace retainers 474*b* are disposed on the exterior surface 454 of the upper 402 on the lateral and medial sides 416, 418 between the first plurality of lace retainers 474*a* and the sole structure 404. In some embodiments, the second plurality of lace retainers 474*b* can be formed by one or more strips of material adhered to the exterior surface 454 of the upper 402 with one or more unconnected portions that form loops to receive the second lace 476*b*.

Referring still to FIG. 28, in the illustrated embodiment, the third plurality of lace retainers 474*c* are part of the lattice-work structure of the frame 470 that is formed by the plurality of apertures 488. More specifically, one or more apertures 488 disposed on the lateral side 490 and the medial side (not shown) of the frame 470 and aligned with the second plurality of lace retainers 474*b* are configured to receive a portion of the second lace 476*b* extending along the exterior surface 484 to the interior surface 486 of the frame 470, or vice versa. In the illustrated embodiment, the third plurality of lace retainers 474*c* includes three lace retainers on each of the lateral and medial sides 416, 418 of the article of footwear 400. In some embodiments, the third plurality of lace retainers 474*c* can include four or more lace retainers. In the illustrated embodiment, the fourth plurality of lace retainers 474*d* are one or more loops formed on the exterior surface 454 of the upper 402 adjacent to the proximal end 422 and the opening 456 of the upper 402 and on each of the lateral and medial sides 416, 418 of the article of footwear 400.

With continued reference to FIG. 28, the second lace 476*b* extends through the second plurality of lace retainers 474*b* and the third plurality of lace retainers 474*c* in a crisscrossing manner across the tongue 460 and through the fourth plurality of lace retainers 474*d* disposed near the proximal end 422 of the upper 402. Free ends of the second lace 476*b* extend from the second, third, and fourth pluralities of lace retainers 474*b*, 474*c*, 474*d* along the lateral and medial sides 416, 418 of the upper 402 adjacent to the proximal end 422 and the opening 456 of the upper 402 such that a user can tighten and tie together the free ends of the second lace 476*b* along the proximal end 422 of the upper 402 adjacent to the opening 456. In some embodiments, the third plurality of lace retainers 474*c* can include four or more apertures 488 that can be disposed on the lateral side 490 and the medial side (not shown) of the frame 470.

Still referring to FIG. 28, in the illustrated embodiment, the second and third pluralities of lace retainers 474*b*, 474*c* are disposed in each of the forefoot region 408, the midfoot region 410, and the heel region 412 of the article of footwear 400, and the fourth plurality of lace retainers 474*d* are disposed along the upper 402 entirely in the heel region 412. With the second lace 476*b* in a tightened configuration (as shown in FIG. 28), the second lace 476*b* pulls the lateral and medial sides 416, 418 of the upper 402 inward toward the tongue 460 and the tongue 460 downward toward the sole structure 404 via the second plurality of lace retainers 474*b*. Further, with the second lace 476*b* in the tightened configuration, the second lace 476*b* also pulls the frame 470 upwards toward the upper 402 via the third plurality of lace retainers 474*c*. Thus, tightening of the second lace 476*b* may provide additional support to the lateral and medial sides 416, 418 of the upper 402 and also provide tensioning force to further secure the frame 470 to the sole structure 404 of the article of footwear 400.

In some embodiments, the free ends of the second lace 476*b* can extend around the proximal end 422 of the upper 402 such that a user can tighten and tie together the free ends of the second lace 476*b* along the tongue 460 adjacent to the opening 456. In some embodiments, the second lace 476*b* can comprise two laces each having a fixed end disposed toward the distal end 424 of the upper 402 and free ends that extend toward the proximal end 422 of the upper 402 through the second and third pluralities of lace retainers 474*b*, 474*c*. In some embodiments, the free ends of the second lace 476*b* can extend from the second plurality of lace retainers 474*b* adjacent to the distal end 424 of the upper 402 such that a user can tighten and tie together the free ends along the tongue 460 proximal to the distal end 424. In some embodiments, the second lace 476*b* can be a closed loop lace. In such embodiments, the fastening mechanism 472 can further include a lacing mechanism (not shown) that can be disposed along the proximal end 422 of the upper 402 and that can be configured to manually and/or automatically tighten or loosen the second lace 476*b*.

Referring specifically to FIGS. 29 and 30, another exemplary embodiment fourth plurality of lace retainers 474*d*' of the fastening mechanism 472 of the article of footwear 400 is depicted. The fourth plurality of lace retainers 474*d*' of the fastening mechanism 472 of FIGS. 29 and 30 is similar to the previous embodiment of FIG. 28, however, in the illustrated embodiment, the fourth plurality of lace retainers 474*d*' includes one or more hooks and the second lace 476*b* is a closed loop lace. More specifically, the one or more hooks of the fourth plurality of lace retainers 474*d*' have an open end that is configured to removably receive the closed loop second lace 476*b*. Referring to FIG. 29, the closed loop second lace 476*b* of the fastening mechanism 472 is shown in a tightened configuration. In the tightened configuration, a portion of the second lace 476*b* extending from an aperture 488 of the frame 470 to a lateral-proximal lace retainer of the second plurality of lace retainers 474*b* disposed near the proximal end 422 of the upper 402, around the proximal end 422 of the upper 402, and to the medial side 418 of the upper 402 (i.e., the "proximal portion of the second lace 476*b*") is received within the hooks of the fourth plurality of lace retainers 474*d*'. Further, in the tightened configuration (as shown in FIGS. 28 and 29), the second lace 476*b* extends around the proximal end 422 of the upper 402 adjacent to the opening 456 of the upper 402.

Referring to FIG. 30, the closed loop second lace 476*b* of the fastening mechanism 472 is shown in a loosened configuration. In the loosened configuration, the proximal portion of the second lace 476*b* extending around the proximal end 422 of the upper 402 is not disposed within the hooks of the fourth plurality of lace retainers 474*d*. Thus, in the loosened configuration, the proximal portion of the second lace 476*b* is free to move downward along the proximal end 422 and away from the opening 456 of the upper 402. As the proximal portion of the second lace 476*b* moves downward toward the lateral-proximal lace retainer of the second plurality of lace retainers 474*b*, other portions of the second lace 476*b* are permitted to increase in length and thus, loosen around the corresponding portions of the upper 402.

Referring still to FIGS. 29 and 30, in some embodiments, the fourth plurality of lace retainers 474*d*' can comprise a single hook disposed on the proximal end 422 of the upper 402 near a central or longitudinal axis 420 (see FIG. 28) of the article of footwear 400. In some embodiments, a plurality of hooks of the fourth plurality of lace retainers 474*d*' can be disposed on the proximal end 422 of the upper 402 near the central axis 420 (see FIG. 28) and arranged in series between the opening 456 of the upper 402 and the sole structure 404 such that the level of tightness of the closed loop second lace 476*b* can be adjusted based on which of the plurality of hooks of the fourth plurality of lace retainers 474*d*' is utilized to secure the second lace 476*b*. For example, a first hook can be disposed adjacent to the opening 456 that is configured to provide a first tightness to the second lace 476*b* and a second hook can be disposed below the first hook toward the sole structure 404 that is configured to provide a second tightness to the second lace 476*b* that is less tight than the first tightness. In some embodiments, the fourth plurality of lace retainers 474*d*' can include three or more hooks that can be disposed near the proximal end 422 of the upper 402. For example, the lateral-proximal lace retainer (shown in FIGS. 29 and 30) and the medial-proximal lace retainer (not shown) of the second plurality of lace retainers 474*b* can each be replaced with a hook of the fourth plurality of lace retainers 474*d*'. In some embodiments, the closed loop second lace 476*b* can be comprised of an elastic material.

Figure 31:
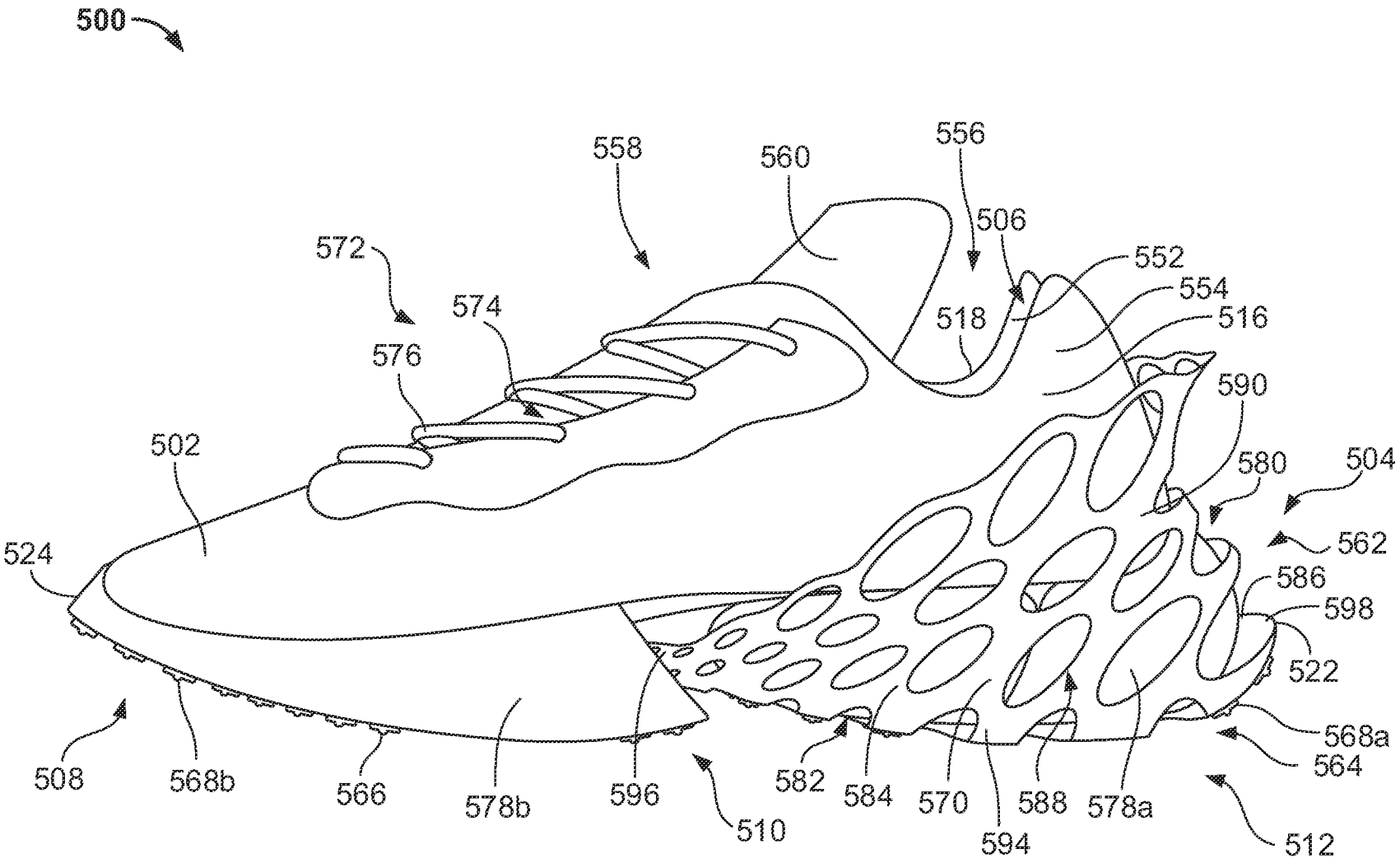
FIG. 31 is a lateral side view of another example of an article of footwear that is similar to the article of footwear of FIG. 1.
Figure 32:
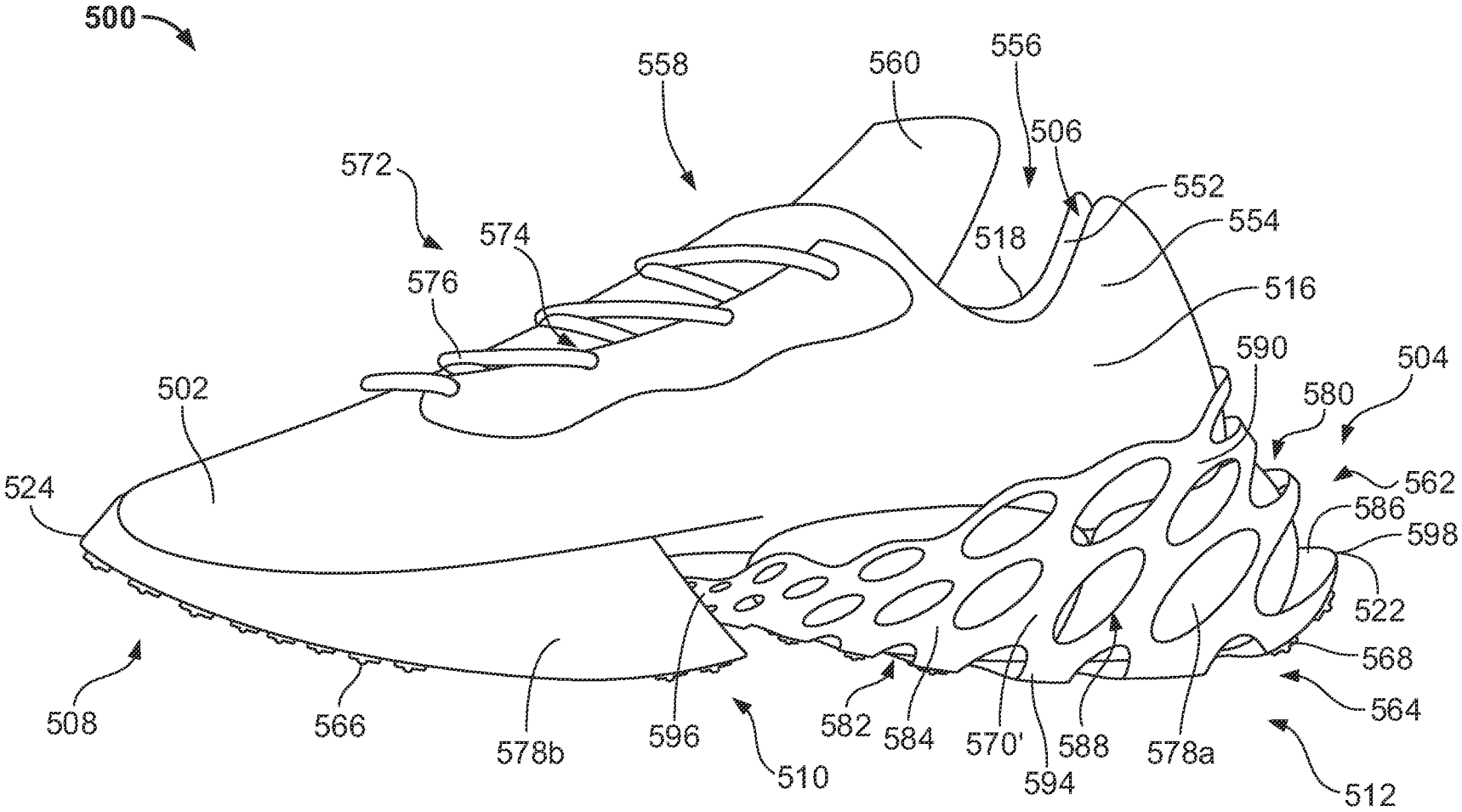
FIG. 32 is a lateral side view of another example frame of the article of footwear of FIG. 31.

Referring now to FIGS. 31 and 32, yet another exemplary embodiment of an article of footwear 500 is depicted, which includes an upper 502, a sole structure 504, and a frame 570. The article of footwear 500 is similar to previous embodiments, with like elements being indicated by similar reference numerals under the "5xx" series of reference numerals. In the article of footwear 500, midsole members of the sole structure 504 include a first midsole member 578*a*, which comprises a plurality of members disposed entirely in the heel region 512 of the sole structure 504, and a second midsole member 578*b*, which comprises a single member disposed in the forefoot region 508 and the midfoot region 510 of the sole structure 504.

Referring specifically to FIG. 31, the frame 570 extends over the first plurality of midsole members 578*a* and along the lateral side 516, the medial side 518, and the proximal end 522 of the sole structure 504 and the upper 502. In the illustrated embodiment, the frame 570 extends increasingly higher along portions of the upper 502 from the midfoot region 510 to the heel region 512 such that the frame 570 extends along a larger portion of the proximal end 522 of the upper 502 than the lateral and medial sides 516, 518 of the upper 502. A plurality of apertures 588 is disposed along the frame 570 that form a lattice-work structure of the frame 570, which permits the first plurality of midsole members 578*a* and the covered portions of the upper 502 to be visible from an outside of the article of footwear 500 through the apertures 588 of the frame 570.

With continued reference to FIG. 31, a first outsole member 568*a* is disposed on the bottom side 594 of the frame 570 and a second outsole member 568*b* is disposed on a bottom side of the second midsole member 578*b*. Similar to the first outsole member 268*a* of the article of footwear 200 of FIGS. 10-13, the first outsole member 568*a* can be disposed between the interior surface 586 of the bottom side 594 of the frame 570 and the first midsole members 578*a* or can be disposed on the exterior surface 584 of the bottom side 594 of the frame 570. In some embodiments, the second outsole member 568*b* can be removably attached or fixedly attached to the bottom of the second midsole member 578*b*. In the illustrated embodiment, the first and second outsole members 568*a*, 568*b* together form the bottom surface 566 of the outsole 564 of the sole structure 504. In some embodiments, the second midsole member 578*b* can comprise a plurality of midsole members. In some embodiments, the frame 570*a* can comprise a first frame that extends over the first midsole members 578*a* and a second frame that extends over the second midsole member 578*b*.

Referring specifically to FIG. 32, another exemplary embodiment frame 570' of the article of footwear 500 is depicted. The frame 570' of FIG. 32 is similar to the frame 570 of FIG. 31, however, the frame 570' covers a smaller portion of the proximal end 522 of the upper 502 than the frame 570 of FIG. 31. Thus, the frame 570' also covers a smaller portion of the lateral and medial sides 516, 518 of the upper 502 than the frame 570 of FIG. 31. In some embodiments, and as discussed above with reference to other embodiments, the article of footwear 500 may be configured such that the frames 570, 570' of FIGS. 31 and 32 are removably attachable to the sole structure 504. Thus, in such embodiments, a user can interchangeably secure either of the frames 570, 570' to the sole structure 504 of the article of footwear 500. In some embodiments, the frames 570, 570' can provide differing structural properties of the sole structure 504 to a user of the article of footwear 500. For example, in such embodiments, at least a portion of the frame 570 can be formed of a first material while a similar portion of the frame 570' can be formed of a second material that is different than the first material.

Figure 33:
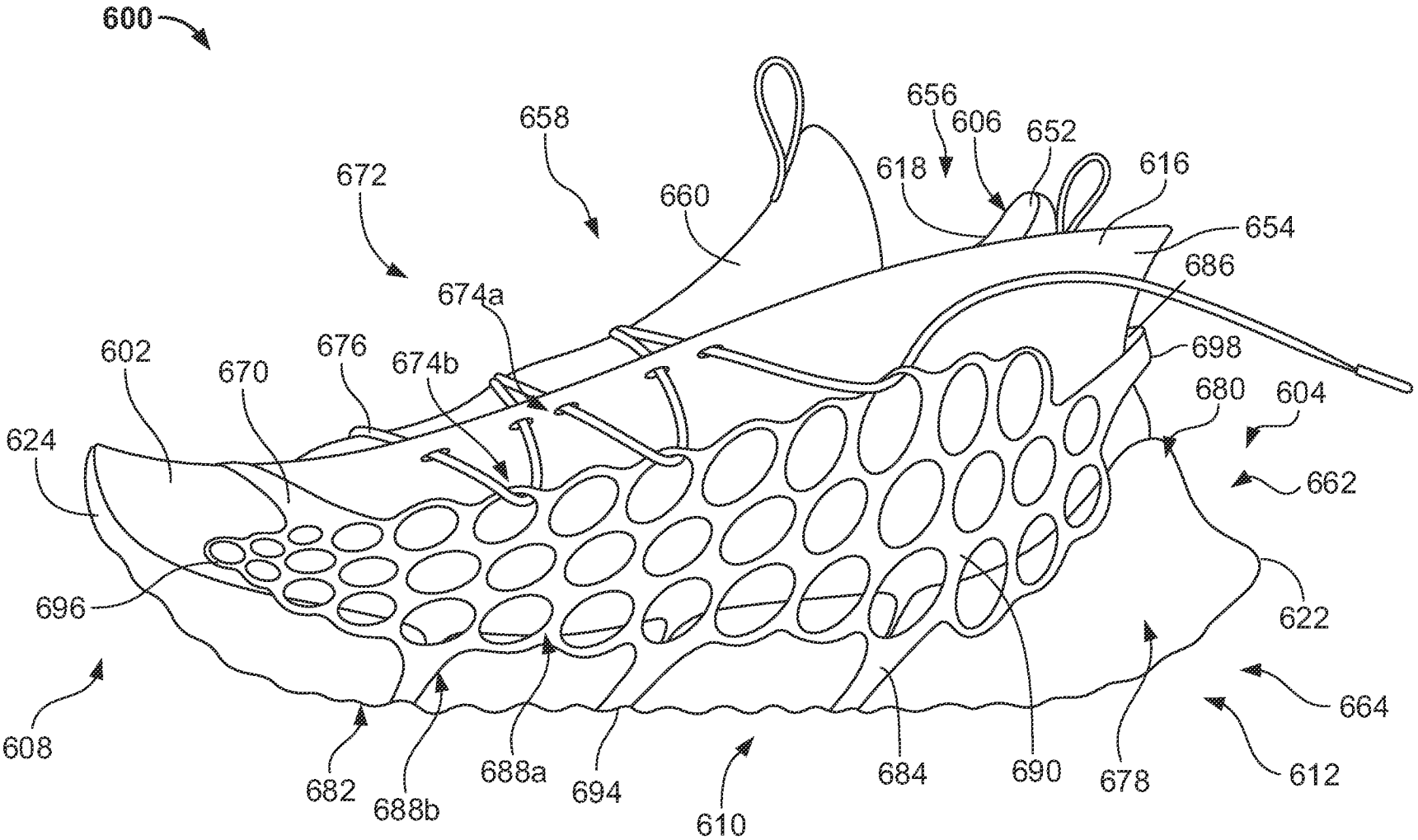
FIG. 33 is a lateral side view of another example of an article of footwear that is similar to the article of footwear of FIG. 1.

Referring now to FIG. 33, yet another exemplary embodiment of an article of footwear 600 is depicted, which includes an upper 602, a sole structure 604, and a frame 670. The article of footwear 600 is similar to previous embodiments, with like elements being indicated by similar reference numerals under the "6xx" series of reference numerals. In the illustrated embodiment, the frame 670 of the article of footwear 600 has a lattice-work structure formed by a plurality of apertures that includes a first plurality of apertures 688*a*, which are disposed substantially on the lateral side 690 and the medial side (not shown) of the frame 670, and a second plurality of apertures 688*b*, which are disposed substantially on the bottom side 694 of the frame 670. Further, the frame 670 is configured such that it covers more of the lateral and medial sides 616, 618 of the upper 602 than the lateral and medial sides 616, 618 of the sole structure 604.

Referring still to FIG. 33, a bottom side 694 of the frame 670 extends over the bottom portions 682 of the midsole members 678 while the lateral side 690 and the medial side (not shown) of the frame 670 extend over the upper portions 680 of the midsole members 678 and portions of the lateral and medial sides 616, 618 of the upper 602. The distal side 696 of the frame 670 extends over the upper 602 between the distal end 624 of the article of footwear 600 and the tongue 660 while the proximal side 698 of the frame 670 extends around the proximal end 622 of the upper 602. The bottom side 694 of the frame 670 includes the second plurality of apertures 688*b*, which, in this embodiment, includes only two large apertures such that the lattice-work structure along the bottom side 694 of the frame 670 extends between gaps between each of the midsole members 678.

Still referring to FIG. 33, the fastening mechanism 672 of the article of footwear 600 includes a first fastening member or first plurality of lace retainers 674*a* and a second fastening member or second plurality of lace retainers 674*b*. In the illustrated embodiment, the first plurality of lace retainers 674*a* are eyelets disposed on the lateral and medial sides 616, 618 of the upper 602 adjacent to the tongue 660, and the second plurality of lace retainers 674*b* are one or more of the first plurality of apertures 688*a* of the frame 670 disposed between the first plurality of lace retainers 674*a* and the sole structure 604. A third fastening member or lace 676 extends through the first plurality of lace retainers 674*a* in a criss-crossing manner across the tongue 660 and through the first and second pluralities of lace retainers 674*a*, 674*b* in parallel, i.e., through one of the first plurality of lace retainers 674*a* to one of the second plurality of lace retainers 674*b*, and back through another one of the first plurality of lace retainers 674*a*.

With continued reference to FIG. 33, free ends of the lace 676 extend through the second plurality of lace retainers 674*b* adjacent to the opening 656 of the upper 602 such that a user can tighten and tie together the free ends of the lace 676 along the tongue 660 adjacent to the opening 656 of the upper 602. In the illustrated embodiment, a user can tighten and tie together the free ends of the lace 676 to provide tension force on the frame 670, which can further secure the frame 670 to the sole structure 604 and provide further support along the lateral and medial sides 616, 618 of the upper 602 of the article of footwear 600 while pulling the tongue 660 downward toward the sole structure 604.

Figure 34:
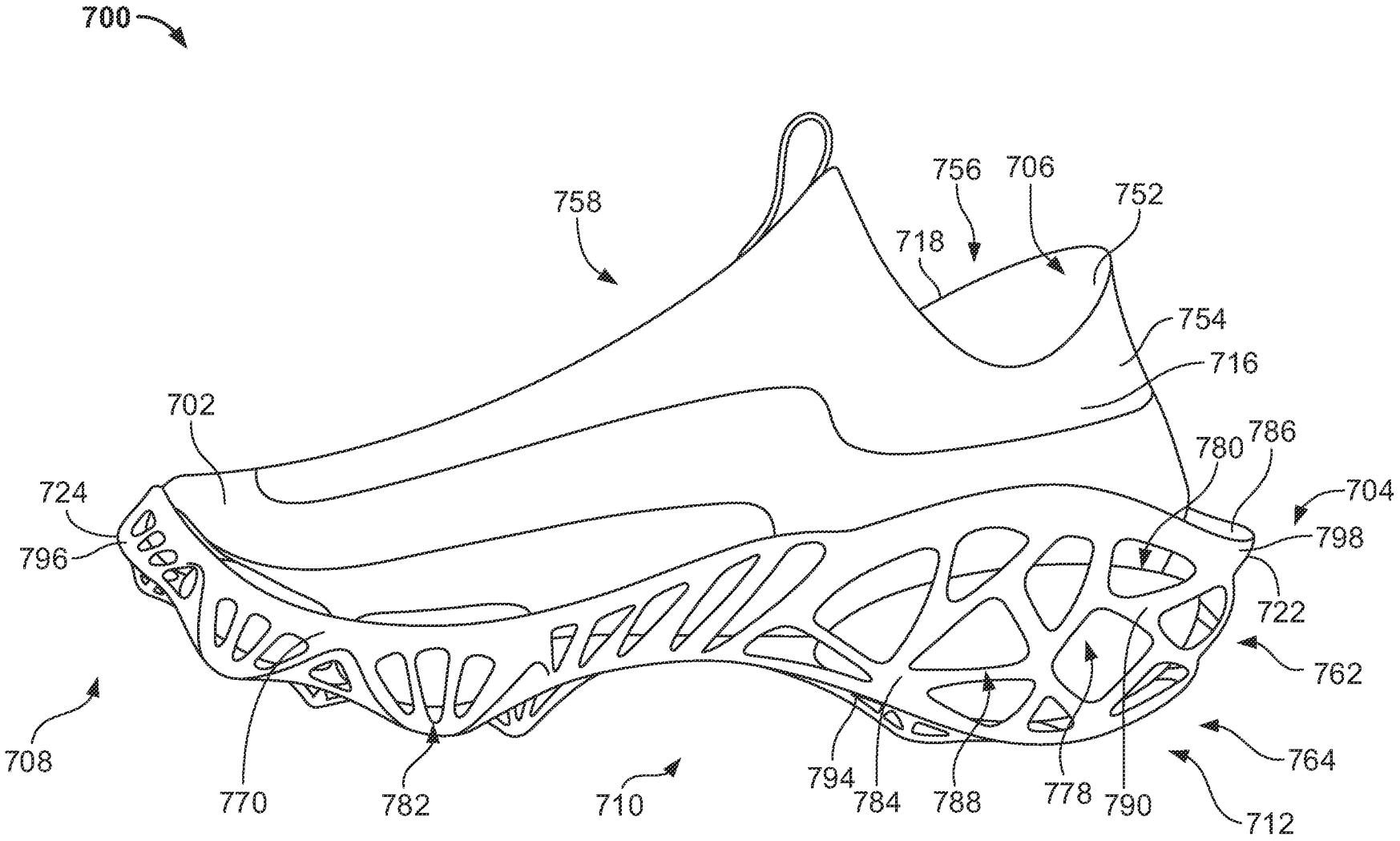
FIG. 34 is a lateral side view of yet another example of an article of footwear that is similar to the article of footwear of FIG. 1.

Referring now to FIG. 34, another exemplary embodiment of an article of footwear 700 is depicted, which includes an upper 702, a sole structure 704, and a frame 770. The article of footwear 700 is similar to previous embodiments, with like elements being indicated by similar reference numerals under the "7xx" series of reference numerals. In contrast to previous embodiments, in the article of footwear 700, neither a tongue nor a fastening mechanism is included along the instep region 758 of the upper 702.

As shown in FIG. 34, the midsole members 778 are disposed only in the forefoot region 708 and the heel region 712 of the sole structure 704 of the article of footwear 700. The frame 770 extends along the lateral side 716, the medial side 718, the proximal end 722, and the distal end 724 of the sole structure 704 and along the lateral and medial sides 716, 718 of a lower portion of the upper 702 in the heel region 712 of the article of footwear 700. In the illustrated embodiment, the bottom side 794 of the frame 770 is shaped such that portions of the frame 770 are proximate to or contact a bottom side of the upper 702 while enlarged cavity sections are provided adjacent the midsole members 778. Further, the frame 770 includes a plurality of apertures 788 having varying shapes and sizes. For example, the apertures 788 disposed in the heel region 712 have shapes with larger widths in comparison to the apertures 788 disposed in the forefoot and midfoot regions 708, 710. In some embodiments, the apertures 788 disposed in the midfoot region 710 can have shapes with larger widths in comparison to the apertures 788 disposed in the forefoot and heel regions 708, 712.

Figure 35:
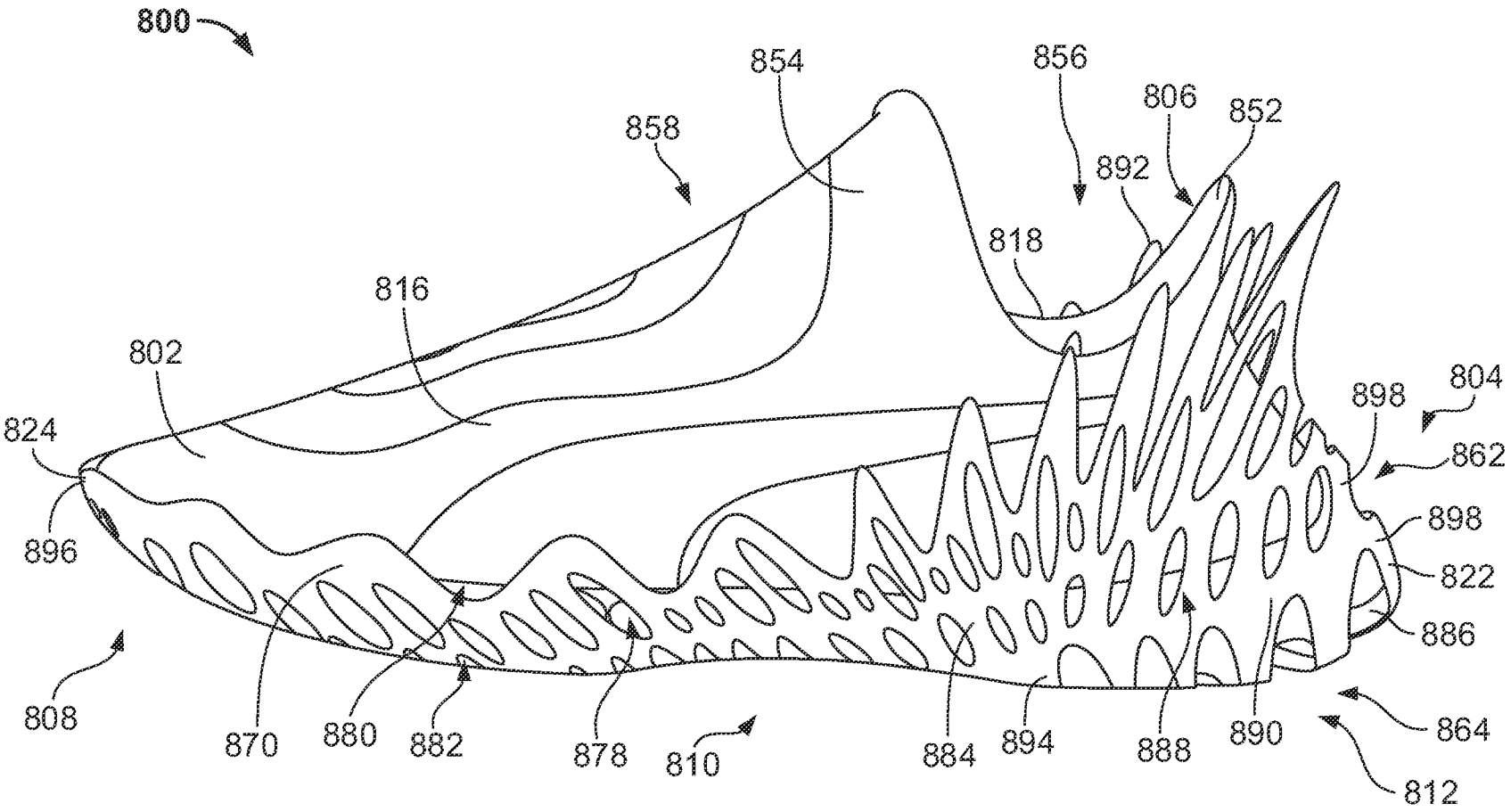
FIG. 35 is a lateral side view of another example of an article of footwear that is similar to the article of footwear of FIG. 1.

Referring now to FIG. 35, yet another exemplary embodiment of an article of footwear 800 is depicted, which includes an upper 802, a sole structure 804, and a frame 870. The article of footwear 800 is similar to previous embodiments, with like elements being indicated by similar reference numerals under the "8xx" series of reference numerals. In contrast to previous embodiments, in the article of footwear 800, the frame 870 extends along the entire proximal end 822 of the upper 802 adjacent to the opening 856 of the upper 802 such that a substantial portion of the article of footwear 800, including the upper 802 and the sole structure 804, in the heel region 812 is covered by the frame 870.

As shown in FIG. 35, the lateral and medial sides 890, 892 of the frame 870 include the plurality of apertures 888 that increase in length in a direction extending from the distal side 896 to the proximal side 898. As a result, upper portions of the frame 870 along the lateral, medial, and proximal sides 890, 892, 898 of the frame 870 increasingly cover larger portions of the upper 802 in the direction extending from the distal end 824 to the proximal end 822 such that a heel portion of the upper 802 within the heel region 812 is entirely covered by the proximal side 898 of the frame 870. In some embodiments, the lateral and medial sides 816, 818 of portions of the upper 802 within the forefoot region 808 and/or the midfoot region 810 can be entirely covered by the lateral and medial sides 890, 892, respectively, of the frame 870.

Figure 36:
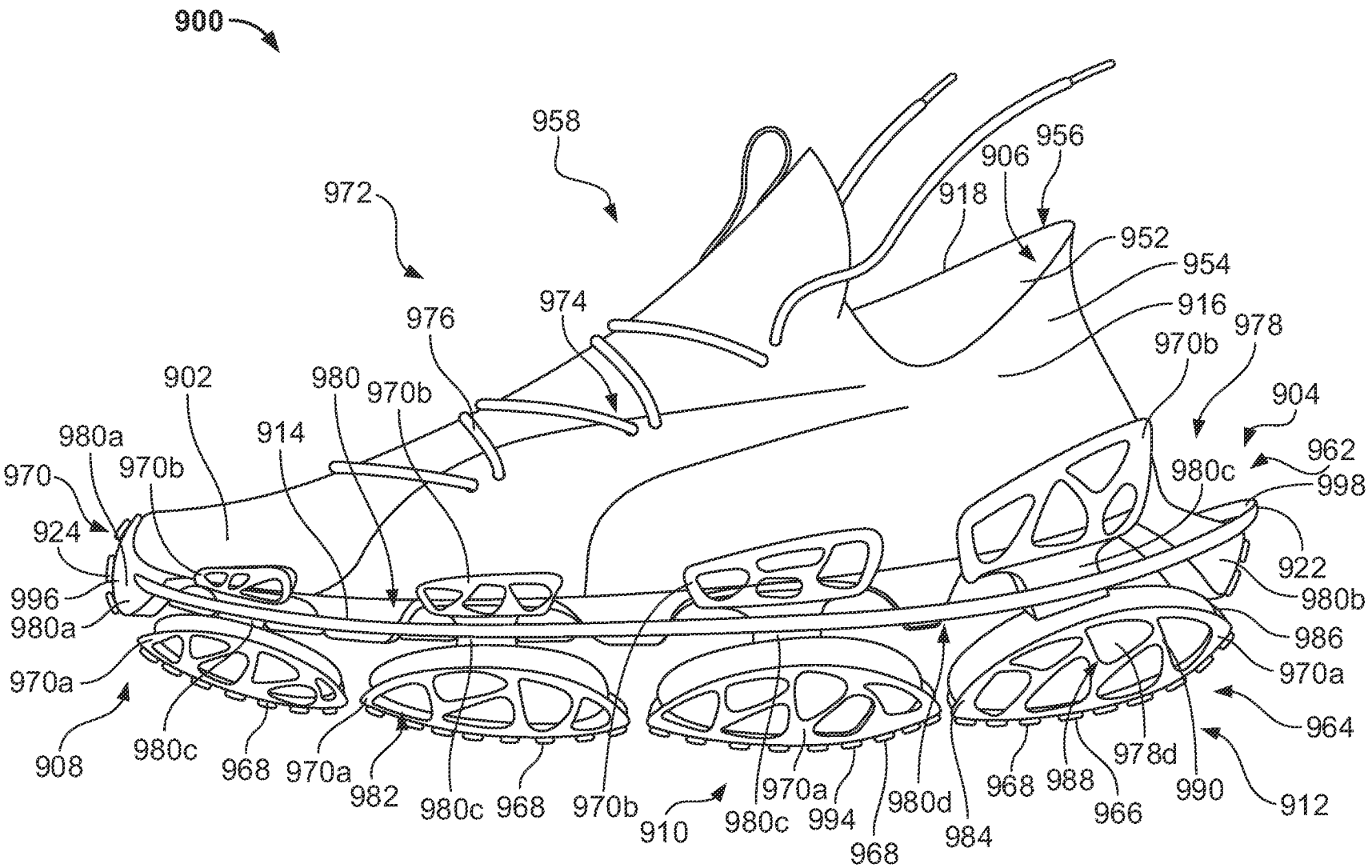
FIG. 36 is a lateral side view of yet another example of an article of footwear that is similar to the article of footwear of FIG. 1.

Referring now to FIG. 36, another exemplary embodiment of an article of footwear 900 is depicted, which includes an upper 902, a sole structure 904, and a frame 970. The article of footwear 900 is similar to previous embodiments, with like elements being indicated by similar reference numerals under the "9xx" series of reference numerals. In contrast to previous embodiments, in the article of footwear 900, the midsole members 978 comprise an interconnected upper portion 980 and a plurality of bottom portions 982 independently connected to parts of the interconnected upper portion 980 in one or more of the forefoot, midfoot, or heel regions 908, 910, 912. Further, the frame 970 includes a plurality of first or bottom frames 970*a* attached to a respective one of the plurality of bottom portions 982 of the midsole members 978 and a plurality of upper frames 970*b* attached to the interconnected upper portion 980 of the midsole members 978.

Referring still to FIG. 36, the interconnected upper portion 980 of the midsole members 978 extends along a bottom side of the upper 902 from the distal end 924 to the proximal end 922 and from the lateral side 916 to the medial side 918 of the upper 902. A first or distal protruding member 980*a* protrudes from the distal end 924 of the sole structure 904, and a second or proximal protruding member 980*b* protrudes from the proximal end 922 of the sole structure 904. In addition, a plurality of connecting protrusions 980*c* extend downwardly from a corresponding one of a plurality of recesses 980*d* disposed along the interconnected upper portion 980 between the first and second protruding members 980*a*, 980*b* that connect the plurality of bottom portions 982 to the interconnected upper portion 980.

In the illustrated embodiment, the plurality of bottom portions 982 includes a first or distal bottom portion 982*a*, a second or distal-midfoot bottom portion 982*b*, a third or proximal-midfoot bottom portion 982*c*, and a fourth or proximal bottom portion 982*d*. Each of the first, second, third, and fourth bottom portions 982*a*, 982*b*, 982*c*, 982*d* of the midsole members 978 are connected to the interconnected upper portion 980 via a respective one of the plurality of connecting protrusions 980*c* extending downwardly from the upper portion 980. In some embodiments, two or more of the first, second, third, and fourth bottom portions 982*a*, 982*b*, 982*c*, 982*d* may be connected to the upper portion 980 by a single connecting protrusion 980*c*. In some embodiments, two or more of the first, second, third, and fourth bottom portions 982*a*, 982*b*, 982*c*, 982*d* can be interconnected. In some embodiments, the plurality of bottom portions 982 can include three or less or five or more bottom portions.

With continued reference to FIG. 36, the plurality of bottom frames 970*a* wrap around a respective one of the bottom portions 982*a*, 982*b*, 982*c*, 982*d* of the midsole members 978. In the illustrated embodiment, the bottom frames 970*a* and the first and second protruding members 980*a*, 980*b* of the upper portion 980 each include an outsole member 968 such that the plurality of bottom frames 970*a* and the first and second protruding members 980*a*, 980*b* collectively define the bottom surface 966 of the outsole 964 of the sole structure 904. Similar to previous embodiments described herein, in some embodiments of the article of footwear 900, the outsole members 968 may be removably attached or fixedly attached to the plurality of bottom frames 970*a* and/or the protruding members 980*a*, 980*b*.

Still referring to FIG. 36, the plurality of upper frames 970*b* extend within the recesses 980*d* and at least partially around the upper portion 980 and the connecting protrusions 980*c* of the midsole members 978, and around lower portions of the upper 902. A frame ring 914 extends along the lateral and medial sides 916, 918 and the proximal and distal ends 922, 924 of the sole structure 904 between the pluralities of bottom and upper frames 970*a*, 970*b*. In addition to providing aesthetic appeal, the frame ring 914 can be configured to provide structural support to the upper portion 980 of the midsole members 978 by structurally connecting the first and second protruding members 980*a*, 980*b*. In some embodiments, the frame ring 914 can extend through an aperture (not shown) that can be defined in the first protruding member 980*a* and/or the second protruding member 980*b*. In some embodiments, the frame ring 914 can be integrally formed with the first protruding member 980*a* and/or the second protruding member 980*b*. In some embodiments, the frame ring 914 is fixedly attached to the upper portion 980 of the midsole members 978. In some embodiments, the frame ring 914 can be connected to each of the plurality of connecting protrusions 980*c* of the midsole members 978 in addition to the first and second protruding members 980*a*, 980*b*. In some embodiments, the frame ring 914 can be removably attached to the sole structure 904.

Referring still to FIG. 36, the fastening mechanism 972 of the article of footwear 900 includes a first fastening member or plurality of lace retainers 974 and a second fastening member or lace 976. In the illustrated embodiment, the plurality of lace retainers 974 are pairs of eyelets disposed on the lateral and medial sides 916, 918 of the upper 902 adjacent to the instep region 958 between the distal end 924 and the opening 956 of the upper 902. The lace 976 extends through the plurality of lace retainers 974 in a crisscrossing manner across the instep region 958. Free ends of the lace 976 extend from the plurality of lace retainers 974 adjacent to the opening 956 of the upper 902 that can be tightened and tied together by a user. In some embodiments, a tongue (not shown) can be included on the upper 902 within the instep region 958, and the plurality of lace retainers 974 can be arranged on the lateral and medial sides 916, 918 of the upper 902 adjacent to sides of the tongue. In some embodiments, the fastening mechanism 972 can further include a third fastening member that can be defined by one or more of: the lattice-work structure formed by one or more apertures 988 of one or more of the plurality of lower frames 970*a*; the plurality of upper frames 970*b*; or the frame ring 914.

Figure 37:
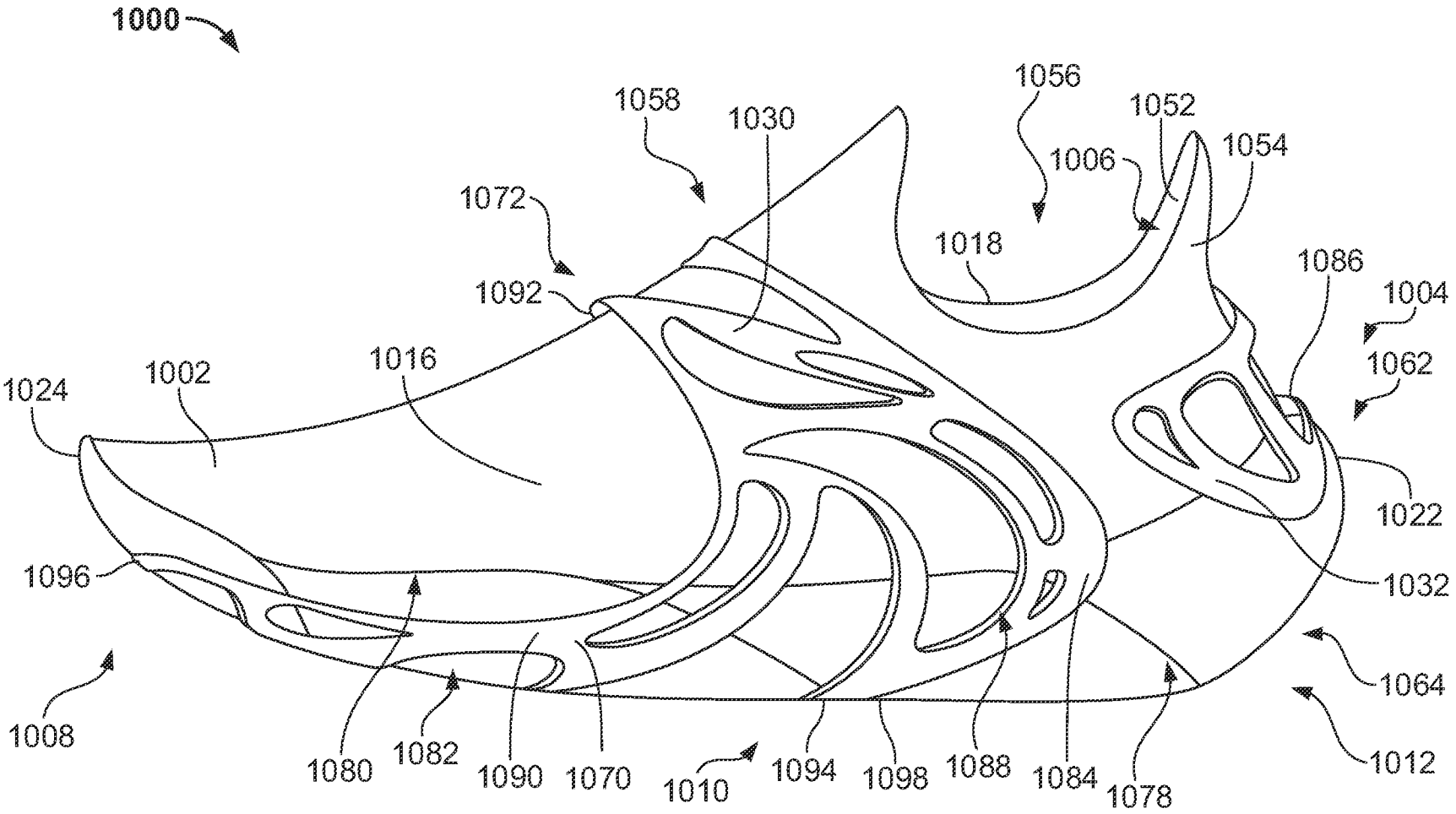
FIG. 37 is a lateral side view of another example of an article of footwear that is similar to the article of footwear of FIG. 1.

Referring now to FIG. 37, yet another exemplary embodiment of an article of footwear 1000 is depicted, which includes an upper 1002, a sole structure 1004, and a frame 1070. The article of footwear 1000 is similar to previous embodiments, with like elements being indicated by similar reference numerals under the "10xx" series of reference numerals. In contrast to previous embodiments, in the article of footwear 1000, a flap 1030 of the frame 1070 extends partially over the sole structure 1004 and over the instep region 1058 from the lateral side 1016 to the medial side 1018 of the upper 1002, and then around the proximal end 1022 of the upper 1002.

As shown in FIG. 37, the bottom side 1094 of the frame 1070 extends along bottom portions 1082 of the midsole members 1078 disposed in the forefoot and midfoot regions 1008, 1010 of the sole structure 1004. In the illustrated embodiment, the distal end 1096 of the frame 1070 does not extend to the distal end 1024 of the sole structure 1004, and the proximal end 1098 of the frame 1070 extends through the midfoot region 1010 of the sole structure 1004. The lateral and medial sides 1090, 1092 of the frame 1070 extend over the upper portions 1080 of the midsole members 1078 within the midfoot and heel regions 1010, 1012. The flap 1030 of the frame 1070 extends from the lateral side 1090 of the frame 1070 and over the instep region 1058 to the medial side 1018 of the upper 1002. The flap 1030 of the frame 1070 then extends along the medial side 1018 of the upper to a lower portion of the proximal end 1022 of the upper 1002 and along at least the upper portions 1080 of the midsole members 1078 disposed toward the proximal end 1022 of the sole structure 1004. The flap 1030 of the frame 170 continues to extend around the proximal end 1022 of the upper 1002 and back to the lateral side 1016 of the upper 1002 where the flap 1030 terminates at a flap end 1032.

With continued reference to FIG. 37, in some embodiments, the frame 1070 can be comprised of two or more materials, for example, at least a portion of the flap 1030 of the frame 1070 can be comprised of a first material that is flexible and the remainder of the frame 1070 can be comprised of a second material this is more rigid than the first material. In such embodiments, the flap 1030 of the frame 1070 can be configured to releasably attach to the upper 1002 and/or the sole structure 1004 such that the flap 1030 of the frame 1070 can be flexed away from the instep region 1058 by a user. In such embodiments, the flap 1030 of the frame 1070 can function as a fastening mechanism 1072 of the article of footwear 1000 by releasably securing the flap end 1032 of the flap 1030 of the frame 1070 to the upper 1002 and/or the sole structure 1004. In such embodiments, the flap end 1032 of the flap 1030 can include a recess or a protrusion and the upper 1002 and/or the sole structure 1004 can include a corresponding recess or protrusion configured to receive the recess or protrusion of the flap end 1032. In some embodiments, the flap 1030 extends from the medial side 1092 of the frame 1070 and then over the instep region 1058 to the lateral side 1016 of the upper 1002. In some embodiments, a first flap extends from the lateral side 1090 of the frame 1070 over a first portion of the instep region 1058 and a second flap extends from the medial side 1092 of the frame 1070 over a second portion of the instep region 1058. In such embodiments, the fastening mechanism 1072 of the article of footwear 1000 can comprise both the first flap on the lateral side 1090 and the second flap on the medial side 1092 of the frame 1070.

Referring to FIGS. 27-37, various components of the example articles of footwear 300, 400, 500, 600, 700, 800, 900, 1000, may be formed through additive manufacturing techniques, such as by one or more of the various 3D printing techniques mentioned above. For example, with reference to the article of footwear 900, the interconnected upper portion 980 of the midsole members 978 of the article of footwear 900 may be 3D printed as a single unitary piece. Further, the plurality of lower frames 970*a*, the plurality of upper frames 970*b*, and/or the frame ring 914 of the article of footwear 900 may be 3D printed.

In other embodiments, other configurations are possible. For example, certain features and combinations of features that are presented with respect to particular embodiments in the discussion above can be utilized in other embodiments and in other combinations, as appropriate. Further, any of the embodiments described herein may be modified to include any of the structures or methodologies disclosed in connection with other embodiments. Additionally, the present disclosure is not limited to articles of footwear of the type specifically shown. Still further, aspects of the articles of footwear of any of the embodiments disclosed herein may be modified to work with any type of footwear, apparel, or other athletic equipment.

As noted previously, it will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

INDUSTRIAL APPLICABILITY

Numerous modifications to the present invention will be apparent to those skilled in the art in view of the foregoing description. Accordingly, this description is to be construed as illustrative only and is presented for the purpose of enabling those skilled in the art to make and use the invention. The exclusive rights to all modifications which come within the scope of the appended claims are reserved.

We claim:

1. A frame for an article of footwear that includes an upper and a sole structure, the frame comprising:

a lattice-work structure formed by a plurality of apertures extending through an exterior surface and an interior surface of the lattice-work structure; and a first outsole member defining an outsole interior surface and an outsole exterior surface between which a thickness of the first outsole member is defined, the first outsole member further having a plurality of first protrusions that extend downward such that the outsole exterior surface of the plurality of first protrusions define a bottom side of the frame that is configured to contact a ground surface, wherein the interior surface of the lattice-work structure and the outsole interior surface are configured for placement adjacent portions of a midsole of the sole structure, wherein the frame is configured to be removably attachable to at least the sole structure of the article of footwear such that, when the frame is removably attached to the article of footwear, at least some of the portions of the midsole adjacent the interior surface of the frame are exposed through the plurality of apertures of the lattice-work structure, wherein the frame comprises a rigid material, wherein the first outsole member is disposed between the bottom side of the frame and the sole structure when the frame is removably attached to the article of footwear, and wherein the lattice-work structure includes a cavity that is configured to receive the first outsole member, the cavity defining an outer shape that matches an outer perimeter of the first outsole member.

2. The frame of claim 1, wherein two or more apertures of the plurality of apertures of the lattice-work structure are configured to receive a portion of a lace of the article of footwear to secure the frame to the sole structure.

3. The frame of claim 2, wherein at least portions of the lattice-work structure of the frame are configured to elastically deform under tension when the lace received within the two or more apertures of the plurality of apertures is in a tightened configuration.

4. The frame of claim 1, wherein the frame is configured to extend along a medial side and a lateral side of the article of footwear, and wherein the lattice-work structure of the frame is configured to extend along at least the lateral side of the article of footwear.

5. The frame of claim 1, wherein the frame is configured to extend along a medial side, a lateral side, and a heel region of the article of footwear, and wherein the lattice-work structure of the frame is configured to extend along at least the lateral side and the heel region of the article of footwear.

6. The frame of claim 1, wherein the lattice-work structure of the frame is configured to extend along a percentage in a range of about 5% to about 60% of an exterior surface of the upper.

7. The frame of claim 1, wherein between about 30% and about 90% of the frame includes the lattice-work structure, expressed as a percentage.

8. The frame of claim 1, wherein between about 60% and about 90% of the frame includes the lattice-work structure, expressed as a percentage.

9. The frame of claim 1, wherein the lattice-work structure of the frame comprises a material that is configured to adapt to a wearer's foot.

10. The frame of claim 1, wherein portions of the lattice-work structure of the frame adjacent the first outsole member have a greater stiffness than portions of the lattice-work structure of the frame adjacent the midsole.

11. The frame of claim 1, wherein the frame further includes a second outsole member.

12. The frame of claim 1, wherein the first outsole member is configured to be disposed in a forefoot region and at least partially in a midfoot region of the sole structure when the frame is removably attached to the article of footwear.

13. The frame of claim 1, wherein the first outsole member is configured to be disposed entirely in a heel region of the sole structure when the frame is removably attached to the article of footwear.

14. The frame of claim 1 further including a plurality of ribs extending from the exterior surface of the frame and arranged between the plurality of apertures.

15. The frame of claim 1, wherein the first outsole member includes one or more second protrusions extending from an inner surface of the first outsole member, the one or more second protrusions configured to be received within one or more gaps in a bottom portion of the midsole.

16. The frame of claim 1 further including one or more second protrusions extending from at least one of a lateral side, a medial side, the bottom side, a distal side, or a proximal side of the frame, the one or more second protrusions configured to be received within one or more gaps in a bottom portion of the midsole.

17. The frame of claim 1, wherein the rigid material is thermoplastic polyurethane (TPU).

18. An article of footwear, comprising:

an upper;

a sole structure having a midsole;

a frame having an exterior surface and an interior surface, the interior surface being adjacent portions of the midsole and the upper in at least a heel region of the article of footwear; and a first outsole member disposed between the midsole and the interior surface of the frame along a bottom side of the frame, wherein the frame is removably attached to at least the sole structure, wherein the frame has a lattice-work structure formed by a plurality of apertures extending through the interior and exterior surfaces such that at least some of the portions of the midsole and the upper adjacent the interior surface are exposed through the plurality of apertures, wherein the lattice-work structure includes a cavity that is configured to receive the first outsole member, the cavity defining an outer shape that matches an outer perimeter of the first outsole member, wherein the frame comprises a rigid material, and wherein one or more protrusions extend from the interior surface of the frame and are configured to be received within gaps of the midsole when the frame is removably attached to at least the sole structure.

19. The article of footwear of claim 18, wherein at least the portion of the midsole in the heel region includes a plurality of midsole members that are disposed between a bottom side of the upper and a bottom side of the frame, and wherein the frame extends over the plurality of midsole members of the sole structure and the one or more protrusions are received within the gaps that extend between bottom portions of the plurality of midsole members.

20. The article of footwear of claim 18, wherein the frame further includes a second outsole member disposed between the midsole and the interior surface of the frame along the bottom side of the frame.

* * * * *